US011980273B2

(12) United States Patent
Mor Yosef et al.

(10) Patent No.: US 11,980,273 B2
(45) **Date of Patent: *May 14, 2024**

(54) BRUSH INTEGRATED CAPSULE WITH FILM-FORMING POLYMER FOR NAIL POLISHING

(71) Applicant: Nailomatic Ltd., Tel-Aviv (IL)

(72) Inventors: Avichay Mor Yosef, Jerusalem (IL); Ron Miller, Herzlia (IL); Omri Moran, Brooklyn, NY (US)

(73) Assignee: Nailomatic Ltd., Tel-Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/985,857

(22) Filed: Nov. 13, 2022

(65) Prior Publication Data

US 2023/0075155 A1 Mar. 9, 2023

Related U.S. Application Data

(63) Continuation of application No. 17/406,170, filed on Aug. 19, 2021, now Pat. No. 11,497,292, which is a (Continued)

(51) Int. Cl.
*A45D 34/04* (2006.01)
*A45D 29/00* (2006.01)
(Continued)

(52) U.S. Cl.
CPC ..... *A45D 34/042* (2013.01); *A45D 29/00* (2013.01); *A46B 9/021* (2013.01);
(Continued)

(58) Field of Classification Search
CPC ..... A45D 34/04; A45D 34/048; A45D 40/26; A45D 40/262; A45D 29/00;
(Continued)

(56) References Cited

U.S. PATENT DOCUMENTS 2,293,211 A * 8/1942 Mureau ..... A45D 40/262
401/176
3,130,734 A 4/1964 Ellis et al.
(Continued)

FOREIGN PATENT DOCUMENTS

CN 85203506 4/1986
CN 1174691 3/1998
(Continued)

OTHER PUBLICATIONS

Ground(s) of Reason of Rejection dated Nov. 3, 2022 From the Korean Intellectual Property Office Re. Application No. 10-2022-7036359 and Its Translation Into English. (6 pages).
(Continued)

*Primary Examiner* — David J Walczak

(57) ABSTRACT

A capsule integrated with a nail polish applying element for usage by a nail polish application apparatus comprising a capsule compartment and a pressure applying element, the capsule comprising a container defining a reservoir containing nail polish fluid, the container comprising an upper face with an opening sealed with a sliding gasket and a bottom face, wherein a volume of the reservoir is reduced and an internal pressure is built in the reservoir when pressure application slides the sliding gasket towards the bottom face, and a container housing comprising a body portion shaped to receive and accommodate the container, one or more conveying tunnels having a proximal end mechanically fixated to a bottom side of the body portion and a nail polish applying element mounted to receive the nail polish fluid from a distal end of the conveying tunnel(s) for applying the nail polish fluid on a nail surface.

17 Claims, 24 Drawing Sheets

Related U.S. Application Data continuation of application No. 16/482,269, filed as application No. PCT/IL2018/050109 on Jan. 31, 2018, now Pat. No. 11,129,461.

(60) Provisional application No. 62/533,720, filed on Jul. 18, 2017, provisional application No. 62/452,461, filed on Jan. 31, 2017.

(51) Int. Cl.
*A46B 9/02* (2006.01)
*A46B 11/00* (2006.01)
*B65D 83/00* (2006.01)

(52) U.S. Cl.
CPC ..... *A46B 11/0055* (2013.01); *B65D 83/0055* (2013.01); *A45D 2200/051* (2013.01); *A45D 2200/055* (2013.01); *A45D 2200/058* (2013.01); *A45D 2200/25* (2013.01); *A46B 11/0075* (2013.01); *A46B 2200/1046* (2013.01)

(58) Field of Classification Search
CPC ..... A45D 2200/51; A45D 2200/055; A45D 2200/058; A45D 2200/25; A45D 2200/054; A46B 11/0055; A46B 11/0075; A46B 2200/1046; A46B 99/021; A46B 11/0041; B65D 83/0055; B65D 83/0022; B65D 83/072; B05C 17/00583; B05C 17/00586
USPC ..... 401/132–135, 152, 153, 171, 176, 184
See application file for complete search history.

(56) References Cited

U.S. PATENT DOCUMENTS

| | | | |
|---|---|---|---|
| 3,292,642 | A | 12/1966 | Del Vecchio |
| 3,411,853 | A | 11/1968 | Hoff |
| 4,149,814 | A | 4/1979 | Manwaring |
| 4,599,008 | A | 7/1986 | Furlong et al. |
| 4,640,637 | A | 2/1987 | Winthrop |
| 4,854,760 | A | 8/1989 | Pike et al. |
| 4,949,858 | A | 8/1990 | Sheridan |
| 5,007,441 | A | 8/1991 | Goldstein |
| 5,253,942 | A | 10/1993 | Stokes |
| 5,309,365 | A | 5/1994 | Sullivan et al. |
| 5,769,099 | A | 6/1998 | Davis et al. |
| 5,778,901 | A | 7/1998 | Abrahamian |
| 5,803,640 | A | 9/1998 | Nakajima et al. |
| 5,992,422 | A | 11/1999 | Ivory |
| 6,085,756 | A | 7/2000 | Sexton et al. |
| 6,209,548 | B1 | 4/2001 | Harrison et al. |
| 6,234,180 | B1 | 5/2001 | Davis et al. |
| 6,283,660 | B1 | 9/2001 | Furlong et al. |
| 6,286,517 | B1 | 9/2001 | Weber et al. |
| 6,575,171 | B1 | 6/2003 | Jacquin |
| 6,695,800 | B1 | 2/2004 | Gary et al. |
| 6,805,512 | B2 | 10/2004 | King |
| 7,472,709 | B1 | 1/2009 | Nickerson |
| 7,810,510 | B2 | 10/2010 | Tranchant |
| 7,918,620 | B2 | 4/2011 | De Ponte |
| 7,985,033 | B2 | 11/2011 | Matsuoka |
| 8,814,291 | B2 | 8/2014 | Bitoh |
| 8,893,731 | B2 | 11/2014 | Pires et al. |
| 8,978,665 | B2 | 3/2015 | Liu et al. |
| 9,007,588 | B1 | 4/2015 | Igarashi |
| 9,179,753 | B2 | 11/2015 | Huynh |
| 10,939,739 | B2 | 3/2021 | Mor Yosef et al. |
| 10,993,520 | B2 | 5/2021 | Mor Yosef et al. |
| 11,044,980 | B1 | 6/2021 | Jackson et al. |
| 11,129,461 | B2 | 9/2021 | Mor Yosef et al. |
| 2001/0047309 | A1 | 11/2001 | Bartholomew et al. |
| 2002/0010528 | A1 | 1/2002 | Bartholomew et al. |
| 2004/0143359 | A1 | 7/2004 | Yogo et al. |
| 2006/0273200 | A1 | 12/2006 | Williams et al. |
| 2007/0014624 | A1 | 1/2007 | Fogelson et al. |
| 2008/0185012 | A1 | 8/2008 | Tran |
| 2009/0149954 | A1 | 6/2009 | Hu et al. |
| 2010/0112032 | A1 | 5/2010 | Guelcher et al. |
| 2010/0252058 | A1 | 10/2010 | Rehkemper et al. |
| 2012/0042891 | A1 | 2/2012 | Rose |
| 2013/0206156 | A1 | 8/2013 | Salo |
| 2014/0133895 | A1 | 5/2014 | Dockery |
| 2015/0007841 | A1 | 1/2015 | Yamasaki |
| 2015/0020834 | A1 | 1/2015 | Bitoh |
| 2015/0335131 | A1 | 11/2015 | Ortiz et al. |
| 2016/0095411 | A1 | 4/2016 | Smith |
| 2016/0270504 | A1 | 9/2016 | Miyamoto |
| 2016/0270506 | A1 | 9/2016 | Kafuku |
| 2016/0353859 | A1 | 12/2016 | Melul |
| 2016/0374448 | A1 | 12/2016 | Yamasaki |
| 2019/0313765 | A1 | 10/2019 | Leong |
| 2019/0365077 | A1 | 12/2019 | Mor Yosef et al. |
| 2021/0120935 | A1 | 4/2021 | Shashou et al. |
| 2021/0186177 | A1 | 6/2021 | Mor Yosef et al. |
| 2021/0244156 | A1 | 8/2021 | Mor Yosef et al. |
| 2021/0378383 | A1 | 12/2021 | Moe Yosef et al. |
| 2022/0125179 | A1 | 4/2022 | Mor Yosef et al. |
| 2022/0400829 | A1 | 12/2022 | Mor Yosef et al. |
| 2023/0071882 | A1 | 3/2023 | Mor Yosef et al. |

FOREIGN PATENT DOCUMENTS

| | | |
|---|---|---|
| CN | 1277589 | 12/2000 |
| CN | 2508611 | 9/2002 |
| CN | 1524051 | 8/2004 |
| CN | 1957797 | 5/2007 |
| CN | 201718715 | 1/2011 |
| CN | 201743178 | 2/2011 |
| CN | 202941595 | 5/2013 |
| CN | 103930001 | 7/2014 |
| CN | 104621952 | 5/2015 |
| CN | 201743178 | 2/2016 |
| CN | 106263462 | 1/2017 |
| DE | 337676 | 1/1922 |
| EP | 0208454 | 1/1987 |
| EP | 0610639 | 8/1994 |
| EP | 0791307 | 8/1997 |
| FR | 2770495 | 5/1999 |
| GB | 2206486 | 1/1989 |
| GB | 2344776 | 6/2000 |
| JP | 42-17985 | 10/1942 |
| JP | 61-144053 | 9/1986 |
| JP | 09-118350 | 5/1997 |
| JP | 2000-296868 | 10/2000 |
| JP | 3149757 | 1/2001 |
| JP | 2004-250101 | 9/2004 |
| JP | 2004-313791 | 11/2004 |
| JP | 2006-043383 | 2/2006 |
| JP | 2011-056268 | 3/2011 |
| JP | 2013-199324 | 10/2013 |
| JP | 2014-147442 | 8/2014 |
| JP | 6268771 | 1/2015 |
| KR | 20-0390050 | 7/2005 |
| WO | WO 03/004371 | 1/2013 |
| WO | WO 2013/029017 | 2/2013 |
| WO | WO 2016/014132 | 1/2016 |
| WO | WO 2016/193108 | 12/2016 |
| WO | WO 2017/163237 | 9/2017 |
| WO | WO 2018/142399 | 8/2018 |

OTHER PUBLICATIONS

Communication Pursuant to Article 94(3) EPC dated Mar. 4, 2022 From the European Patent Office Re. Application No. 18748805.1. (4 Pages).

Decision of Rejection dated Mar. 1, 2022 From the State Intellectual Property Office of the People's Republic of China Re. Application No. 201880018344.1 and its Summary in English. (13 Pages).

International Preliminary Report on Patentability dated Aug. 15, 2019 From the International Bureau of WIPO Re. Application No. PCT/IL2018/050109. (12 Pages).

(56) References Cited

OTHER PUBLICATIONS

International Search Report and the Written Opinion dated Jul. 6, 2018 From the International Searching Authority Re. Application No. PCT/IL2018/050109. (21 Pages).
Invitation to Pay Additional Fees dated May 4, 2018 From the International Searching Authority Re. Application No. PCT/IL2018/050109. (3 Pages).
Notice of Allowance dated Jan. 11, 2022 From the Re. U.S. Appl. No. 17/191,847. (17 Pages).
Notice of Allowance dated Jul. 14, 2022 from Re. U.S. Appl. No. 17/406,170. (11 pages).
Notice of Allowance dated May 14, 2021 from the Re. U.S. Appl. No. 16/482,269. (6pages).
Notice of Allowance dated Aug. 17, 2022 from Re. U.S. Appl. No. 17/243,614. (3 pages).
Notice of Allowance dated Mar. 17, 2021 From the Re. U.S. Appl. No. 16/481,851. 3 Pages).
Notice of Allowance dated Nov. 20, 2020 From the Re. U.S. Appl. No. 16/481,856. (13 Pages).
Notice of Allowance dated Apr. 27, 2022 from Re. U.S. Appl. No. 17/569,587. (16 pages).
Notice of Imported Citations Action dated Apr. 19, 2021 from the Re. U.S. Appl. No. 17/191,847. (6 pages).
Notice of Reason(s) for Rejection dated Jan. 11, 2022 From the Japan Patent Office Re. Application No. 2019-541283 and Its Translation Into English (19 pages).
Notice of Reason(s) for Rejection dated Feb. 22, 2022 From the Japan Patent Office Re. Application No. 2019-561390 with its English translation. (13 pages).
Notice of Reasons for Rejection dated Feb. 22, 2022 From the Japan Patent Office Re. Application No. 2019-561391 and Its Translation Into English. (11 pages).
Notification of Office Action and Search Report dated Jul. 3, 2020 From the State Intellectual Property Office of the People's Republic of China Re. Application No. 201880018297.0. (8 Pages).
Notification of Office Action and Search Report dated Jul. 6, 2021 From the State Intellectual Property Office of the People's Republic of China Re. Application No. 201880013196.4.(12 Pages).
Notification of Office Action and Search Report dated Aug. 19, 2021 From the State Intellectual Property Office of the People's Republic of China Re. Application No. 201880018344.1 and Its Translation of Office Action Into English. (24 Pages).
Notification of Office Action dated Apr. 2, 2022 From the State Intellectual Property Office of the People's Republic of China Re. Application No. 201880013196.4 and Its Translation Into English. (8 Pages).
Notification of Office Action Dated Mar. 9, 2021 From the State Intellectual Property Office of the People's Republic of China Re. Application No. 201880018297.0. (5 Pages).
Notification of Office Action dated Sep. 23, 2021 From the State Intellectual Property Office of the People's Republic of China Re. Application No. 201880018297.0 and Its English Summary. 4 Pages).
Office Action dated Aug. 15, 2022 From the Israel Patent Office Re. Application No. 268381. (4 Pages).
Office Action dated Aug. 22, 2022 From the Israel Patent Office Re. Application No. 268382. (4 Pages).
Office Action dated Aug. 23, 2021 From the Israel Patent Office Re. Application No. 268383 and Its Translation Into English. (14 Pages).
Official Action dated Apr. 1, 2022 from Re. U.S. Appl. No. 17/406,170. (19 pages).
Official Action dated Feb. 5, 2021 From the Re. U.S. Appl. No. 16/482,269. (22 Pages).
Official Action dated Mar. 8, 2022 from Re. U.S. Appl. No. 17/569,587. (26 pages).
Official Action dated Sep. 21, 2021 from the Re. U.S. Appl. No. 17/191,847. (41 pages).
Official Action dated Jan. 27, 2021 From the Re. U.S. Appl. No. 16/481,851. (22 Pages).
Official Action dated Apr. 29, 2022 from Re. U.S. Appl. No. 17/243,614. (25 pages).
Relatório de Busca e Parecer [Search Report and Opinion] dated Jul. 21, 2022 From the Serviço Público Federal, Ministério da Economia, Instituto Nacional da Propriedade Industrial do Brasil Re. Application No. BR112019015618-6. (4 Pages).
Supplementary European Search Report and the European Search Opinion dated Aug. 10, 2020 From the European Patent Office Re. Application No. 18748805.1. (7 Pages).
Translation Dated Aug. 11, 2022 of Grounds of Reason of Rejection dated Jul. 26, 2022 From the Korean Intellectual Property Office Re. Application No. 10-2019-7025223. (9 Pages).
Translation Dated Aug. 11, 2022 of Grounds of Reason of Rejection dated Jul. 26, 2022 From the Korean Intellectual Property Office Re. Application No. 10-2019-7025225. (11 Pages).
Translation Dated Mar. 18, 2021 of Notification of Office Action dated Mar. 9, 2021 From the State Intellectual Property Office of the People's Republic of China Re. Application No. 201880018297.0. (8 Pages).
Translation Dated Jul. 21, 2021 of Notification of Office Action dated Jul. 6, 2021 From the State Intellectual Property Office of the People's Republic of China Re. Application No. 201880013196.4. (8 Pages).
Supplementary European Search Report and the European Search Opinion dated Feb. 21, 2023 From the European Patent Office Re. Application No. 22197226.8. (10 Pages).
Requisition by the Examiner dated Aug. 10, 2023 From the Innovation, Science and Economic Development Canada, Canadian Intellectual Property Office Re. Application No. 3,050,861. (4 Pages).

* cited by examiner

BRUSH INTEGRATED CAPSULE WITH FILM-FORMING POLYMER FOR NAIL POLISHING

RELATED APPLICATIONS

This application is a continuation of U.S. patent application Ser. No. 17/406,170, filed on Aug. 19, 2021, which is a continuation of U.S. patent application Ser. No. 16/482,269 filed on Jul. 31, 2019, now U.S. Pat. No. 11,129,461, which is a a National Phase of PCT Patent Application No. PCT/IL2018/050109 having International Filing Date of Jan. 31, 2018, which claims the benefit of priority under 35 USC § 119(e) of U.S. Provisional Patent Application Nos. 62/452,461 filed on Jan. 31, 2017 and 62/533,720 filed on Jul. 18, 2017.

The contents of the above applications are all incorporated by reference as if fully set forth herein in their entirety.

FIELD AND BACKGROUND OF THE INVENTION

The present invention, in some embodiments thereof, relates to a storage and dispensing capsule for nail polish fluid and, more particularly, but not exclusively, to a disposable storage and dispensing capsule for nail polish fluid with an integrated brush.

Applying nail polish to fingernails and/or toenails has been practiced since ancient times. Decorating the finger and/or toe nails is still fashionable in modern times as many people, in particular woman apply nail polish to decorate their fingernails and/or toenails.

The nail polish is a lacquer fluid that once applied to the nail surface dries to form a solid layer over the nail surface.

Presently, manual nail polish application is the most common method. The manual nail polish application may require some expertise, skills and/or experience and may be time consuming. In addition manual application of the nail polish to one self's nails may be physically challenging due to the need to master the art in both hands and in case of the foot toenails reaching conveniently and efficiently the toes may also present difficulties. While many individuals have mastered the art of applying the nail polish manually for themselves, nail polish application may typically be practiced by professional manicurists and/or pedicurists.

SUMMARY OF THE INVENTION

According to a first aspect of the present invention there is provided a capsule integrated with a nail polish applying element for usage by a nail polish application apparatus comprising a capsule compartment and a pressure applying element, the capsule comprising:

- A container defining a reservoir containing nail polish fluid, the container comprising an upper face with an opening sealed with a sliding gasket and a bottom face. Wherein a volume of the reservoir is reduced and an internal pressure is built in the reservoir when pressure application slides the sliding gasket towards the bottom face.
- A container housing comprising:
  - A body portion sized and shaped to receive and accommodate the container.
  - One or more conveying tunnels having a proximal end mechanically fixated to a bottom side of the body portion.
  - A nail polish applying element mounted to receive the nail polish fluid from a distal end of the one or more conveying tunnels for applying the nail polish fluid on a nail surface.

According to a second aspect of the present invention there is provided a capsule integrated with a nail polish applying element for usage by a nail polish application apparatus comprising a capsule compartment and a pressure applying element, the capsule comprising:

- A body portion defining a reservoir containing nail polish fluid, the body portion having an upper face with an opening sealed with a sliding gasket.
- One or more conveying tunnels having a proximal end mechanically fixated to a bottom side of the body portion.
- A nail polish applying element mounted to receive the nail polish fluid from a distal end of the one or more conveying tunnels for applying the nail polish fluid on a nail surface.

Wherein a volume of the reservoir is reduced and an internal pressure is built in the reservoir when pressure application slides the sliding gasket towards the bottom side.

According to a third aspect of the present invention there is provided a capsule integrated with a nail polish applying element for usage by a nail polish application apparatus comprising a capsule compartment and a pressure applying element, the capsule comprising:

- A body portion defining a reservoir containing nail polish fluid, one or more high elasticity faces of the body portion having an elasticity coefficient higher than the elasticity coefficient of other faces of the body portion, the one or more high elasticity faces is a member of a group consisting of: a top face, a bottom face and a circumferential lateral face.
- One or more conveying tunnels having a proximal end mechanically fixated to a bottom side of the body portion.
- A nail polish applying element mounted to receive the nail polish fluid from a distal end of the one or more conveying tunnels for applying the nail polish fluid on a nail surface.

Wherein a volume of the reservoir is reduced and an internal pressure is built in the reservoir when the body portion is deformed by pressure application to one or more of the other faces forcing the one or more high elasticity faces to fold.

According to a fourth aspect of the present invention there is provided a capsule integrated with a nail polish applying element for usage by a nail polish application apparatus comprising a capsule compartment and a pressure applying element, the capsule comprising:

- A body portion defining a reservoir containing nail polish fluid, the body portion is constructed as a tubular body portion having a circumferential lateral wall constructed with one or more annular corrugations disposed about a center axis of the body portion.
- One or more conveying tunnels having a proximal end mechanically fixated to a bottom side of the body portion.
- A nail polish applying element mounted to receive the nail polish fluid from a distal end of the one or more conveying tunnels for applying the nail polish fluid on a nail surface.

Wherein a volume of the reservoir is reduced and an internal pressure is built in the reservoir when the pressure application to a top face of the body portion forces the one or more corrugations to fold.

According to a fifth aspect of the present invention there is provided a capsule integrated with a nail polish applying element for usage by a nail polish application apparatus comprising a capsule compartment and a pressure applying element, the capsule comprising:

A body portion defining a reservoir containing nail polish fluid.

One or more conveying tunnels having a proximal end mechanically fixated to a bottom side of the body portion, at least a portion of one or more longitude faces of the one or more conveying tunnels having a high elasticity coefficient adapted to fold under pressure applied by a peristaltic pump.

A nail polish applying element mounted to receive the nail polish fluid from a distal end of the one or more conveying tunnels for applying the nail polish fluid on a nail surface.

Wherein a volume of the reservoir is reduced and an internal pressure is built in the reservoir when a displacement movement is induced by the peristaltic pump in the one or more conveying tunnels.

According to a sixth aspect of the present invention there is provided a capsule integrated with a nail polish applying element for usage by a nail polish application apparatus comprising a capsule compartment and a pressure applying element, the capsule comprising:

A body portion defining a reservoir containing nail polish fluid.

One or more conveying tunnels having a proximal end mechanically fixated to a bottom side of the body portion.

A nail polish applying element mounted to receive the nail polish fluid from a distal end of the one or more conveying tunnels for applying the nail polish fluid on a nail surface.

Wherein a compression fluid injected at high pressure into the body portion through one or more openings punctured in the body portion builds an internal pressure in the reservoir.

According to a seventh aspect of the present invention there is provided a method for manufacturing a capsule integrated with a nail polish applying element, comprising:

Producing a body portion defining a reservoir adapted to contain nail polish fluid.

Producing a discharge nozzle having one or more conveying tunnels.

Producing a nail polish applying element.

Mechanically coupling a proximal end of the discharge nozzle to a bottom side of the body portion.

Mechanically coupling the nail polish applying element to a distal end of the discharge nozzle.

Inserting the nail polish fluid into the body portion.

Sealing the body portion.

With reference to the first and/or the seventh aspects of the invention, according to a first implementation, the capsule is provided as a kit in which the container is provided separately from the container housing.

With reference to the first, the second, the third, the fourth, the fifth, the sixth and/or the seventh aspects of the invention and/or the first implementation, according to a second implementation, the nail polish fluid is a member selected from a group consisting of: a nail polish fluid, a base coating fluid, a top coating fluid, a drying fluid, a nail art polish fluid and a medical nail treatment fluid.

With reference to the first, the second, the third, the fourth, the fifth, the sixth and/or the seventh aspects of the invention and/or any of the previous implementations, according to a third implementation, the nail surface is a member of a group consisting of: a nail surface of a human hand finger and a nail surface of a human foot toe.

With reference to the first and/or the seventh aspects of the invention and/or any of the previous implementations, according to a fourth implementation, the container is air sealed.

With reference to the first, the second, the third, the fourth, the fifth, the sixth and/or the seventh aspects of the invention and/or any of the previous implementations, according to a fifth implementation, the body portion is constructed as an inverted cup-shaped body.

With reference to the first, the second, the third, the fourth, the fifth, the sixth and/or the seventh aspects of the invention and/or any of the previous implementations, according to a sixth implementation, the body portion is constructed with a flange-like rim around a top end of the body portion.

With reference to the first and/or the seventh aspects of the invention and/or any of the previous implementations, according to a seventh implementation, the nail polish fluid is released from the container into the body portion when the internal pressure resulting from the pressure application fractures the bottom face.

With reference to the first and/or the seventh aspects of the invention and/or the seventh implementation, according to an eighth implementation, the nail polish fluid is released from the container into the body portion when the internal pressure resulting from the pressure application fractures the bottom face.

With reference to the first and/or the seventh aspects of the invention and/or the seventh and/or eighth implementations, according to a ninth implementation, the nail polish fluid is released from the bottom face is fractured at a weakened surface of the bottom face. The weakened surface is automatically breached by the internal pressure.

With reference to the first and/or the seventh aspects of the invention and/or the seventh, eighth and/or ninth implementations, according to a tenth implementation, the bottom face is fractured by opening a valve located in the bottom face, the valve having a first state in which the valve is closed and state and a second state in which the valve is open. The valve automatically transitions from the first state to the second state under the internal pressure.

With reference to the first and/or the seventh aspects of the invention and/or the seventh, eighth and/or ninth implementations, according to a tenth implementation, the bottom face is fractured by opening a valve located in the bottom face, the valve having a first state in which the valve is closed and state and a second state in which the valve is open. The valve automatically transitions from the first state to the second state under the internal pressure.

With reference to the first and/or the seventh aspects of the invention and/or the seventh, eighth, ninth and/or tenth implementations, according to an eleventh implementation, the bottom face is fractured by one or more internal puncturing elements located inside the body portion. The internal puncturing element punctures the container when the pressure application forces the container to slide down in the body portion towards a bottom side of the body portion.

With reference to the first and/or the seventh aspects of the invention and/or the seventh, eighth, ninth, tenth and/or eleventh implementations, according to a twelfth implementation, the bottom face is fractured by one or more external puncturing elements separated from the capsule.

Optionally, with reference to the first, the second, the third, the fourth, the fifth, the sixth and/or the seventh aspects of the invention and/or any of the previous implementations, according to a thirteenth implementation, a top seal seals a top side of the body portion. The top seal is broken by the pressure application and/or by a user of the nail polish application apparatus.

Optionally, with reference to the first and/or the seventh aspects of the invention and/or any of the previous implementations, according to a fourteenth implementation, one or more circumferential sealing elements are disposed between a circumferential lateral wall of the body portion and a circumferential lateral wall of the container.

Optionally, with reference to the first and/or the seventh aspects of the invention and/or any of the previous implementations, according to a fifteenth implementation, one or more stoppage elements included in the capsule are adapted to lock the container in a static position when the pressure is applied.

Optionally, with reference to the first, the second, the third, the fourth, the fifth, the sixth and/or the seventh aspects of the invention and/or any of the previous implementations, according to a sixteenth implementation, a dynamically adjustable shutter is included in the capsule to control a flow rate of the nail polish fluid through the one or more conveying tunnels.

With reference to the first, the second, the third, the fourth, the fifth, the sixth and/or the seventh aspects of the invention and/or any of the previous implementations, according to a seventeenth implementation, the nail polish applying element comprises one or more members of a group consisting of: a plurality of hair strands, an elastic tube, a solid pipe (e.g. a syringe needle, etc.), a sponge, a wiper and a combination of at least two thereof.

With reference to the first, the second, the third, the fourth, the fifth, the sixth and/or the seventh aspects of the invention and/or any of the previous implementations, according to an eighteenth implementation, one or more of the conveying tunnels include one or more spraying outlets located at a distal end of the one or more conveying tunnel.

With reference to the first, the second, the third, the fourth, the fifth, the sixth and/or the seventh aspects of the invention and/or any of the previous implementations, according to a nineteenth implementation, one or more of the conveying tunnels are constructed as an elongated strip.

With reference to the first, the second, the third, the fourth, the fifth, the sixth and/or the seventh aspects of the invention and/or any of the previous implementations, according to a twentieth implementation, the nail polish applying element is mounted in line with a vertical axis of the one or more conveying tunnels.

With reference to the first, the second, the third, the fourth, the fifth, the sixth and/or the seventh aspects of the invention and/or any of the previous implementations, according to a twenty first implementation, the nail polish applying element is mounted in a tilted position with respect to a vertical axis of the one or more conveying tunnel.

Optionally, with reference to the first, the second, the third, the fourth, the fifth, the sixth and/or the seventh aspects of the invention and/or any of the previous implementations, according to a twenty second implementation, the capsule comprises a removable cover placed over at least the nail polish applying element.

Optionally, with reference to the first, the second, the third, the fourth, the fifth, the sixth and/or the seventh aspects of the invention and/or any of the previous implementations, according to a twenty third implementation, the reservoir is adapted to contain an amount of the nail polish fluid which is sufficient for a single application of the nail polish fluid to a number of nail surfaces, the number is in a range of 1 to 20.

Optionally, with reference to the first, the second, the third, the fourth, the fifth, the sixth and/or the seventh aspects of the invention and/or any of the previous implementations, according to a twenty fourth implementation, one or more stirring object are disposed inside the reservoir for stirring the nail polish fluid when the container is shaken.

Optionally, with reference to the first, the second, the third, the fourth, the fifth, the sixth and/or the seventh aspects of the invention and/or any of the previous implementations, according to a twenty fifth implementation, the reservoir contains two or more types of the nail polish fluid contained in separate chambers defined in the reservoir. The two or more types of the nail polish fluid mix together in the body portion after released from the container.

With reference to the first, the second, the third, the fourth, the fifth, the sixth and/or the seventh aspects of the invention and/or any of the previous implementations, according to a twenty sixth implementation, the reservoir is adapted to contain an amount of the nail polish fluid which is sufficient for a single application of the nail polish fluid to a number of nail surfaces, the number is in a range of 1 to 20.

With reference to the first, the second, the third, the fourth, the fifth, the sixth and/or the seventh aspects of the invention and/or any of the previous implementations, according to a twenty seventh implementation, the body portion is air sealed.

With reference to the second, the third, the fourth, the fifth, the sixth and/or the seventh aspects of the invention and/or any of the previous implementations, according to a twenty eighth implementation, the nail polish is released from the reservoir into the one or more conveying tunnel through one or more opening punctured by one or more external puncturing element separated from the capsule, the one or more opening is punctured in one of: the bottom side of the body portion and inside the one or more conveying tunnel.

With reference to the second, the third, the fourth, the fifth, the sixth and/or the seventh aspects of the invention and/or any of the previous implementations, according to a twenty ninth implementation, the nail polish is released from the reservoir into the one or more conveying tunnel through one or more openings opened by the internal pressure. The one or more openings are located in one or more of: the bottom side of the body portion and inside the one or more conveying tunnels.

With reference to the second, the third, the fourth, the fifth, the sixth and/or the seventh aspects of the invention and/or the twenty ninth implementation, according to a thirtieth implementation, the one or more openings are utilized as a weakened surface that is automatically breached by the internal pressure.

With reference to the second, the third, the fourth, the fifth, the sixth and/or the seventh aspects of the invention and/or the twenty ninth implementation, according to a thirty first implementation, the one or more openings are utilized by a valve having a first state in which the valve is closed and a second state in which the valve is open. The valve automatically transitions from the first state to the second state by the internal pressure.

With reference to the first, second, the third, the fourth, the fifth, the sixth and/or the seventh aspects of the invention and/or any of the previous implementations, according to a thirty second implementation, the nail polish is released from the reservoir to flow through the one or more conveying tunnels by breaking an internal weakened surface disposed inside the one or more conveying tunnel to contain the nail polish fluid. The internal weakened surface is broken by an external pressure deforming the one or more conveying tunnels.

With reference to the first, second, the third, the fourth, the fifth, the sixth and/or the seventh aspects of the invention and/or any of the previous implementations, according to a thirty third implementation, the reservoir occupies a part of the body portion. One or more faces of the reservoir are defined by a membrane surface disposed inside the body portion. The membrane surface is fractured by one or more internal puncturing elements located inside the body portion. The internal puncturing element(s) puncture the membrane surface when the internal pressure forces the membrane to press against the one or more internal puncturing elements.

With reference to the first, second, the third, the fourth, the fifth, the sixth and/or the seventh aspects of the invention and/or the any of the previous implementations, according to a thirty fourth implementation, the nail polish fluid is contained in an inner container disposed inside the body portion. The internal pressure fractures the inner container thus releasing the nail polish fluid into the body portion.

With reference to the first, second, the third, the fourth, the fifth, the sixth and/or the seventh aspects of the invention and/or the thirty fourth implementation, according to a thirty fifth implementation, the inner container is fractured at a weakened surface of the inner container. The weakened surface is automatically breached by the internal pressure.

With reference to the first, second, the third, the fourth, the fifth, the sixth and/or the seventh aspects of the invention and/or the thirty fourth implementation, according to a thirty sixth implementation, the inner container is fractured by one or more puncturing elements. The one or more puncturing elements are members of a group consisting of: an internal puncturing element located inside the body portion and an external puncturing element separated from the capsule.

Optionally, with reference to the first, the second, the third, the fourth, the fifth, the sixth and/or the seventh aspects of the invention and/or any of the previous implementations, according to a thirty seventh implementation, one or more stirring object are disposed inside the reservoir for stirring the nail polish fluid when the capsule is shaken.

Optionally, with reference to the second, the third, the fourth, the fifth, the sixth and/or the seventh aspects of the invention and/or any of the previous implementations, according to a thirty eighth implementation, the body portion comprises two or more types of the nail polish fluid contained in separate chambers in the body portion. The two or more types of the nail polish fluid mix together after released from the separate chambers.

Optionally, with reference to the first, the second and/or the seventh aspects of the invention and/or any of the previous implementations, according to a thirty ninth implementation, the sliding gasket includes one or more magnetic elements which react to an induced magnetic field to apply the pressure. The reaction is a member of a group consisting of: attraction and repulsion.

With reference to the fifth and/or the seventh aspects of the invention and/or any of the previous implementations, according to a fortieth implementation, one or more face of the body portion having a high elasticity coefficient are folded as result of the displacement movement thus reducing the volume.

With reference to the fifth and/or the seventh aspects of the invention and/or any of the previous implementations, according to a forty first implementation, one or more openings are punctured in the body portion to allow air to replace nail polish fluid extruded from the body portion by the displacement movement.

With reference to the sixth and/or the seventh aspects of the invention and/or any of the previous implementations, according to a forty second implementation, the compression fluid is a member of a group consisting of: a gas and a liquid.

With reference to the first, the second, the third, the fourth, the fifth, the sixth and/or the seventh aspects of the invention and/or any of the previous implementations, according to a forty third implementation, the body portion and the discharge nozzle are produced as a single piece.

With reference to the first, the second, the third, the fourth, the fifth, the sixth and/or the seventh aspects of the invention and/or any of the previous implementations, according to a forty fourth implementation, the body portion, the discharge nozzle and the nail polish applying element are produced as a single piece.

With reference to the first, the second, the third, the fourth, the fifth, the sixth and/or the seventh aspects of the invention and/or any of the previous implementations, according to a forty fifth implementation, the body portion is produced from one or more materials, the one or more materials are members of a group consisting of: a polymer, a metal, glass and a ceramic fluid.

With reference to the third the fifth and/or the seventh aspects of the invention and/or any of the previous implementations, according to a forty sixth implementation, one or more high elasticity faces of the body portion has an elasticity coefficient higher than the elasticity coefficient of other faces of the body portion. The one or more high elasticity faces are members of a group consisting of: a top face, a bottom face and a circumferential lateral face.

With reference to the third the fifth and/or the seventh aspects of the invention and/or any of the previous implementations, according to a forty sixth implementation, one or more high elasticity faces of the body portion has an elasticity coefficient higher than the elasticity coefficient of other faces of the body portion. The one or more high elasticity faces are members of a group consisting of: a top face, a bottom face and a circumferential lateral face.

With reference to the fourth and/or the seventh aspects of the invention and/or any of the previous implementations, according to a forty seventh implementation, the body portion is constructed as a tubular body portion having a circumferential lateral wall constructed with one or more annular corrugation disposed about a center axis of the body portion.

With reference to the first, the second, the third, the fourth, the fifth, the sixth and/or the seventh aspects of the invention and/or any of the previous implementations, according to a forty eighth implementation, the body portion is produced from one or more materials, the one or more materials are members of a group consisting of: a polymer, a metal, glass and a ceramic fluid.

Optionally, with reference to the first, the fourth, the fifth, the sixth and/or the seventh aspects of the invention and/or any of the previous implementations, according to a forty ninth implementation, a container adapted for accommodation in the body portion is produced. The container defines the reservoir adapted to contain the nail polish fluid. Wherein the inserting further comprises inserting the nail polish fluid into the container.

With reference to the first, the second, the third, the fourth, the fifth, the sixth and/or the seventh aspects of the invention and/or the forty ninth implementation, according to a fiftieth implementation, the container is produced from one or more materials. The one or more materials are members of a group consisting of: a polymer, a metal, glass and a ceramic fluid.

Optionally, with reference to the first, the second and/or the seventh aspects of the invention and/or any of the previous implementations, according to a fifty first implementation, an inner container is produced. The inner container defines the reservoir adapted to contain the nail polish fluid. Wherein the inserting further comprises disposing the inner container inside the body portion, inserting the nail polish fluid into the inner container and sealing the inner container and the body portion.

With reference to the first, the second, the third, the fourth, the fifth, the sixth and/or the seventh aspects of the invention and/or the fifty first implementation, according to a fifty second implementation, the inner container is produced from one or more fluid, the one or more fluid is a member of a group consisting of: a polymer, a metal, glass and a metallic foil.

With reference to the first, the second, the third, the fourth, the fifth, the sixth and/or the seventh aspects of the invention and/or any of the previous implementations, according to a fifty third implementation, one or more puncturing element are disposed inside the body portion.

With reference to the first, the second, the third, the fourth, the fifth, the sixth and/or the seventh aspects of the invention and/or any of the previous implementations, according to a fifty fourth implementation, the nail polish applying element comprises one or more member of a group consisting of: a plurality of hair strands, one or more elastic tube, a sponge, a wiper and a combination of at least two thereof.

With reference to the first, the second, the third, the fourth, the fifth, the sixth and/or the seventh aspects of the invention and/or any of the previous implementations, according to a fifty fifth implementation, the nail polish applying element is produced by stapling a plurality of hair strands into the discharge nozzle.

Optionally, with reference to the first, the second, the third, the fourth, the fifth, the sixth and/or the seventh aspects of the invention and/or any of the previous implementations, according to a fifty sixth implementation, one or more hollow wedges are inserted through the nail polish applying element and through the discharge nozzle into the body portion. The one or more wedges forms the one or more conveying tunnels.

Optionally, with reference to the first, the second, the third, the fourth, the fifth, the sixth and/or the seventh aspects of the invention and/or the fifty sixth implementation, according to a fifty seventh implementation, the one or more hollow wedges serves as a puncturing element for puncturing a reservoir defined in the body portion.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION OF EMBODIMENTS OF THE INVENTION

Figure 1A:
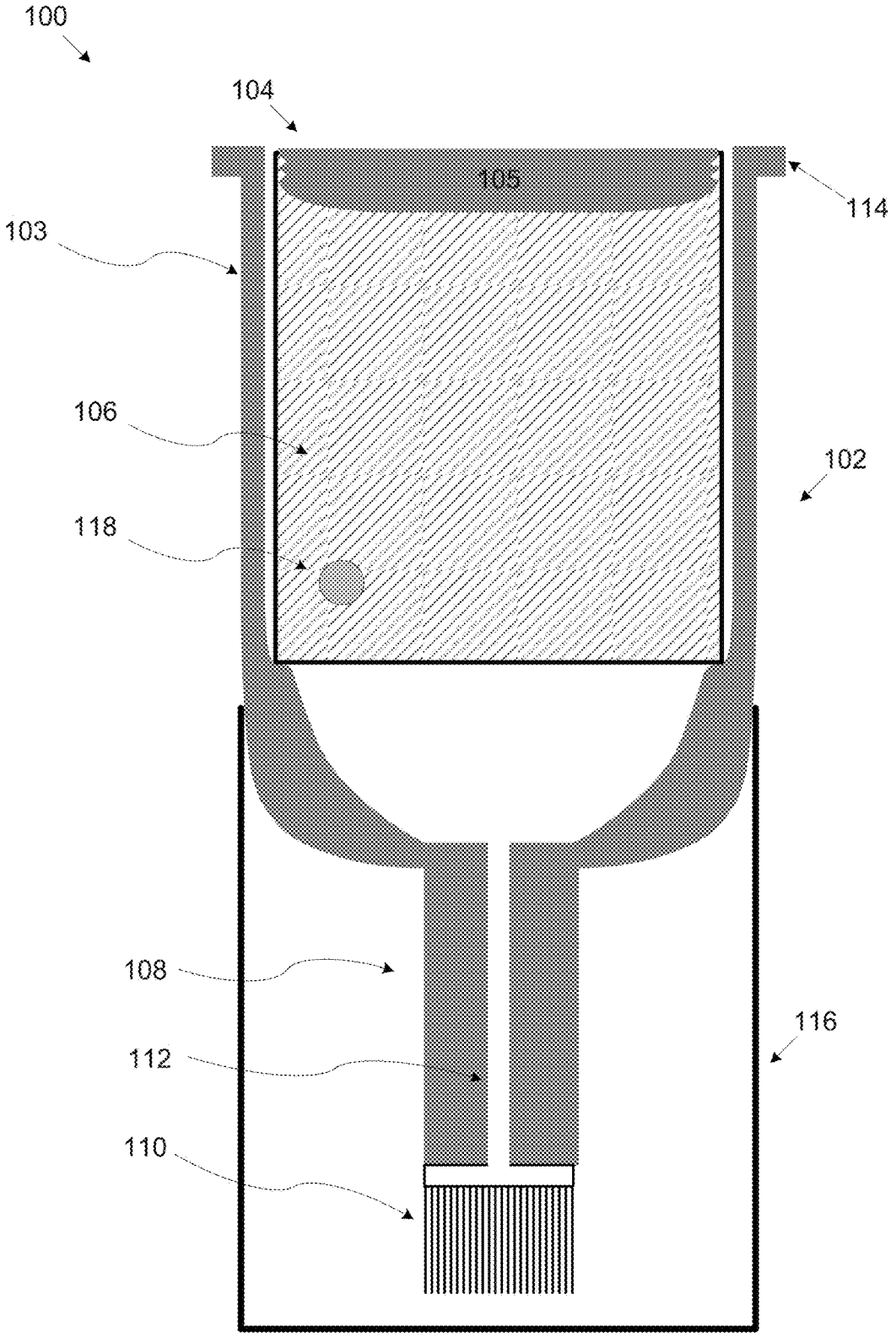
FIG. 1A and FIG. 1B are longitudinal cross section views of exemplary nail polish fluid storage and dispensing capsules, according to an exemplary embodiment of the present invention.

The present invention, in some embodiments thereof, relates to a storage and dispensing capsule for nail polish fluid and, more particularly, but not exclusively, to a disposable storage and dispensing capsule for nail polish fluid with an integrated brush According to some embodiments of the present invention there are provided storage and dispensing capsule with integrated applying element for nail polish fluid application and production methods for the capsule. The capsule which is a disposable capsule intended for a single application of the nail polish fluid may be used with one or more nail polish application apparatuses (and/or systems) that are not covered in the scope of the present invention. The capsule includes a body portion defining a reservoir containing the nail polish fluid and a discharge nozzle having one or more conveying tunnels and an integrated nail polish applying element adapted to convey the nail polish fluid and dispense the nail polish fluid to a nail surface of a user.

The dispensing capsule may be used for dispensing the nail polish fluid, for example, polish fluid, a base coating fluid, a top coating fluid, a drying material a nail art polish fluid, a medical nail treatment fluid and/or the like over one or more nail surfaces of the user, in particular the nail surface of a human hand finger nail and/or the nail surface of a human toe. The disposable single application capsule may contain an amount of nail polish fluid that is sufficient for a single application. The amount of nail polish contained in the reservoir may be pre-defined to suffice for application over, for example, a single nail surface, the nail surfaces of a single hand, the nail surfaces of two hands, the nail surfaces of two hands and two feet and/or the like. It should be noted that the actual application of the nail polish fluid to the nail surface, for example, positioning, alignment, pressure application and/or the like is done by the nail polish application apparatus(s) and may therefore depend on the nail polish application apparatus purpose, design, capabilities and/or the like.

Extrusion of the nail polish fluid from the capsule is done by the nail polish application apparatus having a pressure applying element which applies pressure to the body portion when the capsule is placed in a capsule compartment of the nail polish application apparatus. The applied pressure may reduce the volume of the reservoir defined by the body portion thus building an internal pressure in the reservoir forcing the nail polish fluid to flow through the conveying tunnel(s) of the discharge nozzle towards the nail polish applying element which applies the nail polish fluid to the nail surface. The pressure application may be utilized through one or more pressure mechanisms as described herein after.

The capsule may employ different constructions, shapes and/or features as presented in some embodiments of the present invention.

In some embodiments of the present invention, the capsule further is constructed of a container containing the nail polish fluid and a container housing comprising the body portion and the discharge nozzle which integrates the nail polish applying element. The container may be inserted into the container housing that may be shaped to receive and accommodate the container. The container defining the reservoir containing the nail polish fluid may include a sliding gasket sealing an opening in the container's top face. When applying pressure to the gasket top while the capsule is located in the capsule compartment, the gasket slides towards the bottom face of the container thus reducing the volume of the reservoir defined by the container. The reduced volume may build an internal pressure in the reservoir forcing the nail polish fluid to flow to the discharge nozzle. The internal pressure may also first cause the container to fracture with one or more openings in the bottom face of the container in order to release the nail polish fluid into the body portion. The opening(s) may be utilized through a weakened surface at the bottom face of the container, a valve, an internal puncturing element(s) located in the body portion and/or the like. Optionally, the opening(s) in the container is punctured by an external puncturing element.

In some embodiments of the present invention, the nail polish fluid is contained in the body portion having a sliding gasket sealing an opening in its top side. When applying pressure to the gasket top while the capsule is located in the capsule compartment, the gasket position is lowered towards the bottom of the body portion thus reducing the volume of the reservoir defined by the body portion. The reduced volume may build the internal pressure in the reservoir forcing the nail polish fluid to flow to the discharge nozzle. The internal pressure may also first cause the body portion to fracture with one or more openings in order to release the nail polish fluid into the body portion. The opening(s) may be utilized through a weakened surface at the bottom face of the container, a valve, an internal puncturing element(s) located in the body portion and/or the like. Optionally, the opening(s) in the body portion is punctured by an external puncturing element. Optionally, the opening(s) are located in the conveying tunnel of the discharge nozzle.

In some embodiments of the present invention, the nail polish fluid is contained in the body portion where the body portion has one or more high elasticity faces elasticity characterized by an elasticity coefficient that is higher than the elasticity coefficient of the other faces of the body portion. When applying pressure to the one or more of the other faces of the body portion while the capsule is located in the capsule compartment, the high elastic face(s) may fold thus deforming the body portion. The deformed body portion may reduce the volume of the reservoir defined by the container thus building an internal pressure in the reservoir forcing the nail polish fluid to flow to the discharge nozzle.

In some embodiments of the present invention, the nail polish fluid is contained in the body portion constructed as a tubular body with its circumferential wall having one or more annular corrugations disposed around a center axis of the body portion. When applying pressure to the top and/or bottom face(s) of the body portion while the capsule is located in the capsule compartment, the corrugation(s) may fold thus reducing the height of the body portion. The reduced height may reduce the volume of the reservoir defined by the container thus building an internal pressure in the reservoir forcing the nail polish fluid to flow to the discharge nozzle.

In some embodiments of the present invention, the pressure is applied by a peristaltic pump which is part of the nail polish application apparatus. While the capsule is located in the dispensing compartment, the peristaltic pump is pressed against an elastic longitude face of the discharge nozzle having a high elasticity coefficient. The peristaltic pump may induce a displacement movement of the nail polish fluid in the conveying tunnel(s) forcing the nail polish fluid to flow through the conveying tunnel(s).

In some embodiments of the present invention, the pressure is applied by injecting a gas, for example, air into the body portion. The body portion containing the nail polish fluid has one or more openings (holes) that are punctured when the capsule is located in the dispensing compartment. The gas may be injected at high pressure by a compressor which is part of the nail polish application apparatus. The injected gas may build pressure within the nail polish fluid forcing the nail polish fluid to flow into the discharge nozzle.

Optionally, the nail polish fluid occupies only part of the body portion that is divided with a membrane like surface from the remaining internal space of the body portion. The membrane surface may fracture as result of the internal pressure built in the reservoir defined by the body portion. The membrane surface may fracture by one or more puncturing elements located in the body portion. Optionally, the membrane is fractured by an external puncturing element.

Optionally, the nail polish fluid is contained in a sealed inner container disposed inside the body portion. When the volume of the reservoir defined by the body portion is reduced the pressure conveyed to the inner container may fracture the inner container thus releasing the contained nail polish fluid into the body portion. The applied pressure may further build pressure within the nail polish fluid forcing the nail polish fluid to flow into the discharge nozzle. Optionally, the inner container is fractured by an external puncturing element.

Typically, the body portion may be constructed to funnel the nail polish fluid towards the discharge nozzle, for example, as an inverted cup-shaped body, as a conic like shape and/or the like. In addition, the body portion may be designed to be air-sealed such that while not in use the nail polish fluid is not in contact with the air. Optionally, the body portion is sealed with removable seal that is removed prior to using of the capsule, for example, a removable cover, a tear able foil and/or the like The body portion, the container and/or the inner container may be produced from one or more materials, for example, a polymer, glass, metal, a ceramic material and/or the like. Optionally, the material(s) used to produce the part containing the nail polish fluid such as, for example, the body portion, the container and/or the inner container are characterized by a low permeability coefficient to prevent one or more components of the nail polish fluid, for example, solvents from diffusing through the container and evaporate over time.

The conveying tunnel(s) may be formed by the inherent structure of the discharge nozzle, for example, a hollow body of the discharge nozzle. Optionally, the conveying tunnel(s) is utilized through one or more hollow wedges (e.g. a hollow shaft, a hollow needle, etc.) inserted through the discharge nozzle reaching into the body portion. The conveying tunnel(s) may be adapted according to a viscosity property of the nail polish fluid to allow for a constant flow of the nail polish fluid through the discharge nozzle.

The nail polish applying element integrated with the discharge nozzle may be mounted on the discharge nozzle such that it is straight or tilted. The nail polish applying element may comprise hair strands such that the nail polish fluid flows over the hair strands dispensing the nail polish fluid over the nail surface. Additionally, and/or alternatively, the dispensing head may include one or more elastic tubes and/or solid pipes (e.g. a syringe needle, etc.) to dispense the nail polish fluid over the nail surface. The nail polish applying element may also include a combination of the hair strands and the elastic tube(s). The nail polish applying element may also include a sponge, a wiper and/or the like to apply the nail polish fluid over the nail surface.

Optionally, the capsule includes a dynamically adjustable shutter to control the flow of the nail polish fluid through the conveying tunnel(s). The shutter may be located at the body portion or at the discharge nozzle.

Optionally, the capsule includes a removable cover to protect at least the nail polish applying element. The cover is removed prior to inserting the capsule into the capsule compartment.

Optionally, the capsule is provided in a sealed package that is opened prior to applying the nail polish fluid to the nail surface(s). For example, the capsule may packed in a sealed box, bag and/or the like that may be opened, teared, removed and/or the like by the user prior to using the capsule.

The integrated brush storage and dispensing capsule may present significant benefits compared to existing devices, systems and/or methods for nail polish fluid application over nail surfaces. First, as opposed to traditional manual nail polish fluid application which may be the most common method, the capsule used in the complementary nail polish application apparatus facilitates an automated nail polish fluid application. While the manual nail polish fluid application may be very time consuming and may require skills, expertise and/or experience, the automated nail polish fluid application may allow any user having no relevant skills, knowledge, expertise and/or experience to easily apply the nail polish fluid. The automated nail polish fluid application may also significantly shorten the time of the application process and may even allow the user to engage in other activities while applying the nail polish fluid to his hand and/or toe nail surfaces.

While some devices and/or systems for automatically applying the nail polish fluid may exist, the capsule used in the complementary nail polish application apparatus provides a convenient user friendly solution. The user may be relieved of the need to handle the nail polish fluid, the brush and/or the like as may be needed by the existing devices. In addition, by isolating the nail polish fluid from the nail polish application apparatus, maintenance of the nail polish application apparatus may be significantly reduced. For example, avoiding and/or reducing the need to clean and/or replace parts of the nail polish application apparatus that come in contact with the nail polish fluid, for example, storage compartment(s), conveying tube(s), dispensing tube(s), brush(s) and/or the like. Reducing and/or simplifying the handling and/or the maintenance of the nail polish application apparatus may allow novice users to effectively use the nail polish application apparatus with no and/or minimal knowledge, experience and/or training, making the nail polish application apparatus highly suitable for home use. Furthermore, separating the nail polish fluid from the nail polish application apparatus may significantly reduce the complexity of design and/or operation of the nail polish application apparatus since none of the nail polish application apparatus's parts comes in contact with the nail polish fluid. This may result in reduced cost of the nail polish application apparatus making the nail polish application apparatus coupled with the disposable capsule highly affordable and accessible to ordinary un-professional users.

Moreover, the various nail polish fluid extrusion mechanisms supported by the capsule may allow the capsule to be easily adapted to fit into a plurality of nail polish application apparatuses employing various pressure application mechanisms. In addition, the straight forward nature of the pressure application action may further simplify the design, operation and/or maintenance of the nail polish application apparatus further reducing the cost of the nail polish application apparatus.

Furthermore, the capsule may ensure that the nail polish fluid used for the current application is not mixed and/or degraded by nail polish fluid residues left from previous applications as may happen in the existing devices employing multi-application implementations. The disposable single application nail polish applying element as utilized by the capsule may prevent degradation in the application quality, efficiency and/or operation as opposed to the existing devices that may experience such degradation over time and/or over multiple applications of the nail polish.

Another major benefit relates to drying the nail polish fluid after applied to the nail surface. The drying period of the nail polish after applied using the existing methods and/or devices, may be significant due to one or more materials, for example, solvents added to the nail polish fluid to prevent premature drying when exposed to the air. Since the nail polish fluid is stored in a sealed nail polish capsule intended for a single application, the anti-drying materials added to nail polish fluid may be significantly reduced and/or completely avoided. Therefore after applied to the nail polish, the nail polish fluid may dry significantly quicker than the nail polish fluid typically used by the existing devices and may therefore significantly shorten the overall nail polish application process.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

A storage and dispensing capsule described herein the present invention may be used by a nail polish application apparatus for applying nail polish to nail. However, a person skilled in the art may use the same concepts described throughout the present invention for a capsule used for a plurality of other film forming applications, for example, coloring, applying protective layer(s), applying fluid and/or water resistance layer(s) and/or the like.

Several embodiments of the storage and dispensing capsule for nail polish fluid are described hereinafter. However the presented embodiments should not be construed as limiting. A person skilled in the art may implement, construct, arrange and/or produce the capsule and/or parts thereof through multiple other implementations, structures, shapes, production methods and the like which employ the same concepts described throughout the present invention. Moreover, while one or more of the capsule's features may be described hereinafter for one or more of the embodiments, the features may be applicable for other embodiments as well even when not explicitly stated.

Figure 1B:
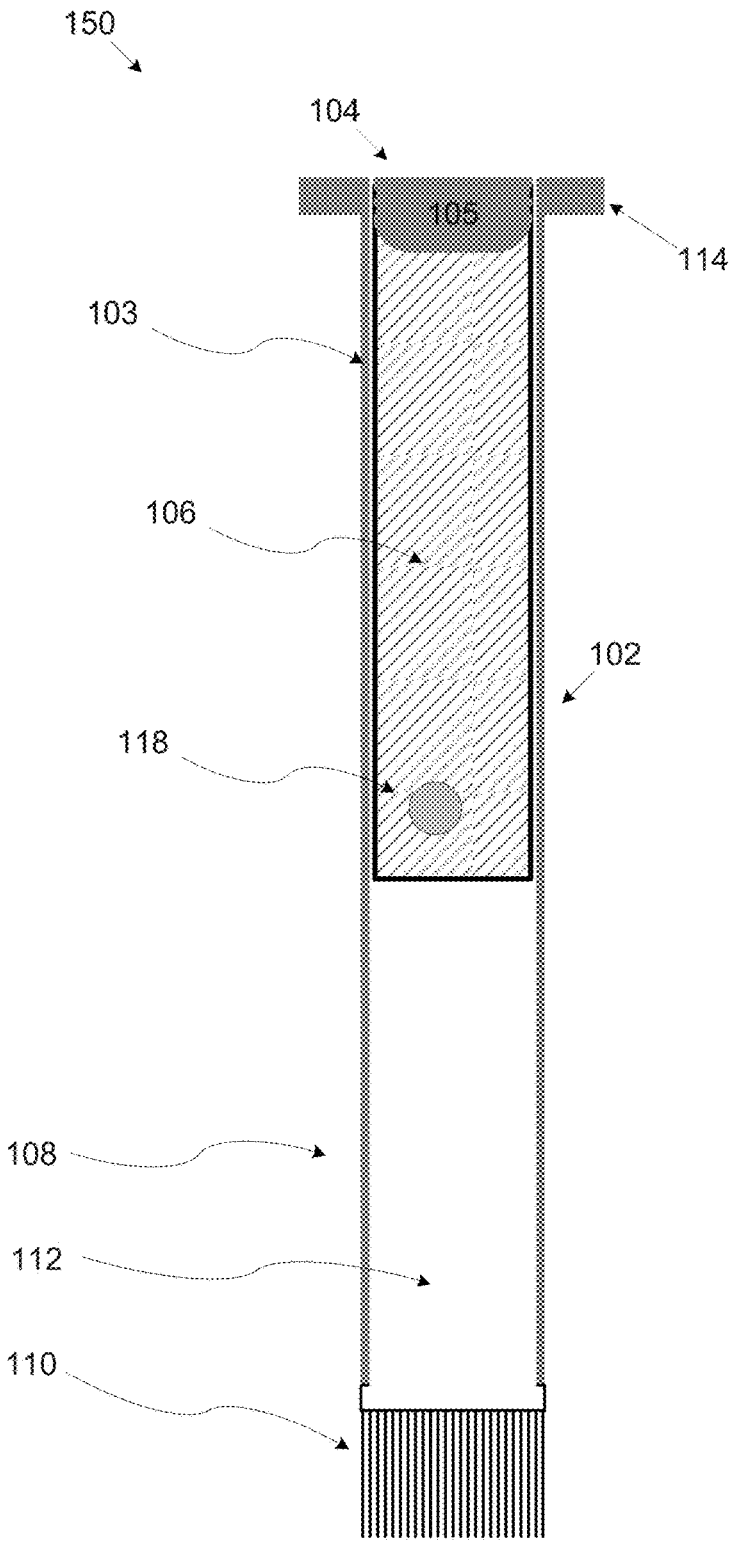

Referring now to the drawings, FIG. 1A and FIG. 1B are longitudinal cross section views of exemplary nail polish fluid storage and dispensing capsules, according to an exemplary embodiment of the present invention. An exemplary nail polish fluid storage and dispensing capsule 100 is a disposable capsule intended for a single application of nail polish on nail surface(s) of a user, for example, hand finger nails and/or foot toe nails. The capsule 100 may be used with one or more nail polish application apparatuses which control the actual nail polish application process. The nail polish application apparatus is not in the scope of the present invention. The capsule 100 comprises a body portion 103 and a discharge nozzle 108.

The body portion 103 defines a reservoir adapted to contain nail polish fluid 106, for example, polish fluid, a base coating fluid, a top coating fluid, a drying material a nail art polish fluid, a medical nail treatment fluid and/or the like. The body portion 103 may be constructed in one of a plurality of shapes, for example, a cylinder, a cone, a pyramid, a box and/or the like. The body portion 103 may be further shaped to funnel the nail polish fluid 106 towards the discharge nozzle 108, for example, as an inverted cup-shaped body, as a conic like shaped body and/or the like. The amount of the nail polish fluid 106 contained in the body portion 103 may pre-defined to suffice for a single application of the nail polish fluid 106 on one or more nail surface(s), for example, a single nail surface, the nail surfaces of a single hand, the nail surfaces of two hands, the nail surfaces of two hands and two feet and/or the like. The body portion 103 may include a flange-like rim 114 defining a perimeter of the top end of the body portion 103. The flange-like rim 114 may be assist in guiding, positioning and/or locking the capsule 100 in a capsule compartment of the nail polish application apparatus.

Optionally, one or more stirring objects 118, for example, a ball, a ring and/or the like may be disposed inside the body portion 103. When shaking the capsule 100, the stirring object(s) 118 may move inside the body portion 103 thus stirring the nail polish fluid 106. This may improve a homogenous distribution of the composition of the nail polish fluid 106. Shaking the capsule 100 may be done manually by the user before placing the capsule 100 in the dispensing compartment. Optionally, the nail polish application apparatus may shake automatically the capsule 100. The nail polish application apparatus may shake the capsule 100 prior to placing the capsule 100 in the dispensing compartment and/or in the dispensing compartment.

The discharge nozzle 108 comprises one or more conveying tunnels 112 and an integrated nail polish applying element 110. The conveying tunnel(s) 112 are adapted to convey the nail polish fluid 106 from the body portion 103 to the nail polish applying element 110. A diameter of the conveying tunnel(s) 112 may be adapted according to a viscosity property of the nail polish fluid 106 to convey a constant flow of the nail polish fluid 106 to the nail polish applying element 110. For example, the diameter of the conveying tunnel(s) 112 may be in a range of 0.1-3 millimeters.

Optionally, the body portion 103 and the discharge nozzle 108 are constructed and produced as a single piece.

The nail polish applying element 110 integrated with the discharge nozzle 108 may be mounted on the discharge nozzle such that the nail polish applying element 110 is in line with the discharge nozzle 108 or tilted with respect to the discharge nozzle 108. The nail polish applying element 110 may comprise hair strands such that the nail polish fluid 106 flows over the hair strands dispensing the nail polish fluid 106 over the nail surface. Additionally, and/or alternatively, the dispensing head 110 may include one or more elastic tubes and/or solid pipes, for example, a syringe needle to dispense the nail polish fluid 106 over the nail surface. The nail polish applying element 110 also include a sponge, a wiper and/or the like to apply the nail polish fluid 106 over the nail surface. The nail polish applying element 110 may further include a combination of two or more of the hair strands, the elastic tube(s), the pipe(s), the sponge and/or the wiper. Optionally, the nail polish applying element 110 is provided separately from the body portion 103 and/or the discharge nozzle 108. The user may manually attach the nail polish applying element 110 to the discharge nozzle 108. The attachment of the nail polish applying element 110 to the discharge nozzle 108 may be employ one or more assembly methods, for example, clamping, screwing, pressing, clipping and/or the like.

In some embodiments, the capsule 100 is constructed of a container housing 102 and a container 104. The container housing 102 comprises the body portion 103 and the discharge nozzle 108 while the container 104 defines the reservoir adapted to contain the nail polish fluid 106. An upper face of the container 104 has an opening sealed with a sliding gasket 105. The sliding gasket 105 may be produced of one or more materials, for example, rubber, silicon and/or the like which have high expansion capability allowing sealing of the opening in the top face of the container 104. The container 104 as well as the body portion 103 adapted to receive and accommodate the container 104 may be constructed in one of a plurality of shapes, for example, a cylinder, a cone, a pyramid, a box and/or the like. The capsule 100 constructed of the container housing 102 and the container 104 may be provided pre-assembled such that the container 104 is inserted in the container housing 102.

Optionally, the container 104 and the container housing 102 are provided as a kit in which the container 104 and the container housing 102 are separated. The container 104 may be manually inserted into the container housing 102 by a user prior to inserting the capsule 100 into the capsule compartment of the nail polish application apparatus. Optionally, the container 104 may be inserted automatically into the container housing 102 by the nail polish application apparatus, for example, after the container housing 102 is placed in the capsule compartment. In another example, the nail polish application apparatus may insert automatically the container 104 into the container housing 102 prior to placing the container housing 102 in the capsule compartment and placing the assembled capsule into the capsule compartment.

Optionally, one or more stirring objects such as the stirring object 118 are disposed inside container 104. When shaking the container 104, the stirring object(s) 118 may move inside the container 104 thus stirring the nail polish fluid 106. In case the container 104 is provide separated from the container housing 102, shaking the container 104 may be done before inserting the container 104 into the container housing 102. In case the container 104 is pre-installed in the container housing 102, the entire capsule 100 may be shaken in order for the stirring object(s) 118 to stir the nail polish fluid 106 contained in the container 104. Shaking capsule 100 and/or the container 104 may be done manually by the user before placing the capsule 100 in the dispensing compartment. Optionally, the nail polish application apparatus may shake automatically the capsule 100. The nail polish application apparatus may shake the capsule 100 prior to placing the capsule 100 in the dispensing compartment and/or in the dispensing compartment.

The body portion 103, the discharge nozzle 108 and/or the container 104 may be produced from one or more materials, for example, a polymer, glass, metal, a ceramic material and/or the like. The body portion 103 and/or the container 104 may be air sealed to prevent the nail polish fluid 106 from contacting the air. The body portion 103, the discharge nozzle 108 and/or the container 104 may be further produced from one or more materials characterized by a low permeability coefficient to prevent one or more components of the nail polish fluid, for example, solvents from diffusing and evaporating over time.

Optionally, the capsule 100 includes a cover 116 to protect at least the nail polish applying element 110. The cover 116 may be attached to the container housing 102 while the capsule 100 is not used, i.e. not placed in the capsule compartment of the nail polish application apparatus. The cover 116 may be attached to the container housing 102 through one or more mechanisms, for example, placed, screwed, glued, pushed and/or the like. The cover 116 may be removed prior to placing the capsule 100 in the dispensing compartment. The cover 116 may be manually removed by the user. Optionally, the cover 116 is removed automatically by the nail polish application apparatus prior to placing the capsule 100 in the dispensing compartment and/or in the dispensing compartment.

Optionally, the polish application apparatus removes and places back on the cover 116 during the nail application process. For example, in case the user started the nail polish application process and wishes to pause the application process (i.e. the nail polish application apparatus enters a pause mode), the nail polish application apparatus may place the cover 116 back over the capsule 100 in order to protect the nail polish applying head 110 by preventing the nail polish fluid 106 present on the nail polish applying head 110 from drying. This may also prevent the nail polish fluid 106 present inside the conveying tunnel(s) 112 from drying. When the user resumes the application process, the nail polish application apparatus may again remove the cover 116 from the capsule 100. During the initialization of the nail polish application process, the cover 116 may be used to evenly dispense the nail polish fluid 106 over the nail polish applying element 110.

In some embodiments, the cover 116 may serve as a bucket to collect the nail polish fluid 106 which may drip from the nail polish applying element 110. Such dripping may occur since the internal pressure built in the reservoir may still apply sufficient pressure to force at least some of the nail polish fluid 106 through the conveying tunnel(s) 112 and the nail polish applying element 110. The cover 116 may be disposed at the end of the nail polish application process.

Optionally, the capsule 100 is provided in a sealed package that is opened prior to applying the nail polish fluid 106 to the nail surface(s). For example, the capsule 100 may be packed in a sealed box, bag and/or the like that may be opened, teared, removed and/or the like by the user prior to using the capsule 100.

As stated before, the capsule 100 and/or parts thereof may be designed, constructed and/or produced through multiple other implementations, structures, shapes, production methods and the like which employ the same concepts described throughout the present invention. As shown in FIG. 1B, a nail polish fluid storage and dispensing capsule 150 such as the container housing may be constructed as an elongated tube, for example, a cylinder, a box, a pyramid and/or the like. The discharge nozzle 108, in particular the conveying tunnel 112 may be integrated with the body portion 103 as a single piece adapted to the shape of the body portion 103. The container 104 may of course be adapted to the shape of the container housing 102. The same applies for configurations of the capsule 100 which do not include the container 104 in which the body portion 103 contains the nail polish fluid 106.

Figure 2B:
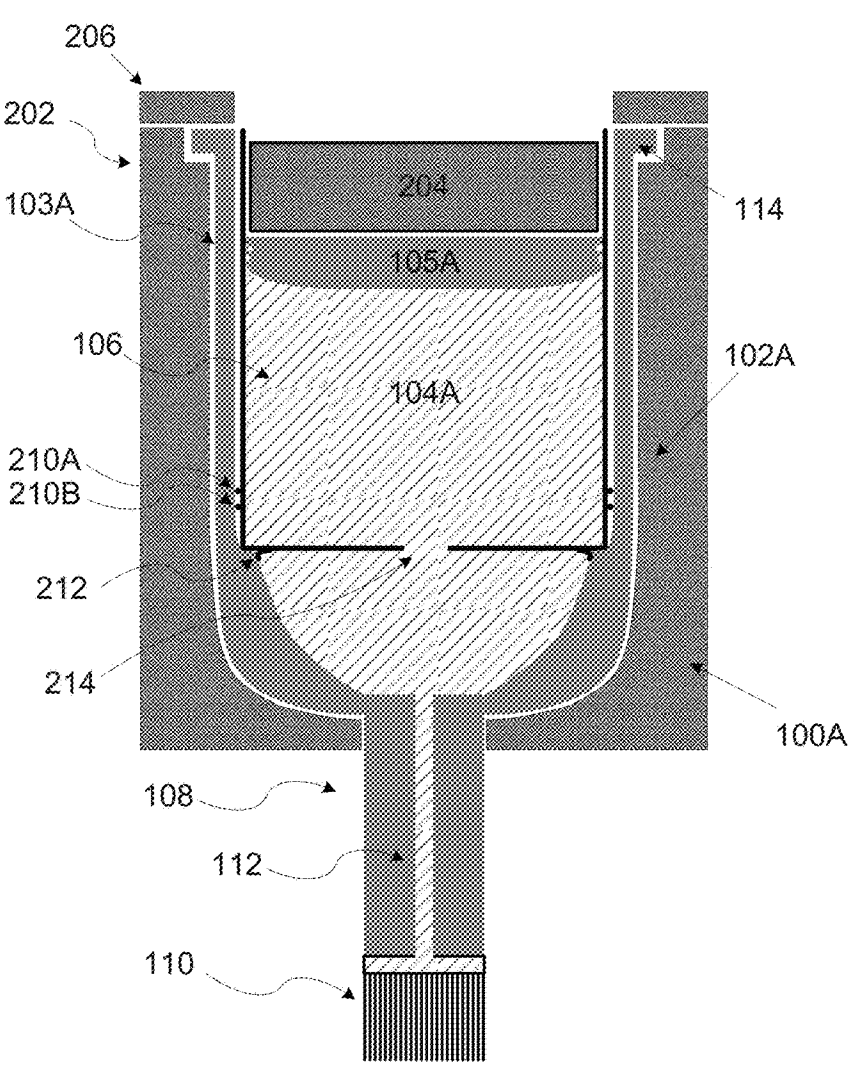
FIG. 2A and FIG. 2B are longitudinal cross section views of an exemplary first embodiment of a nail polish fluid storage and dispensing capsule inserted in an exemplary dispensing compartment, according to an exemplary embodiment of the present invention.
Figure 2A:
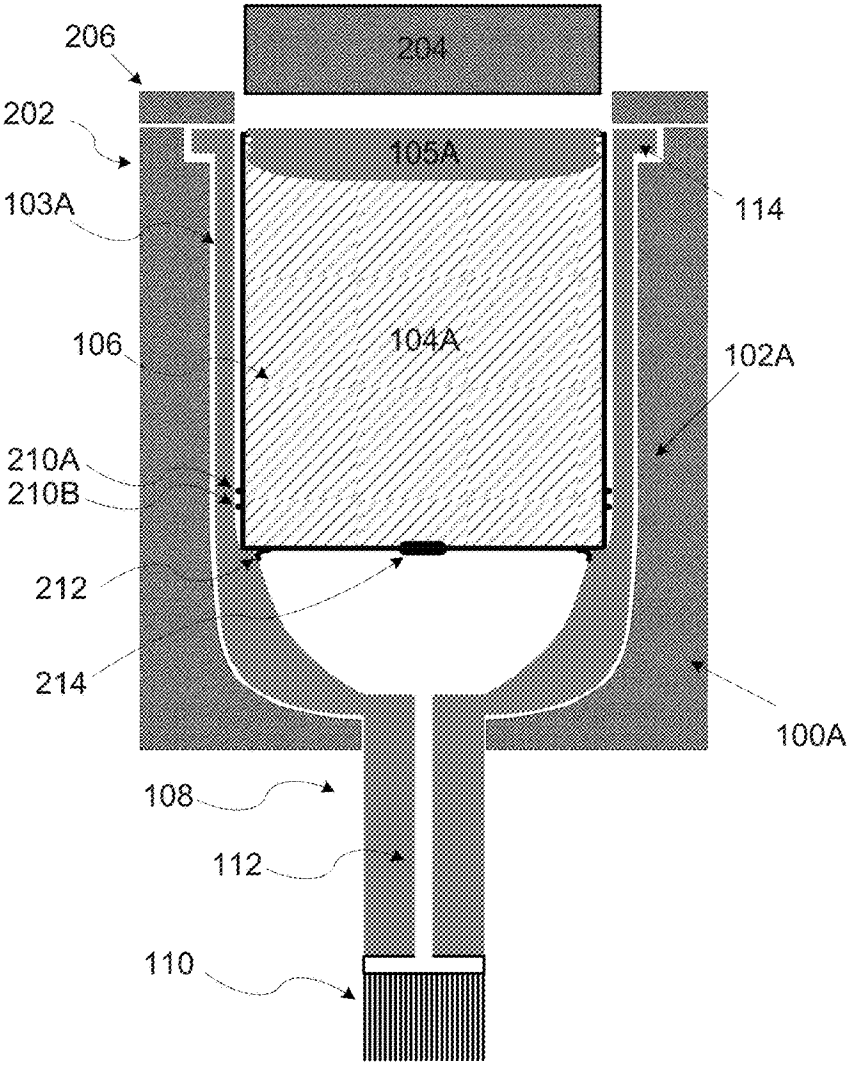

Reference is now made to FIG. 2A and FIG. 2B, which are longitudinal cross section views of an exemplary first embodiment of a nail polish fluid storage and dispensing capsule inserted in an exemplary dispensing compartment, according to an exemplary embodiment of the present invention. An exemplary embodiment 100A of the nail polish fluid storage and dispensing capsule 100 includes a container housing 102A such as the container housing 102 and a container 104A such as the container 104 sealed with a sliding gasket 105A such as the sliding gasket 105. The container housing 102A comprises a body portion 103A such as the body portion 103 and a discharge nozzle such as the discharge nozzle 108 which includes one or more conveying tunnels such as the conveying tunnel(s) 112 and an integrated nail polish applying element such as the nail polish applying element 110. The container 104A defines a reservoir adapted to contain nail polish fluid such as the nail polish fluid 106.

As shown in FIG. 2A, the capsule 100A may be inserted into a capsule compartment 202 of the nail polish application apparatus. The body portion 103A may include a flange-like rim such as the flange-like rim 114 that may be adapted to fit the outline of the capsule compartment 202 in order to guide and/or position the capsule 100A in the capsule compartment 202. Moreover, the nail polish application apparatus may apply a locking mechanism 206 that may press the flange-like rim 114 against the capsule compartment 202 after the capsule 100A is placed in the capsule compartment 202 in order to secure the body portion 103A in the capsule compartment 202. The locking mechanism 206, for example, a perimeter ring may be fixed over the flange-like rim 114 after the capsule 100A is placed in the capsule compartment 202. A pressure applying element 204 of the nail polish application apparatus, for example, a piston, a press, a lead screw, a moving element and/or the like may apply pressure to the top side of the sliding gasket 105A.

One or more circumferential sealing elements 210, for example, 210A and/or 210B may be disposed between a circumferential lateral wall of the container 104A and a circumferential lateral wall of the body portion 103A. The circumferential sealing elements 210 may be made from one or more sealing materials, for example, rubber, silicon and/or the like. The circumferential sealing element(s) 210 may be constructed as part of the container 104A and/or the as part of the body portion 103A. Optionally, the sealing element(s) 210 may be separate parts, for example, bands that are placed on the container 104A.

The body portion 103A may include one or more stoppage elements 212 disposed inside the body portion 103A to lock the container 104A securely inside the body portion 103A. The stoppage element 212 may be constructed as part of the body portion 103A inherent shape, for example, as a protrusion, a shelf, a surface and/or the like adapted to block the movement of the container 104A towards a bottom side of the body portion 103A. The stoppage element 212 may be disposed along the entire perimeter of the internal side of the circumferential lateral wall of the body portion 103A. Optionally, the stoppage element(s) 212 may be located only at one or more locations along the internal side of the circumferential lateral wall of the body portion 103A.

The container 104A includes one or more openings 214 located at a bottom face of the container 104A. The opening(s) 214 has two operational states, in the first state which is the default state, the opening(s) 214 is closed thus preventing the nail polish fluid 106 from flowing out of the container 104A. In the second state, the opening(s) 214 is opened thus releasing the nail polish fluid 106 from the container 104A into the body portion 103A. The opening(s) 214 automatically transitions from the first state to the second state when internal pressure is built in the reservoir defined by the container 104A. Optionally, the opening(s) 214 is unidirectional allowing the nail polish fluid 106 to flow out of the body portion 104A while preventing the nail polish fluid 106 from re-entering the body portion 103A. In one example, the opening(s) 214 may be utilized by a weakened surface area at the bottom face of the container 104A. The weakened surface may form a sealed bottom face of the container 104A when the capsule 100A is not in use (i.e. in the first state) thus preventing the nail polish fluid 106 from flowing out of the container 104A. The weakened surface area may break automatically under the internal pressure built in the reservoir defined by the container 104A to release the nail polish fluid 106 to the body portion 103A. In another exemplary implementation, the opening(s) 214 is utilized through a mechanical valve having the two operational states. By default, under no pressure, the mechanical valve is closed thus preventing the nail polish fluid 106 from flowing out of the container 104A. The mechanical valve may open automatically when the internal pressure is built in reservoir thus transitioning to the second state in which the nail polish fluid 106 may be released to the body portion 103A.

As shown in FIG. 2B, the pressure applying element 204 presses down the sliding gasket 105A which slides down towards the bottom face of the container 104A. The stoppage element(s) 212 may secure the container 104A in place while the pressure applying element 204 presses against the sliding gasket 105A. As result of the sliding gasket 105A moving toward the bottom side of the body portion 103A, a volume of the reservoir defined by the container 104A is reduced thus building the internal pressure in the reservoir. The internal pressure may fracture the container 104A as the opening(s) 214 may automatically open, i.e. automatically transition from the first state to the second state thus releasing the nail polish fluid 106 contained in the container 104A into the body portion 103A. The internal pressure may further force the released nail polish fluid 106 to flow into the body portion 103A and through the conveying tunnel(s) 112 to the nail polish applying element 110. The sealing element(s) 210 may prevent the released nail polish fluid 106 from flowing in between the circumferential lateral wall of the container 104A and the circumferential lateral wall of the body portion 103A. Additionally and/or alternatively, the stoppage element(s) 212 seals the gap between the circumferential lateral wall of the container 104A and the circumferential lateral wall of the body portion 103A. By sealing the gap, the stoppage element(s) 212 may prevent the released nail polish fluid 106 from flowing in between the circumferential lateral wall of the container 104A and the circumferential lateral wall of the body portion 103A.

Optionally, the capsule compartment 202 may be adapted to host the capsule 100A such that when properly inserted and locked in place in the capsule compartment 202, the nail polish applying head 110 is tilted with respect to a nail surface of the user using the nail polish application apparatus. The tilted positioning may improve the application of the nail polish fluid 106 by the nail polish applying head 110. For example, the side of the nail surface may be curved and approaching the nail surface from an angle may allow the nail polish applying head 110 to better dispense the nail polish fluid 106 over the nail surface.

Figure 3C:
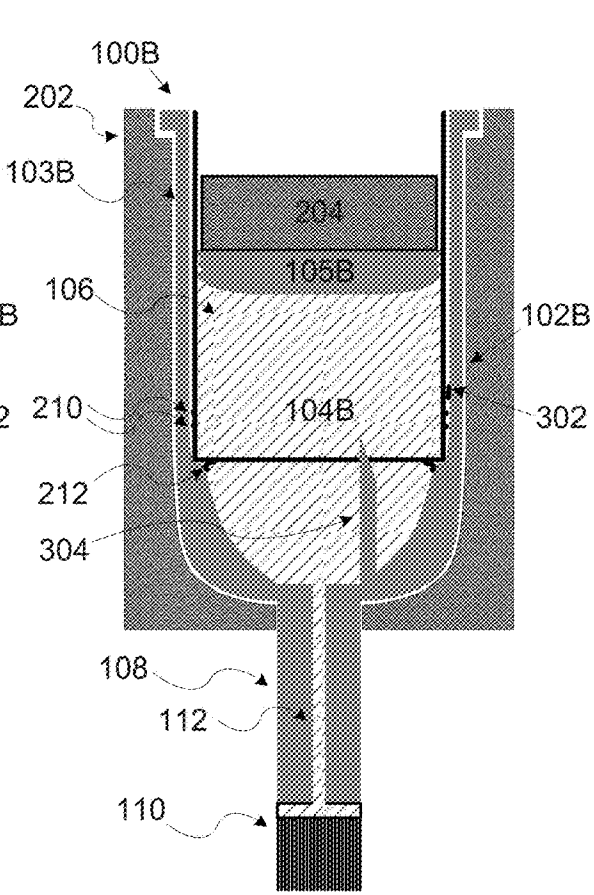
FIG. 3A, FIG. 3B and FIG. 3C are longitudinal cross section views of an exemplary second embodiment of a nail polish fluid storage and dispensing capsule inserted in an exemplary dispensing compartment, according to an exemplary embodiment of the present invention.
Figure 3B:
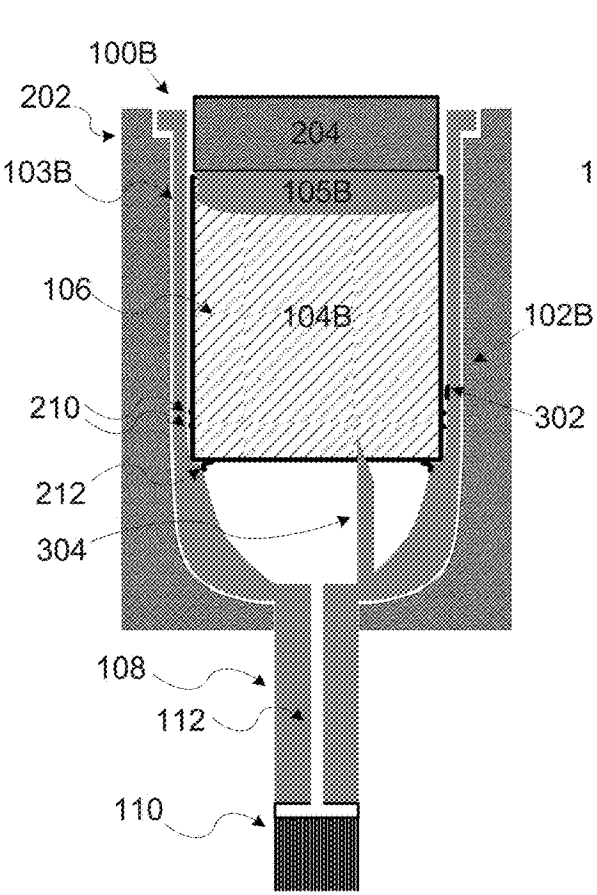
Figure 3A:
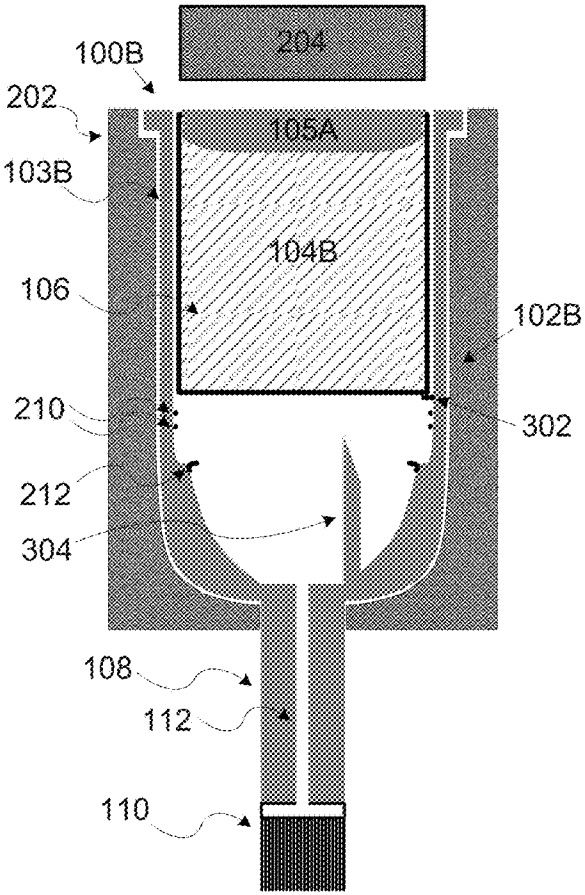

Reference is now made to FIG. 3A, FIG. 3B and FIG. 3C, which are longitudinal cross section views of an exemplary second embodiment of a nail polish fluid storage and dispensing capsule inserted in an exemplary dispensing compartment, according to an exemplary embodiment of the present invention. An exemplary embodiment 100B of the nail polish fluid storage and dispensing capsule 100 includes a container housing 102B such as the container housing 102 and a container 104B such as the container 104 sealed with a sliding gasket 105B such as the sliding gasket 105. The container housing 102B comprises a body portion 103B such as the body portion 103 and a discharge nozzle such as the discharge nozzle 108 which includes one or more conveying tunnels such as the conveying tunnel(s) 112 and an integrated nail polish applying element such as the nail polish applying element 110. The container 104B defines a reservoir adapted to contain nail polish fluid such as the nail polish fluid 106. The capsule 100B may further include one or more sealing elements such as the sealing element 210 and/or one or more stoppage elements such as the stoppage element 212. The body portion 103B may also include a flange-like rim such as the flange-like rim 114 adapted for a capsule compartment such as the capsule compartment 202.

The body portion 103B further includes one or more internal puncturing elements 304 disposed inside body portion 103B underneath the bottom face of the container 104B. The internal puncturing elements 304 may be shaped, for example, as a piercing protuberance, a piercing protrusion, a sharp extension and/or the like.

In its initial state, the capsule 100B is provided with the container 104B placed in an elevated position at a top portion of the body portion 103B such that the container 104B is not in contact with the internal puncturing element(s) 304. The container 104B may be held in the elevated position by force of friction between the circumferential lateral wall of the container 104B and the circumferential lateral wall of the body portion 103B. Optionally, the body portion 103B includes one or more weakened holding elements 302 that may hold the container 104B in the elevated position.

As shown in FIG. 3A, the capsule 100B may be inserted into the capsule compartment 202. The capsule compartment 202 may include a locking mechanism such as the locking mechanism 206 to lock the capsule 100B using the flange-like rim 114. As shown, the container 104B is located at the elevated position.

As shown in FIG. 3B, a pressure applying element such as the pressure applying element 204 may apply pressure to the top side of the sliding gasket 105B. The pressure applied by the pressure applying element 204 may push the container 104B downwards towards the bottom side of the body portion 103B. Since the container 104B is sealed, the pressure applied by the pressure applying element 204 may not cause the sliding gasket 105B to slide down inside the container 104B but may rather push the container 104B to slide along downwards in the body portion 103B. As magnitude of the force induced by the pressure may be larger than the friction force between the circumferential lateral wall of the container 104B and the circumferential lateral wall of the body portion 103B, the container 104B may slide downwards until locked in place by the stoppage element(s) 212. In case the body portion 103B includes the weakened holding element(s) 302, the force induced by the pressure may break the weakened holding element(s) 302 thus allowing the container 104B to slide downwards until locked in place by the stoppage element(s) 212.

Optionally, the pressure applying element 204 is adapted to first apply pressure on the entire container 104B and/or at least on the circumferential lateral wall of the container 104B in order push the entire container 104B downwards in the body portion 103B until locked in place by the stoppage element(s) 212. After the container 104B is locked in place (operational position), the pressure applying element 204 may apply the pressure to the sliding gasket 105B. For example, the pressure applying element 204 may be adjustable with two surface sizes and/or diameters, a first size adapted to fit a size of the top face of the container 104B and a second size adapted to fit the top face of the sliding gasket 105B and/or part thereof. Optionally, the container 104B is attached to a top cover and/or a top seal covering the top face of the capsule 100B. The top cover and/or top seal may be removed from the capsule 100B thus releasing the container 104B such that the container 104B may slide down until locked in place by the stoppage element(s) 212. The top cover and/or top seal may be removed manually by the user and/or automatically by the nail polish application apparatus before and/or after placed in the capsule compartment 202.

While the container 104B is pushed towards the bottom side of the body portion 103B, the bottom face of the container 104B may be punctured by the internal puncturing element(s) 304. The puncturing location in the bottom face of the container 104B may be adapted as a weakened area to be easily punctured by the internal puncturing element(s) 304. As the container 104B is punctured, the nail polish fluid 106 contained in the container 104B is released into the body portion 103B. The container 104B may be pushed downwards until locked in place by the stoppage element(s) 212.

As shown in FIG. 3C, the pressure applying element 204 presses down the sliding gasket 105B which slides down towards the bottom face of the container 104B. As result of the sliding gasket 105B moving toward the bottom side of the body portion 103B, a volume of the reservoir defined by the container 104B is reduced thus building internal pressure in the reservoir. The internal pressure may force the released nail polish fluid 106 to flow into the body portion 103B and through the conveying tunnel(s) 112 to the nail polish applying element 110.

Figure 4C:
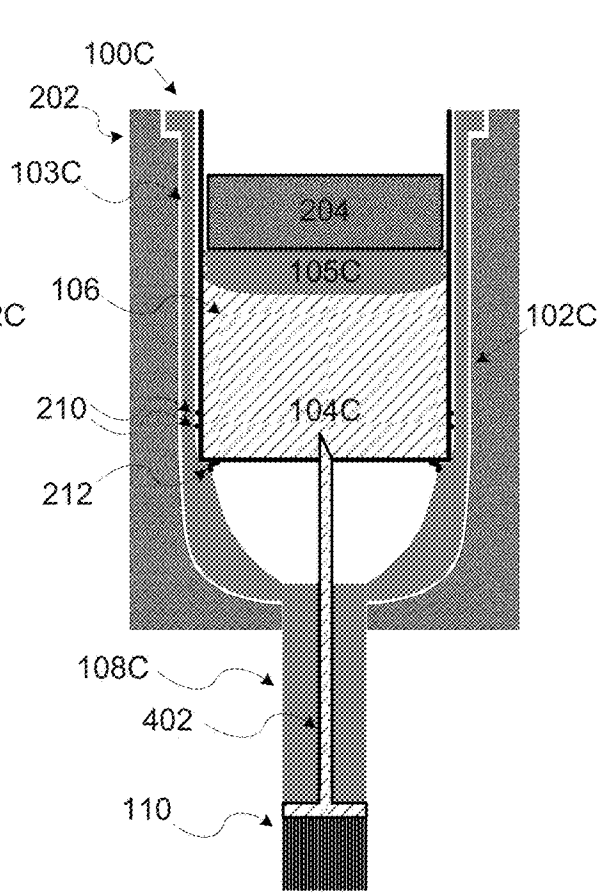
FIG. 4A, FIG. 4B and FIG. 4C are longitudinal cross section views of an exemplary third embodiment of a nail polish fluid storage and dispensing capsule inserted in an exemplary dispensing compartment, according to an exemplary embodiment of the present invention.
Figure 4B:
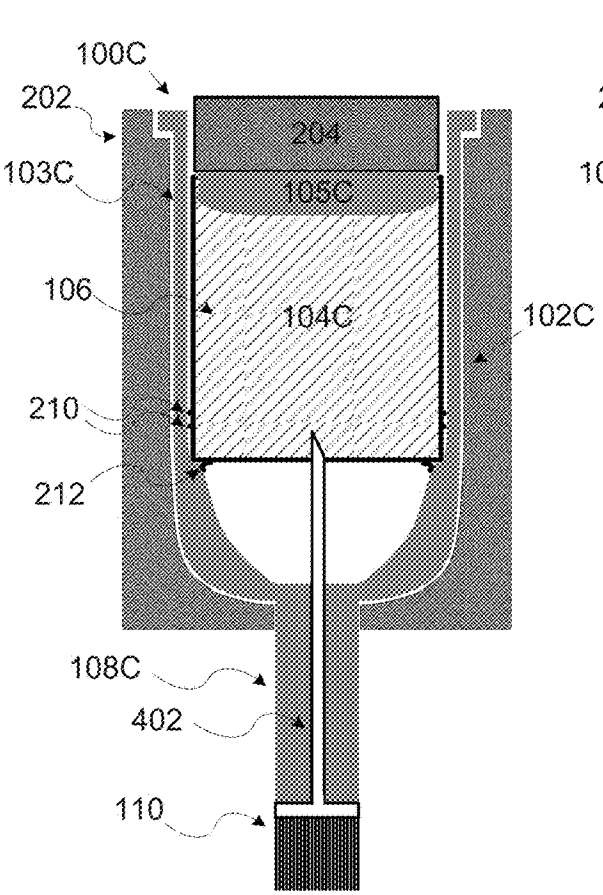
Figure 4A:
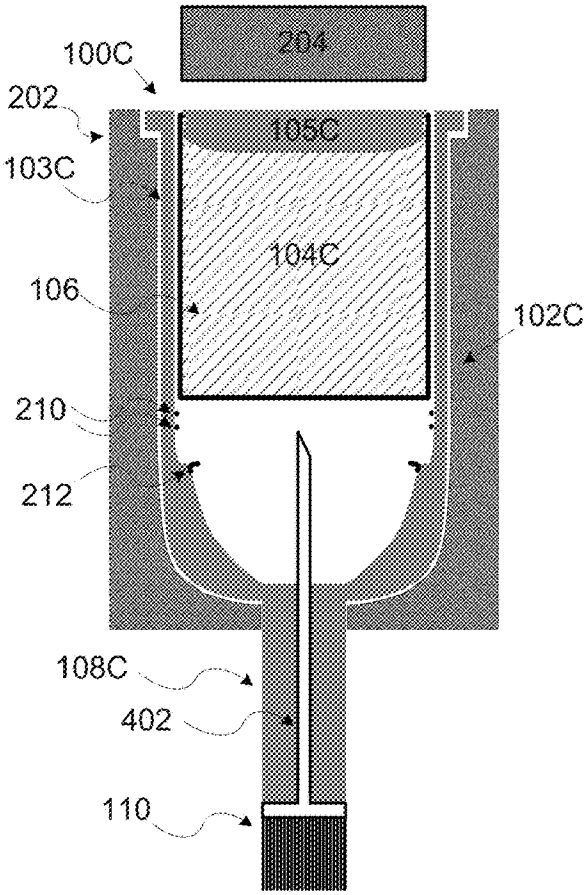

Reference is now made to FIG. 4A, FIG. 4B and FIG. 4C, which are longitudinal cross section views of an exemplary third embodiment of a nail polish fluid storage and dispensing capsule inserted in an exemplary dispensing compartment, according to an exemplary embodiment of the present invention. An exemplary embodiment 100C of the nail polish fluid storage and dispensing capsule 100 includes a container housing 102C such as the container housing 102 and a container 104C such as the container 104 sealed with a sliding gasket 105C such as the sliding gasket 105. The container housing 102C comprises a body portion 103C such as the body portion 103 and a discharge nozzle 108C such as the discharge nozzle 108. The discharge nozzle 108C implements a piercing conveying tunnel 402, for example, a sharpened hollow wedge, a hollow needle and/or the like which serve as the conveying tunnel 112. The discharge nozzle 108C further includes an integrated nail polish applying element such as the nail polish applying element 110. The container 104C defines a reservoir adapted to contain nail polish fluid such as the nail polish fluid 106. The capsule 100C may further include one or more sealing elements such as the sealing element 210 and/or one or more stoppage elements such as the stoppage element 212. The body portion 103C may also include a flange-like rim such as the flange-like rim 114 adapted for a capsule compartment such as the capsule compartment 202.

In its initial state, the capsule 100C is provided with the container 104C placed in an elevated position at a top portion of the body portion 103C such that the container 104C is not in contact with the piercing conveying tunnel 402. The container 104C may be held in the elevated position by force of friction between the circumferential lateral wall of the container 104C and the circumferential lateral wall of the body portion 103C. Optionally, the body portion 103C includes one or more weakened holding elements such as the weakened holding element 302 that may hold the container 104C in the elevated position.

As shown in FIG. 4A, the capsule 100C may be inserted into the capsule compartment 202. The capsule compartment 202 may include a locking mechanism such as the locking mechanism 206 to lock the capsule 100C using the flange-like rim 114. As shown, the container 104C is located at the elevated position.

As shown in FIG. 4B, a pressure applying element such as the pressure applying element 204 may apply pressure to the top side of the sliding gasket 105C. The pressure applied by the pressure applying element 204 may push the container 104C downwards towards the bottom side of the body portion 103C. The capsule 100C may apply the same mechanisms and techniques described for the capsule 100B for pushing the container 104C inside the body portion 103C.

While the container 104C is pushed towards the bottom side of the body portion 103C, the bottom face of the container 104C may be punctured by the piercing conveying tunnel 402. The puncturing location in the bottom face of the container 104C may be adapted as a weakened area to be easily punctured by the piercing conveying tunnel 402. As the container 104C is punctured, the nail polish fluid 106 contained in the container 104C is released into the body portion 103C. The container 104C may be pushed downwards until locked in place by the stoppage element(s) 212.

As shown in FIG. 4C, the pressure applying element 204 presses down the sliding gasket 105C which slides down towards the bottom face of the container 104C. As result of the sliding gasket 105C moving toward the bottom side of the body portion 103C, the volume of the reservoir defined by the container 104C is reduced thus building internal pressure in the reservoir. The internal pressure may force the released nail polish fluid 106 to flow into the body portion 103C and through the piercing conveying tunnel 402 to the nail polish applying element 110.

Figure 5C:
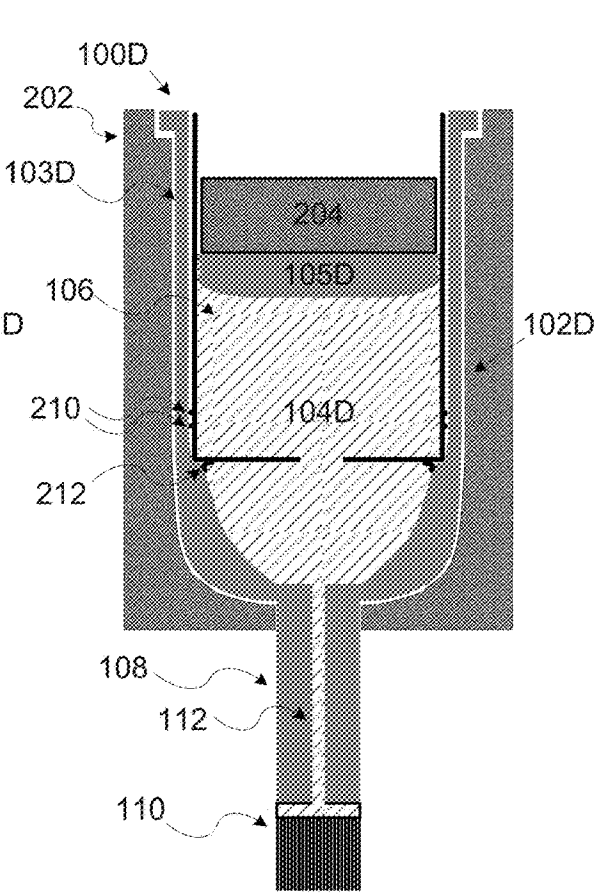
FIG. 5A, FIG. 5B and FIG. 5C are longitudinal cross section views of an exemplary fourth embodiment of a nail polish fluid storage and dispensing capsule inserted in an exemplary dispensing compartment, according to an exemplary embodiment of the present invention.
Figure 5B:
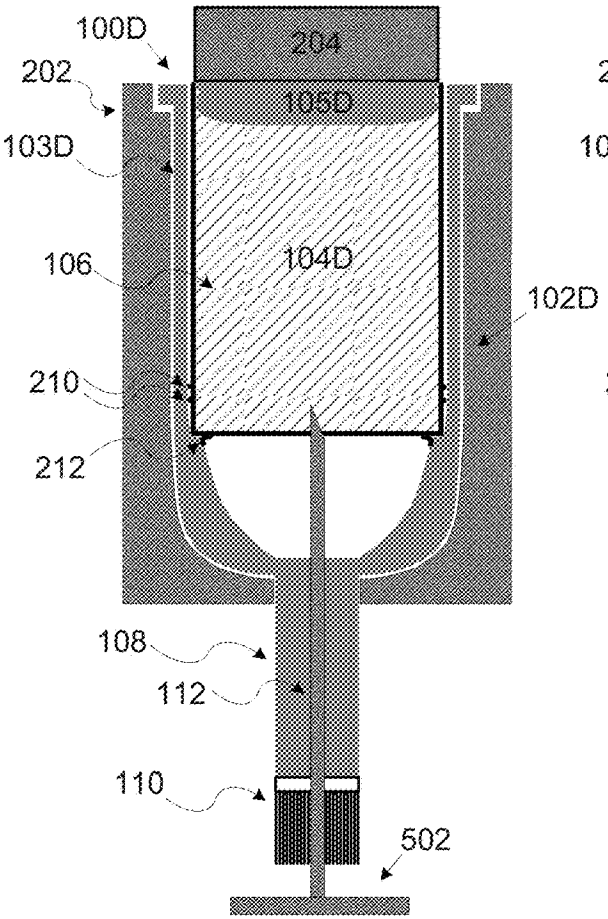
Figure 5A:
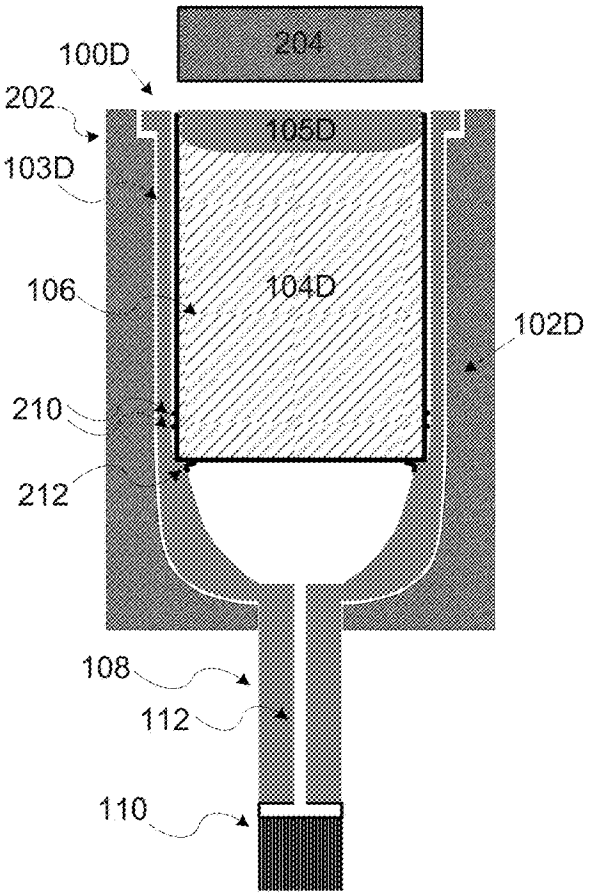

Reference is now made to FIG. 5A, FIG. 5B and FIG. 5C, which are longitudinal cross section views of an exemplary fourth embodiment of a nail polish fluid storage and dispensing capsule inserted in an exemplary dispensing compartment, according to an exemplary embodiment of the present invention. An exemplary embodiment 100D of the nail polish fluid storage and dispensing capsule 100 includes a container housing 102D such as the container housing 102 and a container 104D such as the container 104 sealed with a sliding gasket 105D such as the sliding gasket 105. The container housing 102D comprises a body portion 103D such as the body portion 103 and a discharge nozzle such as the discharge nozzle 108 which includes one or more conveying tunnels such as the conveying tunnel(s) 112 and an integrated nail polish applying element such as the nail polish applying element 110. The container 104D defines a reservoir adapted to contain nail polish fluid such as the nail polish fluid 106. The capsule 100D may further include one or more sealing elements such as the sealing element 210 and/or one or more stoppage elements such as the stoppage element 212. The body portion 103D may also include a flange-like rim such as the flange-like rim 114 adapted for a capsule compartment such as the capsule compartment 202.

As shown in FIG. 5A, the capsule 100D may be inserted into the capsule compartment 202. The capsule compartment 202 may include a locking mechanism such as the locking mechanism 206 to lock the capsule 100D using the flange-like rim 114. The container 104D is placed in the capsule housing 103D such that it is locked in place by the stoppage element(s) 212.

As shown in FIG. 5B, an external puncturing element 502 is used to puncture the bottom face of the container 104D. The external puncturing element 502 may be inserted, for example, through the conveying tunnel 112 to pierce the bottom face of the container 104D. The puncturing location in the bottom face of the container 104D may be adapted as a weakened area to be easily punctured by the external puncturing element 502. In another example, the external puncturing element 502 may be inserted from the top of the capsule 100D. The external puncturing element 502 may be inserted through the gasket 105D to pierce the bottom face of the container 104D. The gasket 105D may be produced of a material having a high elasticity coefficient such that after the external puncturing element 502 is extracted from the container 104D, the gasket 105D re-seals the opening at the top face of the container 104D to prevent the nail polish fluid 106 from flowing through the opening pierced in the gasket 105D. The external puncturing element 502 which may be part of the nail polish applying apparatus may be used to puncture the container 104D while the capsule 100D is inserted in the capsule compartment 202. Optionally, the external puncturing element 502 may be used to puncture the container 104D prior to inserting the capsule 100D into the capsule compartment 202, for example, in a puncturing compartment and/or the like. After the container 104D is punctured, the nail polish fluid 106 contained in the container 104D is released into the body portion 103D.

As shown in FIG. 5C, a pressure applying element such as the pressure applying element 204 presses down the sliding gasket 105D which slides down towards the bottom face of the container 104D. As result of the sliding gasket 105D moving toward the bottom side of the body portion 103D, the volume of the reservoir defined by the container 104D is reduced thus building internal pressure in the reservoir. The internal pressure may force the released nail polish fluid 106 to flow into the body portion 103D and through the conveying tunnel(s) 112 to the nail polish applying element 110.

Figure 6B:
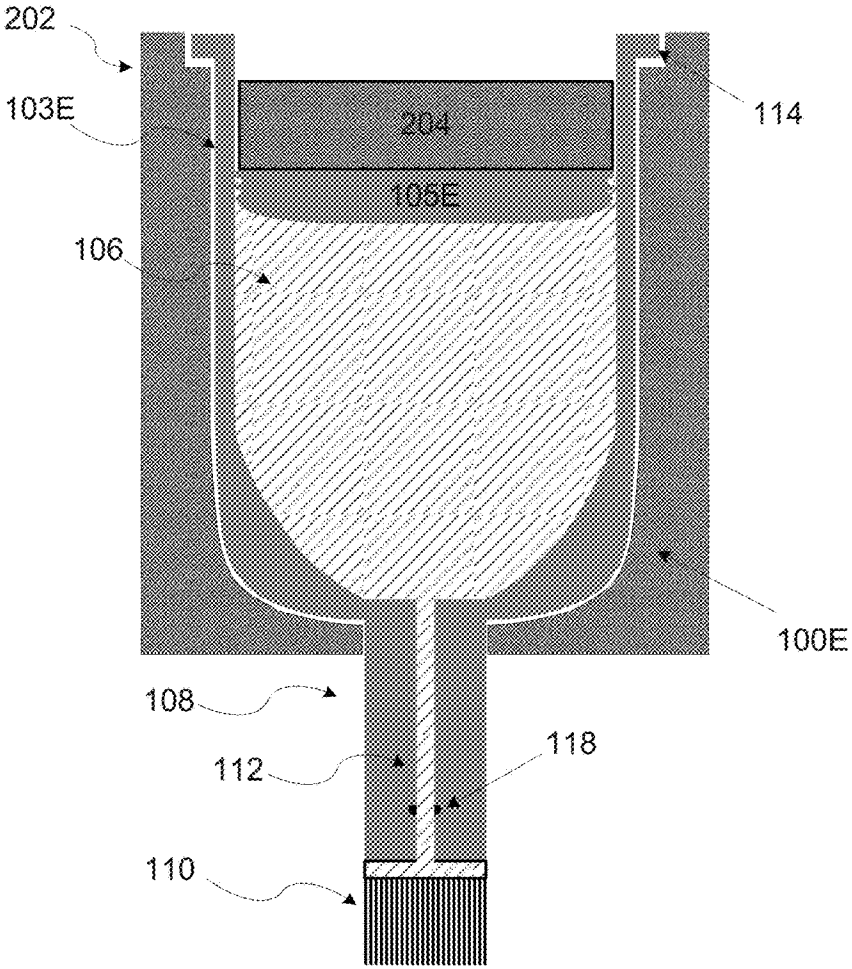
FIG. 6A and FIG. 6B are longitudinal cross section views of an exemplary fifth embodiment of a nail polish fluid storage and dispensing capsule inserted in an exemplary dispensing compartment, according to an exemplary embodiment of the present invention.
Figure 6A:
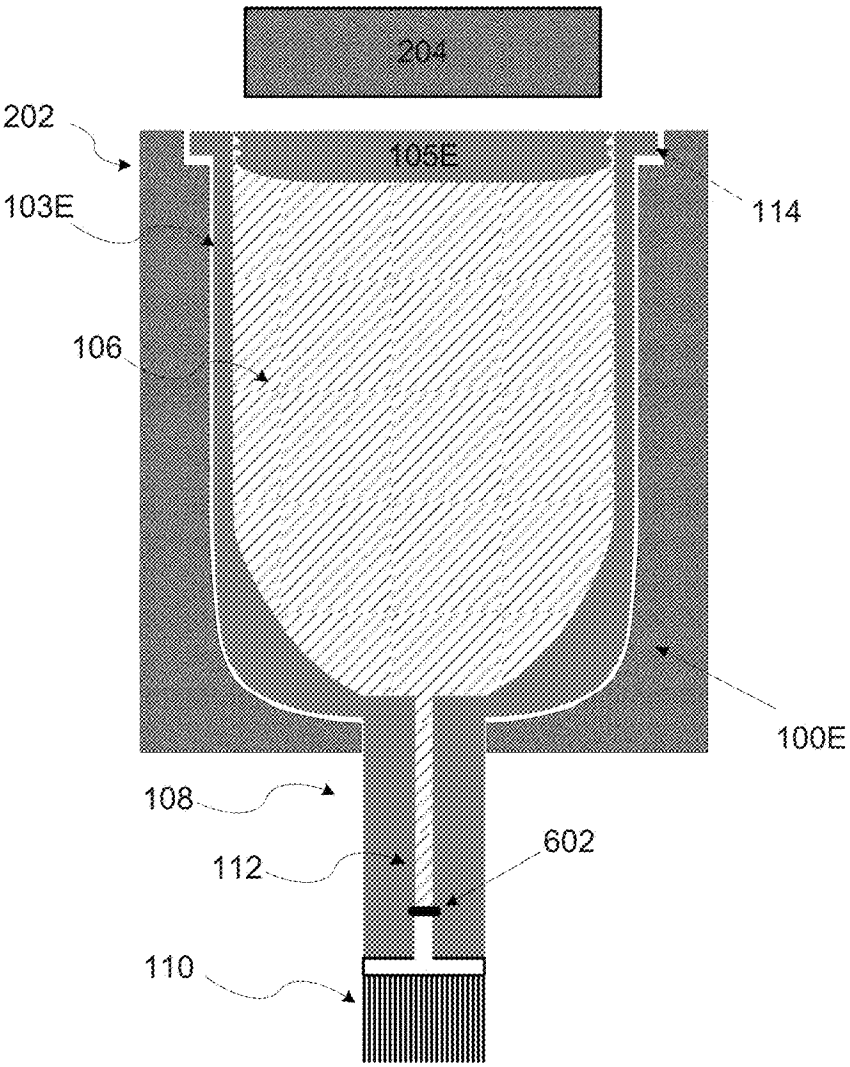

Reference is now made to FIG. 6A and FIG. 6B, which are longitudinal cross section views of an exemplary fifth embodiment of a nail polish fluid storage and dispensing capsule inserted in an exemplary dispensing compartment, according to an exemplary embodiment of the present invention. An exemplary embodiment 100E of the nail polish fluid storage and dispensing capsule 100 includes a body portion 103E such as the body portion 103 and a discharge nozzle such as the discharge nozzle 108 which includes one or more conveying tunnels such as the conveying tunnel(s) 112 and an integrated nail polish applying element such as the nail polish applying element 110. The body portion 103E which defines the reservoir adapted to contain nail polish fluid such as the nail polish fluid 106 is sealed with a sliding gasket 105E such as the sliding gasket 105. The body portion 103E may also include a flange-like rim such as the flange-like rim 114 adapted for a capsule compartment such as the capsule compartment 202. The capsule 100E further includes one or more sealed openings 602 such as the opening 214. The opening(s) 602 may be located, for example, inside the conveying tunnel(s) 112, preventing the nail polish fluid 106 from flowing to the nail polish applying element 110. In another example, the opening(s) 602 may be located at the bottom side of the body portion 103E where the conveying tunnel 112 connects to the body portion 103E.

As shown in FIG. 6A, the capsule 100E may be inserted into the capsule compartment 202. The capsule compartment 202 may include a locking mechanism such as the locking mechanism 206 to lock the capsule 100E using the flange-like rim 114.

As shown in FIG. 6B, a pressure applying element such as the pressure applying element 204 presses down the sliding gasket 105E which slides down towards the bottom side of the body portion 103E. As result of the sliding gasket 105E moving toward the bottom side of the body portion 103E, a volume of the reservoir defined by the body portion 103E is reduced thus building an internal pressure in the reservoir. The internal pressure fractures the body portion 103E as the opening(s) 602 may automatically open, i.e. automatically transition from the first state to the second state thus releasing the nail polish fluid 106 contained in the body portion 103E. The internal pressure may further force the nail polish fluid 106 to flow through the conveying tunnel(s) 112 to the nail polish applying element 110.

Optionally, the opening(s) 602 may be opened by an external puncturing element such as the external puncturing element 502 to allow the nail polish fluid 106 to flow through the conveying tunnel(s) 112 to the nail polish applying element 110.

Figures 7A, 7B, 7C:
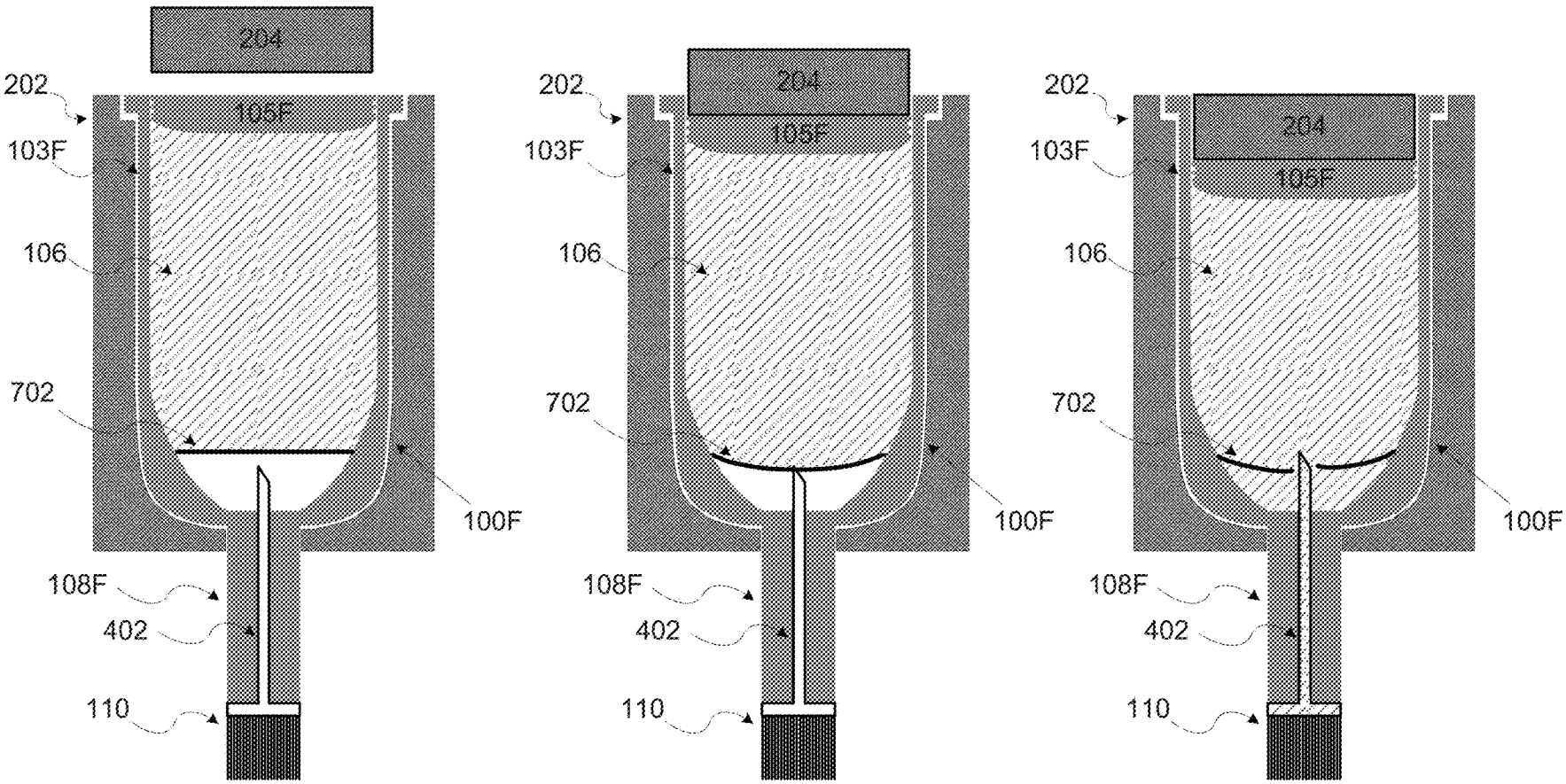
FIG. 7A, FIG. 7B and FIG. 7C are longitudinal cross section views of an exemplary sixth embodiment of a nail polish fluid storage and dispensing capsule inserted in an exemplary dispensing compartment, according to an exemplary embodiment of the present invention.

Reference is now made to FIG. 7A, 7B and FIG. 7C, which are longitudinal cross section views of an exemplary sixth embodiment of a nail polish fluid storage and dispensing capsule inserted in an exemplary dispensing compartment, according to an exemplary embodiment of the present invention. An exemplary embodiment 100F of the nail polish fluid storage and dispensing capsule 100 includes a body portion 103F such as the body portion 103 and a discharge nozzle 108F such as the discharge nozzle 108C. An opening in a top face of the body portion 103F is sealed by a sliding gasket 105F such as the sliding gasket 105E. The discharge nozzle 108F includes a piercing conveying tunnel such as the piercing conveying tunnel 402 and an integrated nail polish applying element such as the nail polish applying element 110. The body portion 103F may also include a flange-like rim such as the flange-like rim 114 adapted for a capsule compartment such as the capsule compartment 202.

The body portion 103F which defines the reservoir adapted to contain nail polish fluid such as the nail polish fluid 106 further includes an internal membrane surface 702. The membrane surface 702 confines the nail polish fluid 106 to an upper portion of the body portion 103F. The membrane surface 702 is disposed in the body portion 103F such that it is not in contact with the piercing conveying tunnel 402.

As shown in FIG. 7A, the capsule 100F may be inserted into the capsule compartment 202. The membrane surface 702 does not touch the piercing conveying tunnel 402. The capsule compartment 202 may include a locking mechanism such as the locking mechanism 206 to lock the capsule 100F using the flange-like rim 114.

As shown in FIG. 7B, a pressure applying element such as the pressure applying element 204 presses down the sliding gasket 105F which slides down towards the bottom side of the body portion 103F. The sliding gasket 105F moving toward the bottom side of the body portion 103F may build an internal pressure in the upper portion of the body portion 103F such that the nail polish fluid 106 contained in the upper portion of the body portion 103F presses the membrane surface 702 towards the piercing conveying tunnel 402.

As shown in FIG. 7C, the membrane surface 702 is pressed against the piercing conveying tunnel 402 until fractured by the piercing conveying tunnel 402. As the membrane surface 702 is fractured, the nail polish fluid 106 is released out of the upper portion of the body portion 103F. As the sliding gasket 105F continues sliding towards the bottom side of the body portion 103F a volume of the reservoir defined by the body portion 103F is reduced increasing the internal pressure in the reservoir and forcing the released nail polish fluid 106 to flow through the piercing conveying tunnel 402 to the nail polish applying element 110.

Optionally, the construction of the capsule 100F employs the structure and technique described for the capsule 100B. In such embodiments, the body portion 103F includes one or more internal puncturing elements such as the internal puncturing element 304. The membrane surface 702 is disposed in the body portion 103F such that it is not in contact with the internal puncturing element 304. In such embodiments, the capsule 100F may utilize a discharge nozzle such as the discharge nozzle 108.

Optionally, the membrane surface 702 is a sealing surface that is fractured by an external puncturing element such as the external puncturing element 502 to allow the nail polish fluid 106 to flow through the conveying tunnel(s) 112 to the nail polish applying element 110.

Optionally, in case one or more stirring elements such as the stirring element 118 are disposed in the body portion 103F, the stirring element(s) 118 may be used to assist fracturing the membrane surface 702. When shaking the capsule 100F to stir the nail polish fluid 106 contained in the body portion 103F, the stirring element(s) 118 may press the membrane surface 702 against the piercing conveying tunnel 402 and/or the internal puncturing element 304. This may fracture the membrane surface 702 thus releasing the nail polish fluid 106 from the upper portion of the body portion 103F.

Figure 8B:
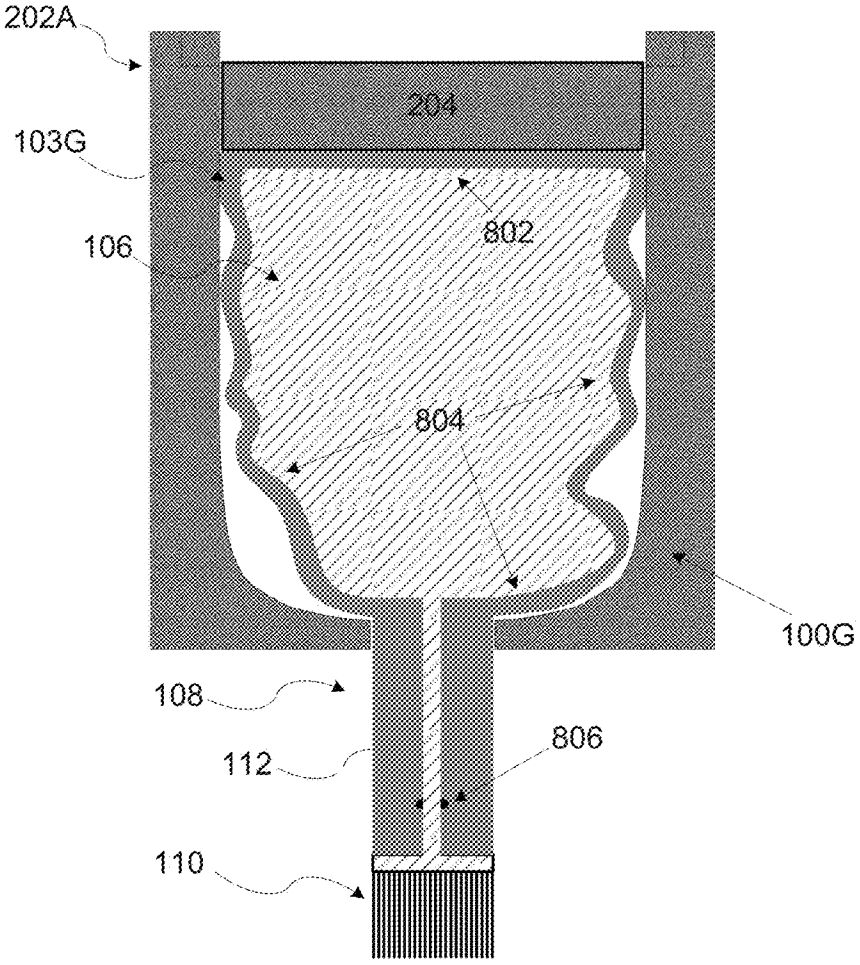
FIG. 8A and FIG. 8B are longitudinal cross section views of an exemplary seventh embodiment of a nail polish fluid storage and dispensing capsule inserted in an exemplary dispensing compartment, according to an exemplary embodiment of the present invention.
Figure 8A:
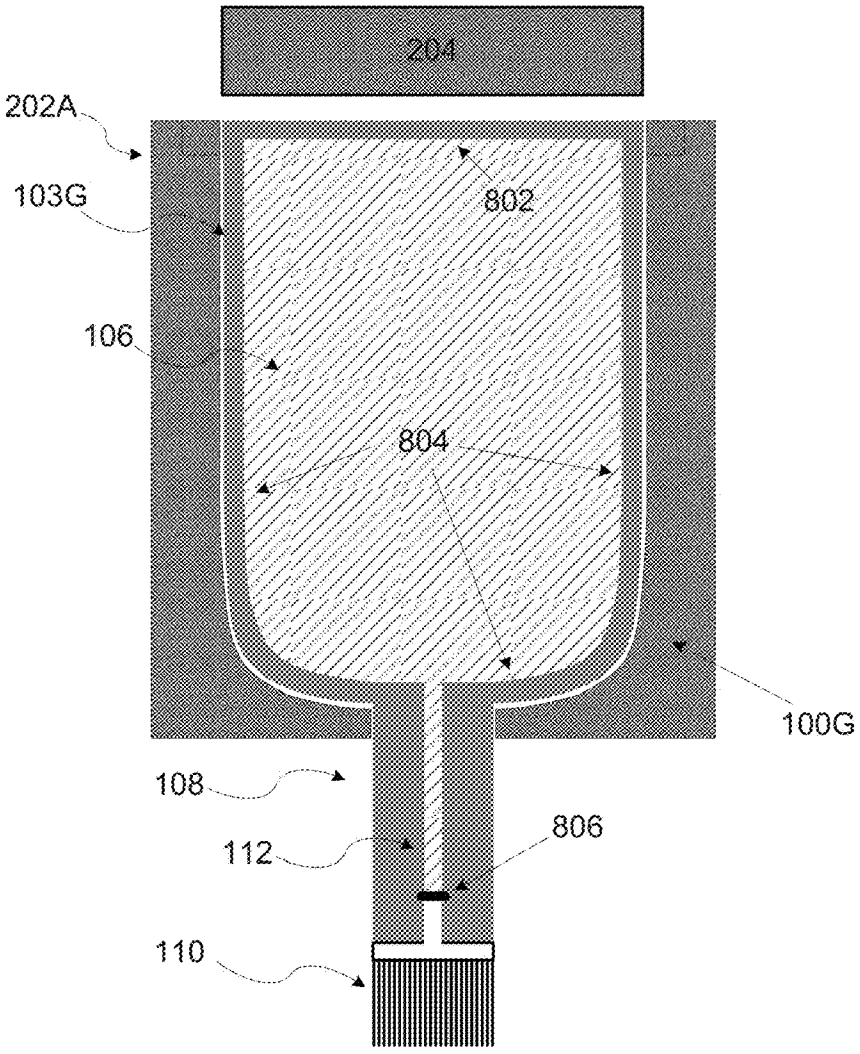

Reference is now made to FIG. 8A and FIG. 8B, which are longitudinal cross section views of an exemplary seventh embodiment of a nail polish fluid storage and dispensing capsule inserted in an exemplary dispensing compartment, according to an exemplary embodiment of the present invention. An exemplary embodiment 100G of the nail polish fluid storage and dispensing capsule 100 includes a body portion 103G such as the body portion 103 and a discharge nozzle such as the discharge nozzle 108 which includes one or more conveying tunnels such as the conveying tunnel(s) 112 and an integrated nail polish applying element such as the nail polish applying element 110. The body portion 103G defines a reservoir adapted to contain nail polish fluid such as the nail polish fluid 106. One or more high elasticity faces 804 of the body portion 103G have an elasticity coefficient that is higher than the elasticity coefficient of other faces 802 of the body portion 103G. The capsule 100G may further include one or more sealed openings 806 such as the opening 214. The opening(s) 806 may be located, for example, inside the conveying tunnel(s) 112, preventing the nail polish fluid 106 from flowing to the nail polish applying element 110. In another example, the opening(s) 806 may be located at the bottom side of the body portion 103G where the conveying tunnel 112 connects to the body portion 103G.

As shown in FIG. 8A, the capsule 100G may be inserted into the capsule compartment 202.

As shown in FIG. 8B, a pressure applying element such as the pressure applying element 204 presses down the face 802. In other exemplary embodiments, the face 802 may be a lateral face of the body portion 103G and the high elasticity face(s) 804 may be the top and/or other lateral faces of the body portion 103G. In such embodiments the pressure applying element 204 may press the body portion 103G from the side. Naturally, the capsule compartment 202 and the pressure applying element 204 may be adapted to accommodate the capsule 100G in which the high elasticity faces are the lateral faces of the body portion 103G.

As the pressure applying element 204 moves down, the high elasticity faces 804 may fold thus deforming the body portion 103G and reducing the volume of the reservoir defined by the body portion 103G. The reduced volume may build an internal pressure in the reservoir which may fracture body portion 103G at the sealed opening(s) 806 which may automatically open, i.e. automatically transition from the first state to the second state thus releasing the nail polish fluid 106 contained in the to the body portion 103G. The internal pressure may further force the released nail polish fluid 106 to flow through the conveying tunnel(s) 112 to the nail polish applying element 110.

Optionally, the opening(s) 806 is a sealing surface that is fractured by an external puncturing element such as the external puncturing element 502 to allow the nail polish fluid 106 to flow through the conveying tunnel(s) 112 to the nail polish applying element 110.

Figure 9B:
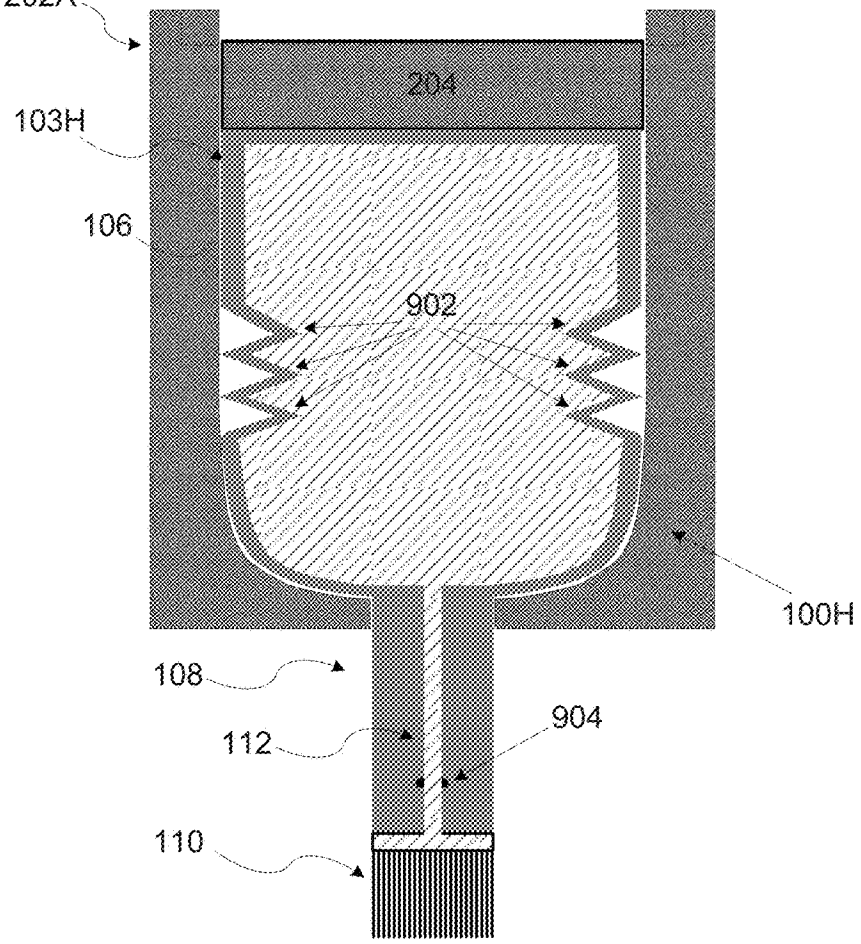
FIG. 9A and FIG. 9B are longitudinal cross section views of an exemplary eighth embodiment of a nail polish fluid storage and dispensing capsule inserted in an exemplary dispensing compartment, according to an exemplary embodiment of the present invention.
Figure 9A:
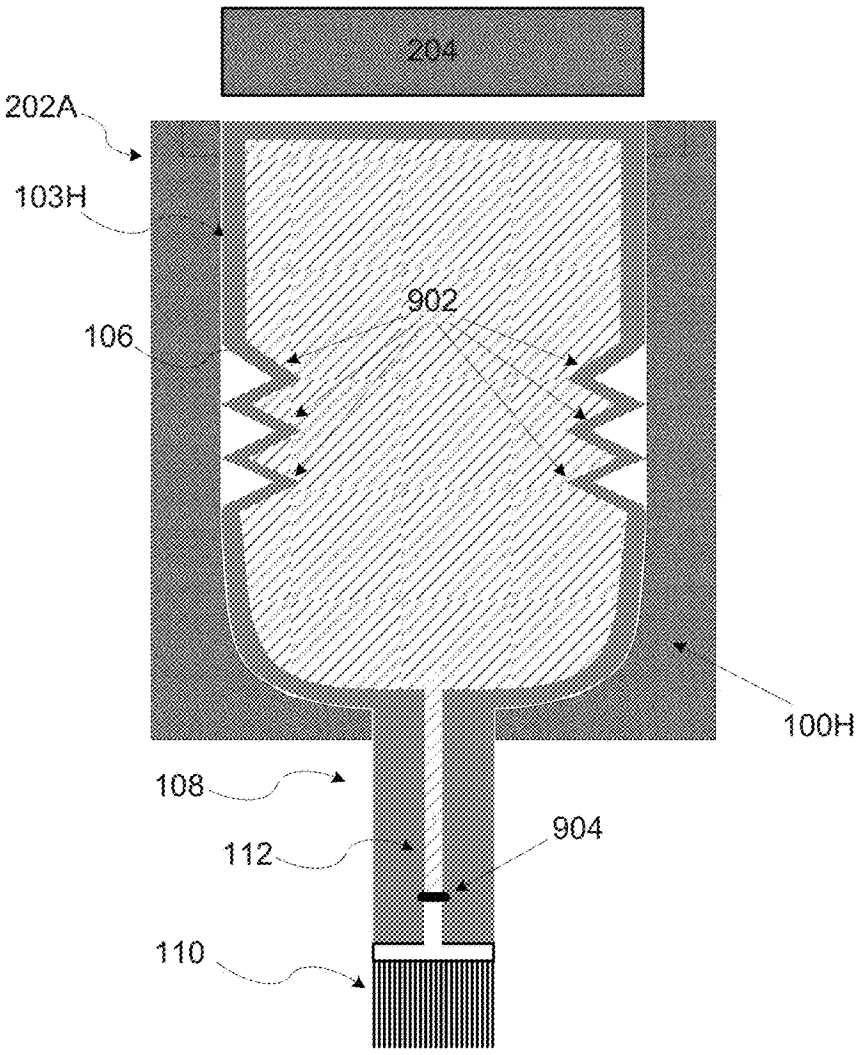

Reference is now made to FIG. 9A and FIG. 9B, which are longitudinal cross section views of an exemplary eighth embodiment of a nail polish fluid storage and dispensing capsule inserted in an exemplary dispensing compartment, according to an exemplary embodiment of the present invention. An exemplary embodiment 100H of the nail polish fluid storage and dispensing capsule 100 includes a body portion 103H such as the body portion 103 and a discharge nozzle such as the discharge nozzle 108 which includes one or more conveying tunnels such as the conveying tunnel(s) 112 and an integrated nail polish applying element such as the nail polish applying element 110. The body portion 103H defines a reservoir adapted to contain nail polish fluid such as the nail polish fluid 106. The body portion 103H is constructed as a tubular body having a circumferential lateral wall constructed with one or more annular corrugations 902 disposed about a center axis of said body portion 103H. The capsule 100H may further include one or more sealed openings 904 such as the opening 214. The opening(s) 904 may be located, for example, inside the conveying tunnel(s) 112, preventing the nail polish fluid 106 from flowing to the nail polish applying element 110. In another example, the opening(s) 904 may be located at the bottom side of the body portion 103H where the conveying tunnel 112 connects to the body portion 103H.

As shown in FIG. 9A, the capsule 100H may be inserted into the capsule compartment 202.

As shown in FIG. 9B, a pressure applying element such as the pressure applying element 204 presses down a top face of the body portion 103H. As the pressure applying element 204 moves down, the annular corrugation(s) 902 may fold (collapse) thus reducing the volume of the reservoir defined by the body portion 103H. The reduced volume may build an internal pressure in the reservoir which may fracture the body portion 103H at the sealed opening(s) 904 which may automatically open, i.e. automatically transition from the first state to the second state thus releasing the nail polish fluid 106 contained in the body portion 103H. The internal pressure may further force the released nail polish fluid 106 to flow through the conveying tunnel(s) 112 to the nail polish applying element 110.

Optionally, the opening(s) 904 is a sealing surface that is fractured by an external puncturing element such as the external puncturing element 502 to allow the nail polish fluid 106 to flow through the conveying tunnel(s) 112 to the nail polish applying element 110.

Figure 10B:
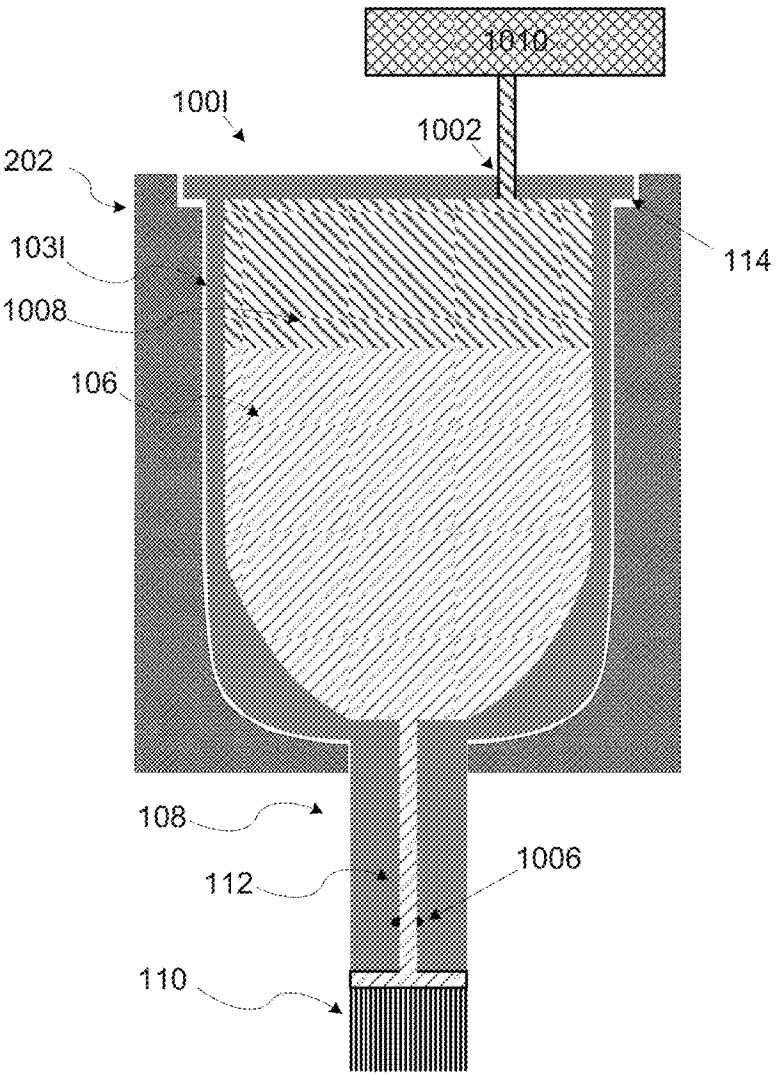
FIG. 10A and FIG. 10B are longitudinal cross section views of an exemplary ninth embodiment of a nail polish fluid storage and dispensing capsule inserted in an exemplary dispensing compartment, according to an exemplary embodiment of the present invention.
Figure 10A:
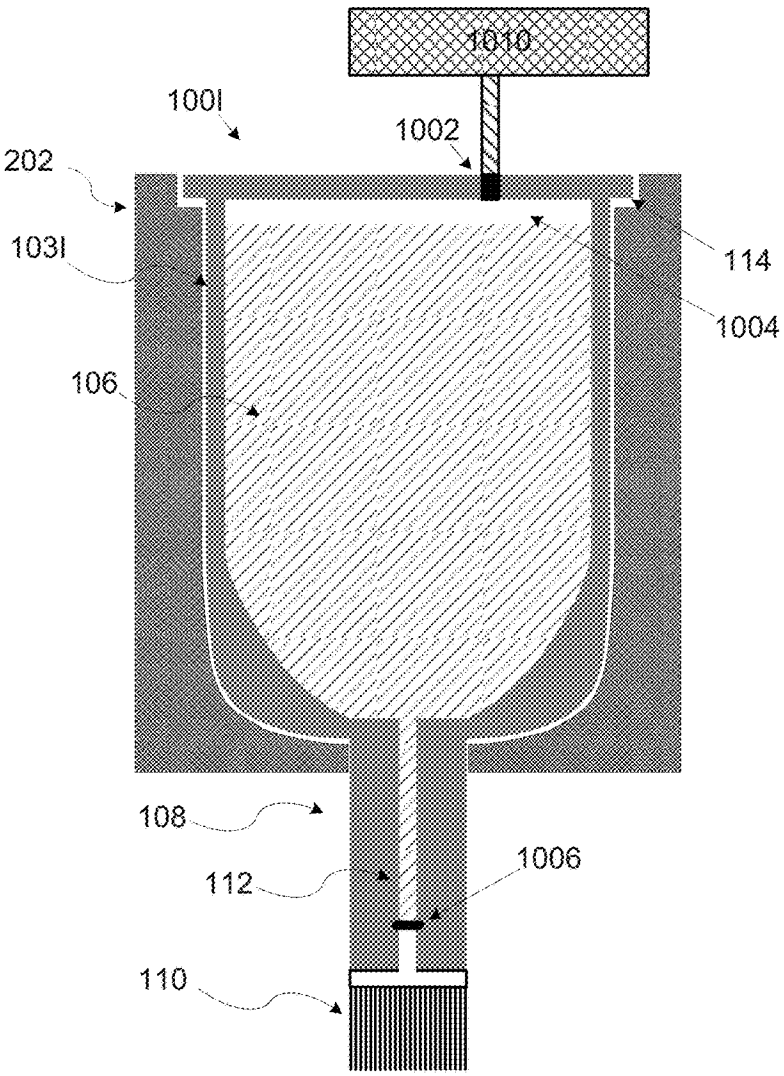

Reference is now made to FIG. 10A and FIG. 10B, which are longitudinal cross section views of an exemplary ninth embodiment of a nail polish fluid storage and dispensing capsule inserted in an exemplary dispensing compartment, according to an exemplary embodiment of the present invention. An exemplary embodiment 100I of the nail polish fluid storage and dispensing capsule 100 includes a body portion 103I such as the body portion 103 and a discharge nozzle such as the discharge nozzle 108 which includes one or more conveying tunnels such as the conveying tunnel(s) 112 and an integrated nail polish applying element such as the nail polish applying element 110. The body portion 103I defines a reservoir adapted to contain nail polish fluid such as the nail polish fluid 106. The body portion 103I includes one or more sealed injection openings 1002 that may be located at a top face of the body portion 103I and/or at a top of one or more circumferential lateral faces of the body portion 103I. The reservoir defined by the body portion 103I may contain some gas 1004, for example, air such that when the capsule 100I is inserted in a capsule compartment such as the capsule compartment 202, the injection opening(s) 1002 is above a surface level of the nail polish fluid 106 contained in the body portion 103I. The body portion 103I may also include a flange-like rim such as the flange-like rim 114 adapted for the capsule compartment 202. The capsule 100I may further include one or more openings 1006 such as the opening 214.

As shown in FIG. 10A, the capsule 100I may be inserted into the capsule compartment 202. The sealed injection opening(s) 1002 may be opened by one or more puncturing elements, for example, a needle, a sharp extrusion and/or the like which are part of the of the nail polish apparatus.

As shown in FIG. 10B, a compressor 1010 which is part of the nail polish application apparatus may inject one or more compression materials 1008, for example a gas (e.g. air and/or the like), a liquid (e.g. water, oil and/or the like)

and/or the like at high pressure into the body portion 103I through the opened injection opening(s) 1002. The injected compression material 1008 may build an internal pressure in the reservoir defined by the body portion 103I. The internal pressure in the reservoir may fracture the body portion 103I at the opening(s) 1006 which may automatically open, i.e. automatically transition from the first state to the second state thus releasing the nail polish fluid 106 contained in the body portion 103I. The internal pressure may further force the released nail polish fluid 106 to flow through the conveying tunnel(s) 112 to the nail polish applying element 110.

Optionally, the opening(s) 1006 is a sealing surface that is fractured by an external puncturing element such as the external puncturing element 502 to allow the nail polish fluid 106 to flow through the conveying tunnel(s) 112 to the nail polish applying element 110.

Figure 11C:
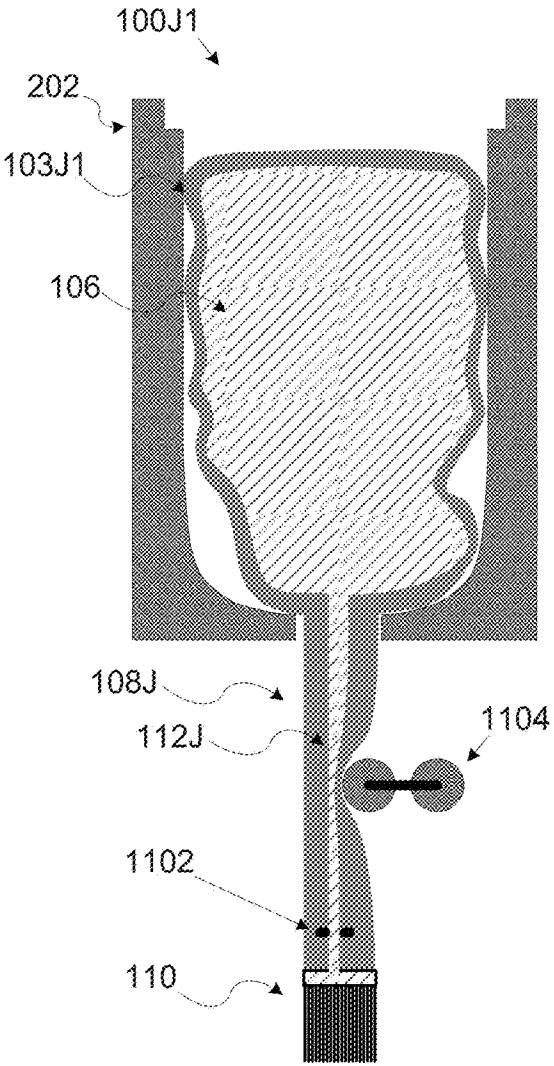
FIG. 11A, FIG. 11B and FIG. 11C are longitudinal cross section views of exemplary tenth and eleventh embodiments of a nail polish fluid storage and dispensing capsule inserted in an exemplary dispensing compartment, according to an exemplary embodiment of the present invention.
Figure 11B:
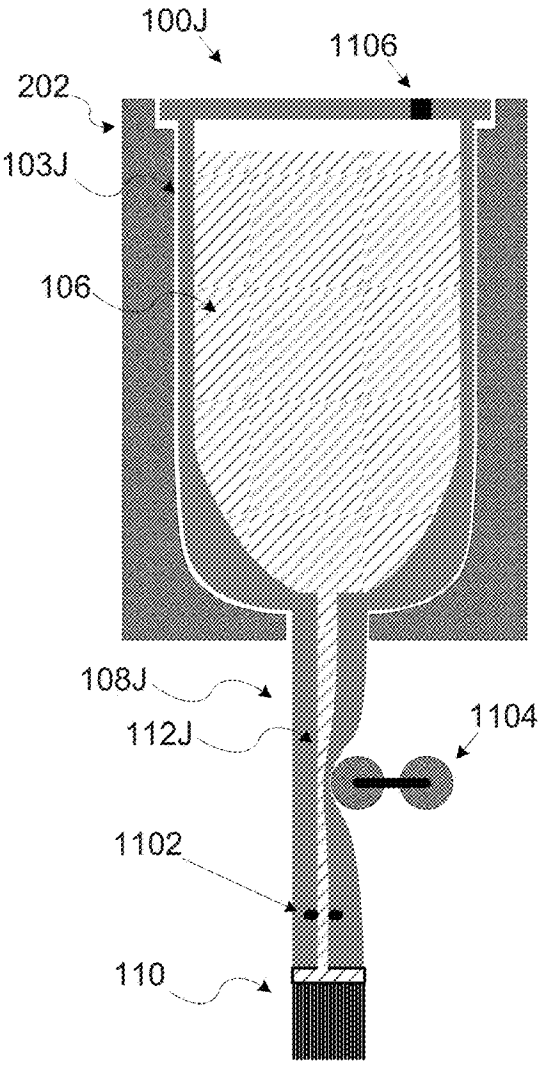
Figure 11A:
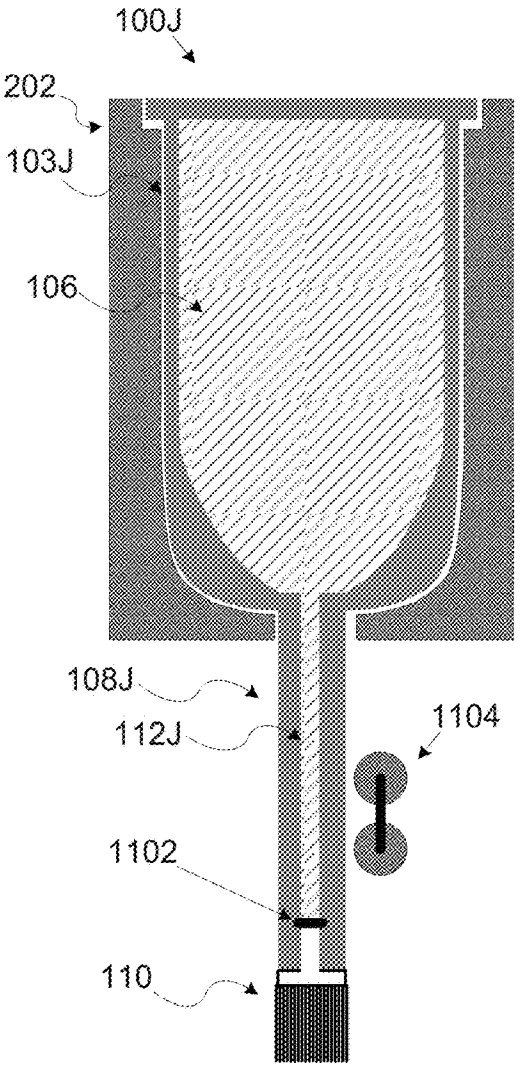

Reference is now made to FIG. 11A, FIG. 11B and FIG. 11C, which are longitudinal cross section views of exemplary tenth and eleventh embodiments of a nail polish fluid storage and dispensing capsule inserted in an exemplary dispensing compartment, according to an exemplary embodiment of the present invention. An exemplary embodiment 100J of the nail polish fluid storage and dispensing capsule 100 includes a body portion 103J such as the body portion 103 and a discharge nozzle 108J such as the discharge nozzle 108 which includes a conveying tunnel 112J such as the conveying tunnel 112 and an integrated nail polish applying element such as the nail polish applying element 110. The body portion 103J defines a reservoir adapted to contain nail polish fluid such as the nail polish fluid 106. One or more longitude faces of the conveying tunnel 112J and/or part thereof are constructed from one or more materials having a high elasticity coefficient, for example, a polymer. The high elasticity longitude face(s) of the conveying tunnel 112J may be bent and/or crumpled when pressure is applied to it. The capsule 100J may further include one or more openings 1102 such as the opening 214 that may be located in the conveying tunnel 112J.

As shown in FIG. 11A, the capsule 100J may be inserted into the capsule compartment 202.

As shown in FIG. 11B, a peristaltic pump 1104 which is part of the nail polish application apparatus may be applied to the conveying tunnel 112J, i.e. pressed against the high elasticity longitude face(s) of the conveying tunnel 112J. The peristaltic pump 1104 may induce a displacement movement in the conveying tunnel 112J which may draw (suck) the nail polish fluid 106 from the body portion 103J towards the nail polish applying element 110. The body portion 103J may include one or more air openings 1106 to allow air to come into the body portion 103J to replace the drawn nail polish fluid 106 thus preventing a vacuum in the body portion 103J and allowing the displacement movement to draw the nail polish fluid 106 from the body portion 103J. The air opening(s) 1106 that are typically closed (i.e., prior to using the capsule 100J) may be opened by one or more puncturing elements, for example, a needle, a sharp extrusion and/or the like which are part of the of the nail polish apparatus.

Optionally, the opening(s) 1102 is a sealing surface that is fractured by an external puncturing element such as the external puncturing element 502 to allow the nail polish fluid 106 to flow through the conveying tunnel(s) 112 to the nail polish applying element 110.

Optionally, as shown in FIG. 11C, one or more faces of a body portion 103K of an exemplary nail polish fluid storage and dispensing capsule 100J1 such as the nail polish fluid storage and dispensing capsule 100 are high elasticity faces constructed from one or more materials having a high elasticity coefficient. For example, the upper parts of the body portion 103J1, e.g. the top face (or part thereof) and/or the upper sections of the lateral faces of the body portion 103J1 are constructed of, for example, nylon. The high elasticity faces may crumple when low pressure exists in the reservoir defined by the body portion 100J1. The peristaltic pump 1104 may be pressed against the high elasticity longitude face(s) of the conveying tunnel 112J thus inducing the displacement movement in the conveying tunnel 112J. The displacement movement may draw the nail polish fluid 106 from the body portion 103J1 towards the nail polish applying element 110. As the nail polish fluid 106 is drawn out of the body portion 103J1, the pressure in the body portion 103J1 is reduced and the high elasticity faces of the body portion 103J1 may crumple thus preventing a vacuum in the body portion 103J1 and allowing the displacement movement to draw the nail polish fluid 106 from the body portion 103J1.

Figure 12C:
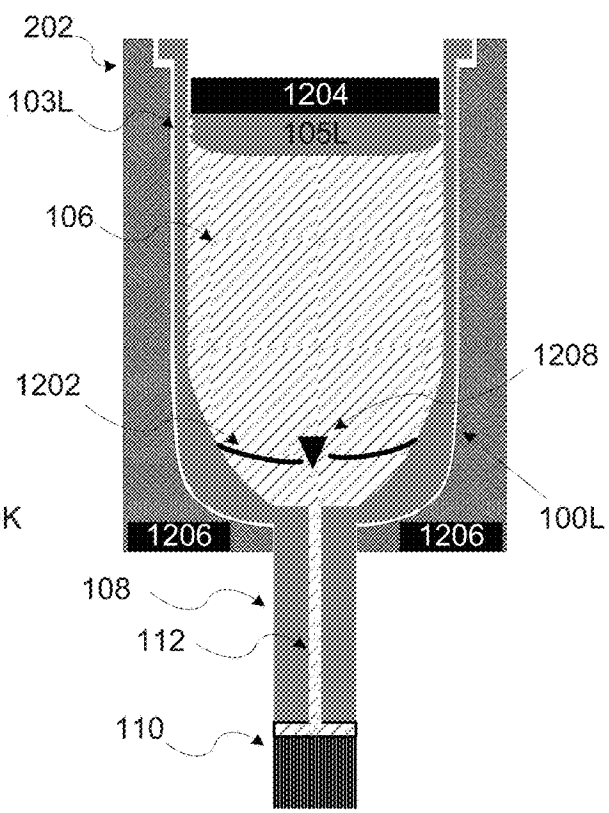
FIG. 12A, FIG. 12B and FIG. 12C are longitudinal cross section views of exemplary twelfth and thirteenth embodiments of a nail polish fluid storage and dispensing capsule inserted in an exemplary dispensing compartment, according to an exemplary embodiment of the present invention.
Figure 12B:
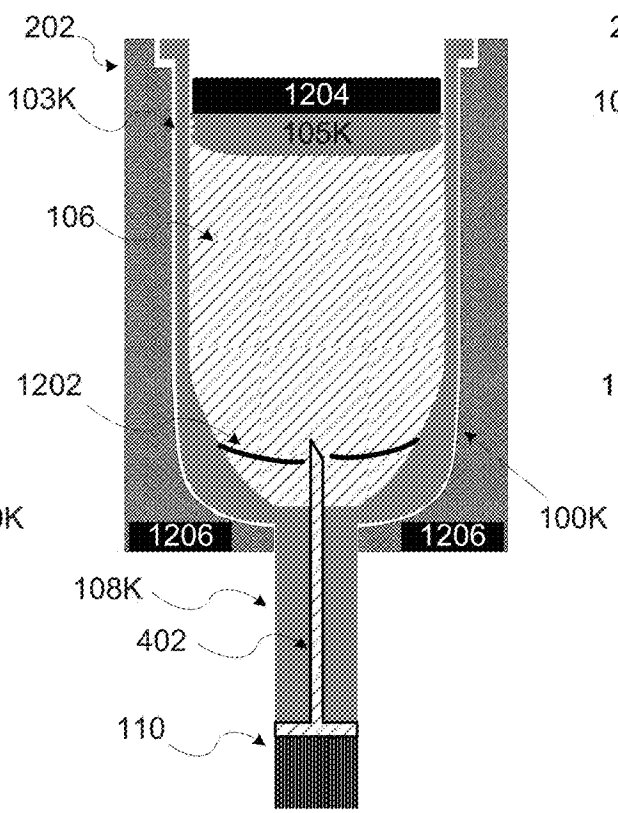
Figure 12A:
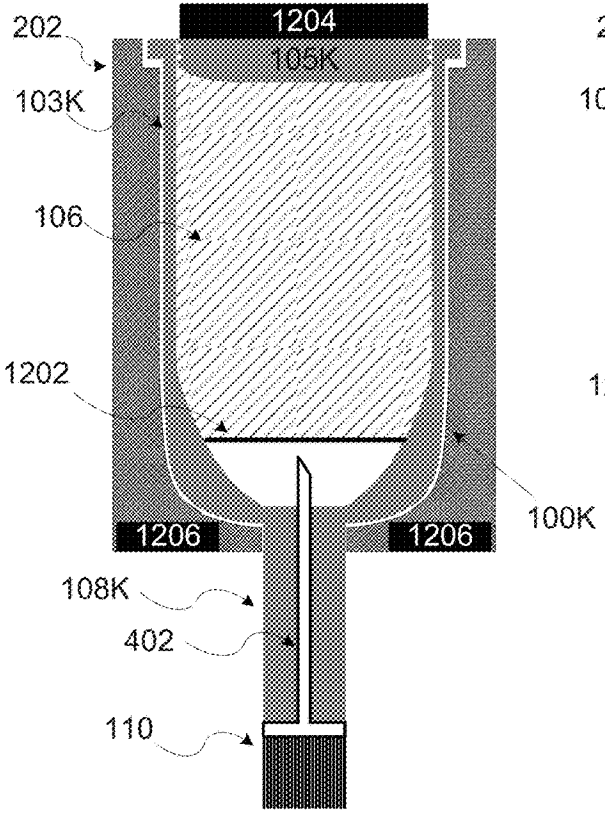

Reference is now made to FIG. 12A, FIG. 12B and FIG. 12C, which are longitudinal cross section views of exemplary twelfth and thirteenth embodiments of a nail polish fluid storage and dispensing capsule inserted in an exemplary dispensing compartment, according to an exemplary embodiment of the present invention.

FIG. 12A, FIG. 12B and FIG. 12C present an exemplary embodiment 100K of the nail polish fluid storage and dispensing capsule 100 comprising a body portion 103K such as the body portion 103 and a discharge nozzle 108K such as the discharge nozzle 108C. An opening in a top face of the body portion 103K is sealed by a sliding gasket 105K such as the sliding gasket 105E. The discharge nozzle 108K includes a piercing conveying tunnel such as the piercing conveying tunnel 402 and an integrated nail polish applying element such as the nail polish applying element 110. The body portion 103K may also include a flange-like rim such as the flange-like rim 114 adapted for a capsule compartment such as the capsule compartment 202. The body portion 103K which defines the reservoir adapted to contain nail polish fluid such as the nail polish fluid 106 further includes an internal membrane surface 1202 such as the membrane surface 702 containing the nail polish fluid in an upper portion of the body portion 103K. The capsule 100K may further include one or more magnetic element 1204 on top the sliding gasket 105K. The magnetic element 1204 that may be attracted and/or repelled according to a magnetic field applied to it. Optionally, the magnetic element 1204 is part of the nail polish application apparatus such that after inserting the capsule 100K into the capsule compartment 202, the magnetic element 1204 is placed, for example, over a top face of the body portion 103K, in particular on top the sliding gasket 105K.

As shown in FIG. 12A, the capsule 100K may be inserted into the capsule compartment 202. The membrane surface 1202 does not touch the piercing conveying tunnel 402. The capsule compartment 202 may include a locking mechanism such as the locking mechanism 206 to lock the capsule 100F using the flange-like rim 114. The capsule compartment 202 may further include one or more magnetic field generators 1206, for example, a solenoid and/or the like. The magnetic field generator(s) 1206 may generate a magnetic field when, for example, an electric current is driven through them. The direction, magnitude and/or other magnetic field parameters of the generated magnetic field may depend on the electric current characteristics. The magnetic field generator(s) 1206 may be located at the bottom of the capsule compartment 202 and adapted to generate a magnetic field to attract the magnetic element(s) 1204. Optionally, the magnetic field generator(s) 1206 are located above the capsule 100K and adapted to generate a magnetic field to repel the magnetic element(s) 1204.

As shown in FIG. 12B, the magnetic field generator(s) 1206 may induce the magnetic field to attract the magnetic material 1204 thus applying pressure on the sliding gasket 105K. Optionally, in case the magnetic field generator(s) 1206 are located above the sliding gasket 105K, the magnetic field generator(s) 1206 may induce the magnetic field to repel the magnetic material 1204 thus applying pressure on the sliding gasket 105K. The pressure applied from the top of the gasket 105K may press down the sliding gasket 105K towards the bottom side of the body portion 103K. The sliding gasket 105K moving toward the bottom side of the body portion 103K may build an internal pressure in the upper portion of the body portion 103K such that the nail polish fluid 106 contained in the upper portion of the body portion 103K presses the membrane surface 1202 towards the piercing conveying tunnel 402. The membrane surface 1202 may be pressed against the piercing conveying tunnel 402 until fractured by the piercing conveying tunnel 402. As the membrane surface 1202 is fractured, the nail polish fluid 106 is released out of the upper portion of the body portion 103K. As the sliding gasket 105K continues sliding towards the bottom side of the body portion 103K a volume of the reservoir defined by the body portion 103K is reduced increasing the internal pressure in the reservoir and forcing the released nail polish fluid 106 to flow through the piercing conveying tunnel 402 to the nail polish applying element 110.

Optionally, one or more magnetic piercing elements are disposed in the body portion. FIG. 12C presents an exemplary embodiment 100L of the nail polish fluid storage and dispensing capsule 100 comprising a body portion 103L such as the body portion 103 and a discharge nozzle such as the discharge nozzle 108. An opening in a top face of the body portion 103L is sealed by a sliding gasket 105L such as the sliding gasket 105E. The body portion 103L may also include a flange-like rim such as the flange-like rim 114 adapted for a capsule compartment such as the capsule compartment 202. The body portion 103L further includes the internal membrane surface 1202 containing the nail polish fluid in the upper portion of the body portion 103L. The capsule 100L may further include one or more magnetic elements 1204 placed on top the sliding gasket 105L. The capsule 100L further includes one or more magnetic piercing elements 1208 disposed in the nail polish fluid 106 contained by the membrane surface 1202 in the upper portion of the body portion 103L.

The capsule 100L may be inserted into the capsule compartment 202 having the magnetic field generator(s) 1206. When the magnetic field is generated by the magnetic field generator(s) 1206 (for example, excited by the electrical current), the magnetic piercing element(s) 1208 may be attracted to the source of the magnetic field, i.e. towards the magnetic field generator(s) 1206. While moving towards the magnetic field generator(s) 1206, the magnetic piercing element(s) 1208 may press against the membrane surface 1202 and as result may fracture the membrane surface 1202. Optionally, one or more ends, faces and/or sides of the magnetic piercing element(s) 1208 include sharpened ends to improve a piercing capability of the magnetic piercing element(s) 1208.

Figures 13A, 13B, 13C:
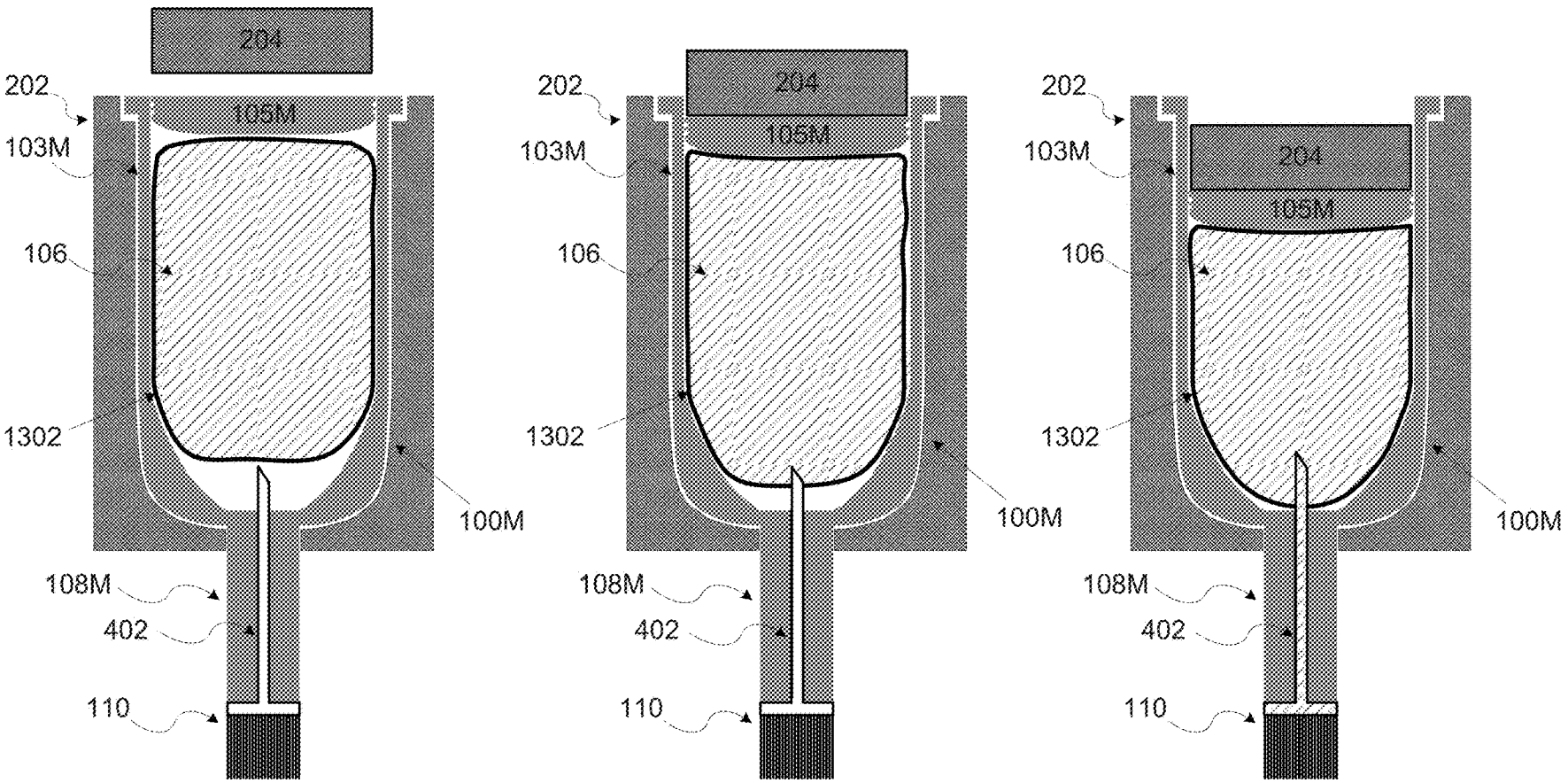
FIG. 13A, FIG. 13B and FIG. 13C are longitudinal cross section views of an exemplary fourteenth embodiment of a nail polish fluid storage and dispensing capsule inserted in an exemplary dispensing compartment, according to an exemplary embodiment of the present invention.

Reference is now made to FIG. 13A, FIG. 13B and FIG. 13C, which are longitudinal cross section views of an exemplary fourteenth embodiment of a nail polish fluid storage and dispensing capsule inserted in an exemplary dispensing compartment, according to an exemplary embodiment of the present invention. An exemplary embodiment 100M of the nail polish fluid storage and dispensing capsule 100 includes a body portion 103M such as the body portion 103 and a discharge nozzle 108M such as the discharge nozzle 108C. The discharge nozzle 108L includes a piercing conveying tunnel such as the piercing conveying tunnel 402 and an integrated nail polish applying element such as the nail polish applying element 110. The body portion 103M may also include a flange-like rim such as the flange-like rim 114 adapted for a capsule compartment such as the capsule compartment 202.

The capsule 100M further includes an inner container 1302 disposed inside the body portion 103M. While the body portion 103M defines a reservoir, the inner container 1302 contains nail polish fluid such as the nail polish fluid 106. The inner container 1302 may be disposed in the body portion 103M such that it is not in contact with the piercing conveying tunnel 402.

The capsule 100M may employ a construction of one or more of the capsule embodiments described herein above, for example, the capsule 100E having a sliding gasket 105E, the capsule 100G having one or more high elasticity faces, the capsule 100H having one or more annular corrugations and/or the like. For brevity, the mechanism of the capsule 100E is described however this should not be construed as limiting. In the described embodiment, an opening in a top face of the body portion 103M is sealed with a sliding gasket 105M such as the sliding gasket 105E.

As shown in FIG. 13A, the capsule 100M may be inserted into the capsule compartment 202. The inner container 1302 does not touch the piercing conveying tunnel 402. The capsule compartment 202 may include a locking mechanism such as the locking mechanism 206 to lock the capsule 100M using the flange-like rim 114.

As shown in FIG. 13B, a pressure applying element such as the pressure applying element 204 presses down a sliding gasket 105M which slides down towards the bottom side of the body portion 103M. The sliding gasket 105M moving toward the bottom side of the body portion 103M may press the inner container 1302 against the piercing conveying tunnel 402 until fractured by the piercing conveying tunnel 402.

As shown in FIG. 13C, once the inner container 1302 is fractured, the nail polish fluid 106 is released out of the inner container 1302 into the reservoir defined by the body portion 103M. As the sliding gasket 105M continues sliding towards the bottom side of the body portion 103M a volume of the reservoir defined by the body portion 103M is reduced thus increasing the internal pressure in the reservoir and forcing the released nail polish fluid 106 to flow through the piercing conveying tunnel 402 to the nail polish applying element 110.

Optionally, the construction of the capsule 100M employs the structure and technique described for the capsule 100B. In such embodiments, the body portion 103M includes one or more internal puncturing elements such as the internal puncturing element 304. The inner container 1302 is disposed in the body portion 103M such that it is not in contact with the internal puncturing element 304. In such embodiments, the capsule 100M may utilize a discharge nozzle such as the discharge nozzle 108.

Optionally, the inner container 1302 is fractured by an external puncturing element such as the external puncturing element 502 to allow the nail polish fluid 106 to flow through the conveying tunnel(s) 112 to the nail polish applying element 110.

Figures 14A, 14B, 14C:
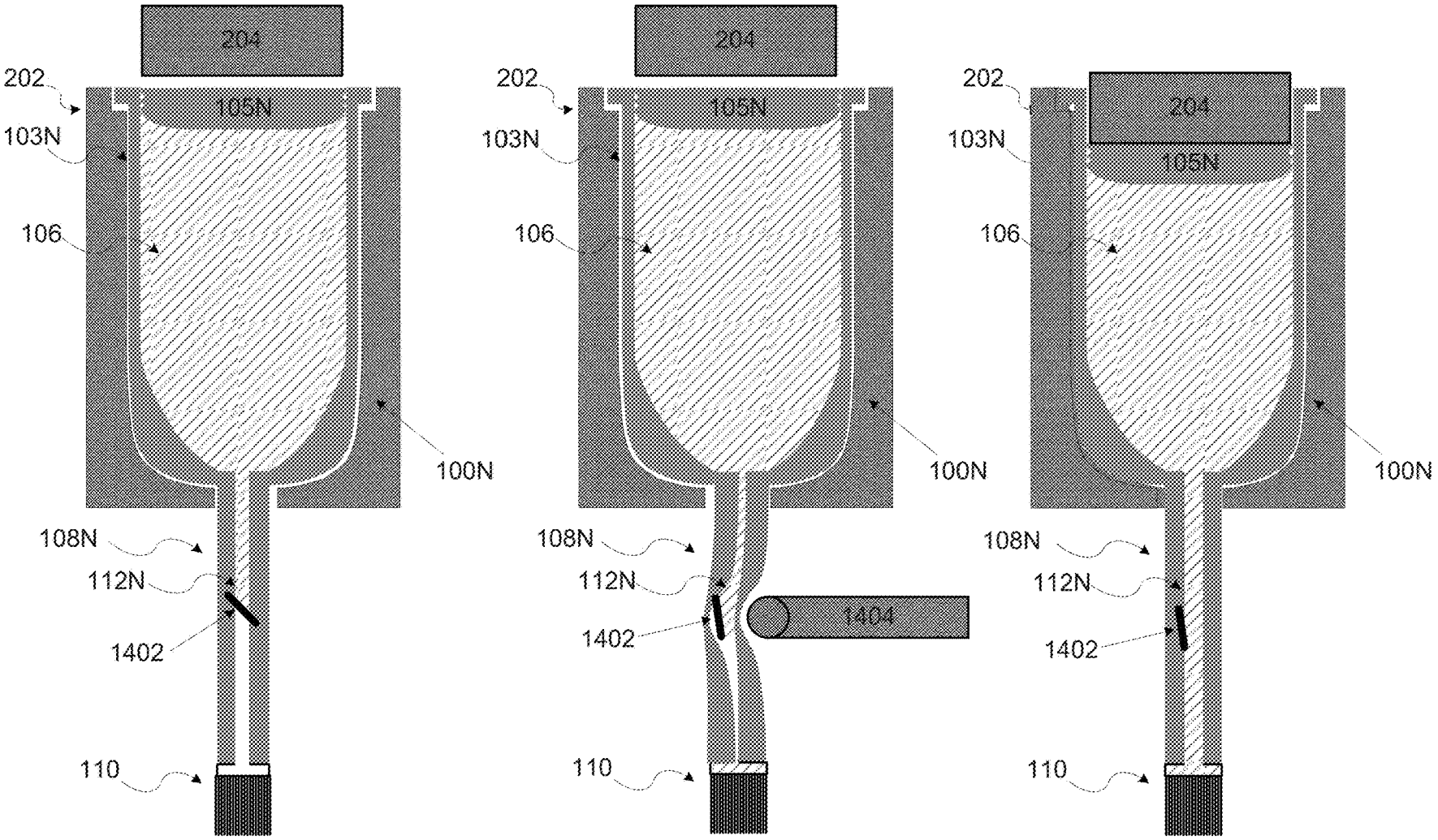
FIG. 14A, FIG. 14B and FIG. 14C are longitudinal cross section views of an exemplary fifteenth embodiment of a nail polish fluid storage and dispensing capsule inserted in an exemplary dispensing compartment, according to an exemplary embodiment of the present invention.

Reference is now made to FIG. 14A, FIG. 14B and FIG. 14C, which are longitudinal cross section views of an exemplary fifteenth embodiment of a nail polish fluid storage and dispensing capsule inserted in an exemplary dispensing compartment, according to an exemplary embodiment of the present invention. An exemplary embodiment 100N of the nail polish fluid storage and dispensing capsule 100 includes a body portion 103N such as the body portion 103 and a discharge nozzle 108N such as the discharge nozzle 108. The discharge nozzle 108N comprises one or more conveying tunnels 112N such as the conveying tunnel(s) 112 and an integrated nail polish applying element such as the nail polish applying element 110. A top opening of the body portion 103N is sealed with a sliding gasket 105N such as the sliding gasket 105E. One or more longitude faces of the conveying tunnel(s) 112N and/or part thereof are constructed from one or more materials having a high elasticity coefficient, for example, a polymer. The high elasticity longitude face(s) of the conveying tunnel 112N may be bent and/or crumpled when pressure is applied to it. One or more sealed openings 1402, for example, a weakened surface are disposed in the conveying tunnel 112N.

As shown in FIG. 14A, the capsule 100N may be inserted into a capsule compartment such as the capsule compartment 202. The sealed opening(s) 1402 form a barrier to contain the nail polish fluid 106 inside the body portion 103N.

As shown in FIG. 14B, a pressure applying element 1404 of the nail polish application apparatus may apply pressure to one or more of the longitude faces of the conveying tunnel 112N. The pressure applied by the pressure applying element 1404 may deform the conveying tunnel 112N, for example, bend, crumple and/or the like thus breaking the sealed opening(s) 1402 disposed inside the conveying tunnel 112N. Optionally, the nail polish application apparatus may use the pressure applying element 1404 and/or one or other mechanisms to deform the conveying tunnel 112N before the capsule 100N is inserted into the capsule compartment 202. In some embodiments, the user may deform manually the conveying tunnel 112N to break the sealed opening(s) 1402. The user may deform the conveying tunnel 112N before the capsule 100N is inserted into the capsule compartment 202 and/or while the capsule 100N is located in the capsule compartment 202.

As shown in FIG. 14C, once the sealed opening(s) 1402 is fractured (broken), the nail polish fluid 106 is released out of the body portion 103N inner container. As the sliding gasket 105N slides towards the bottom side of the body portion 103N, a volume of the reservoir defined by the body portion 103N is reduced thus increasing the internal pressure in the reservoir and forcing the released nail polish fluid 106 to flow through the conveying tunnel 112N to the nail polish applying element 110.

Figure 15B:
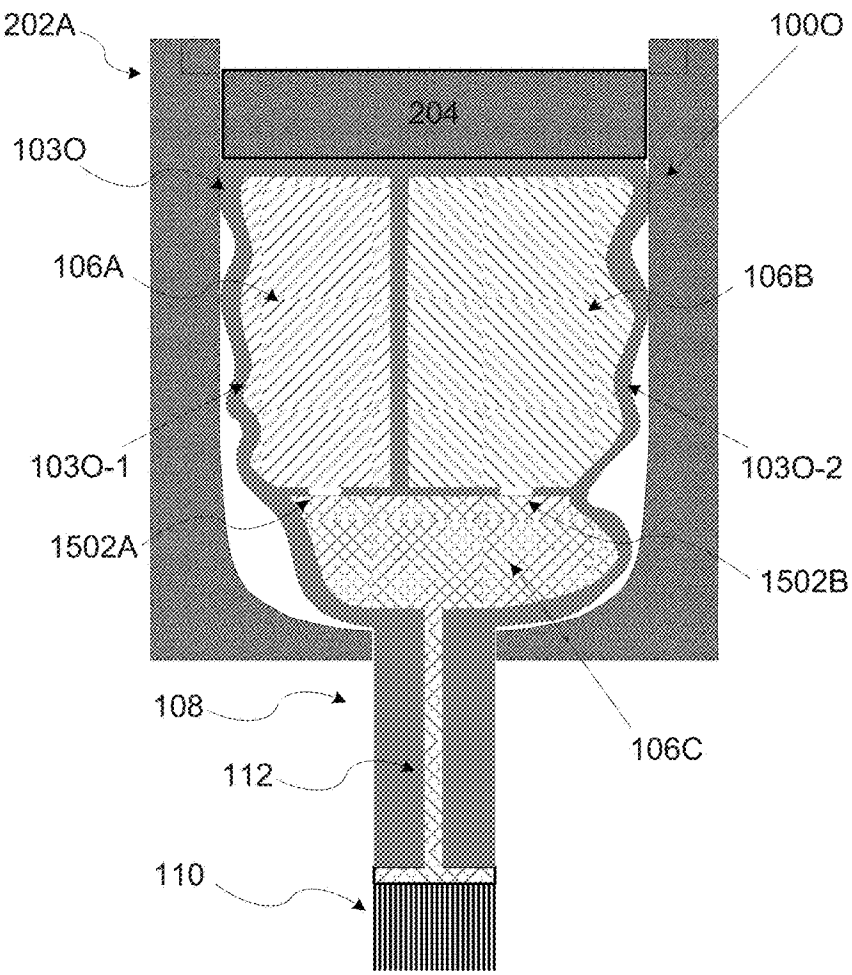
FIG. 15A and FIG. 15B are longitudinal cross section views of an exemplary sixteenth embodiment of a nail polish fluid storage and dispensing capsule inserted in an exemplary dispensing compartment, according to an exemplary embodiment of the present invention.
Figure 15A:
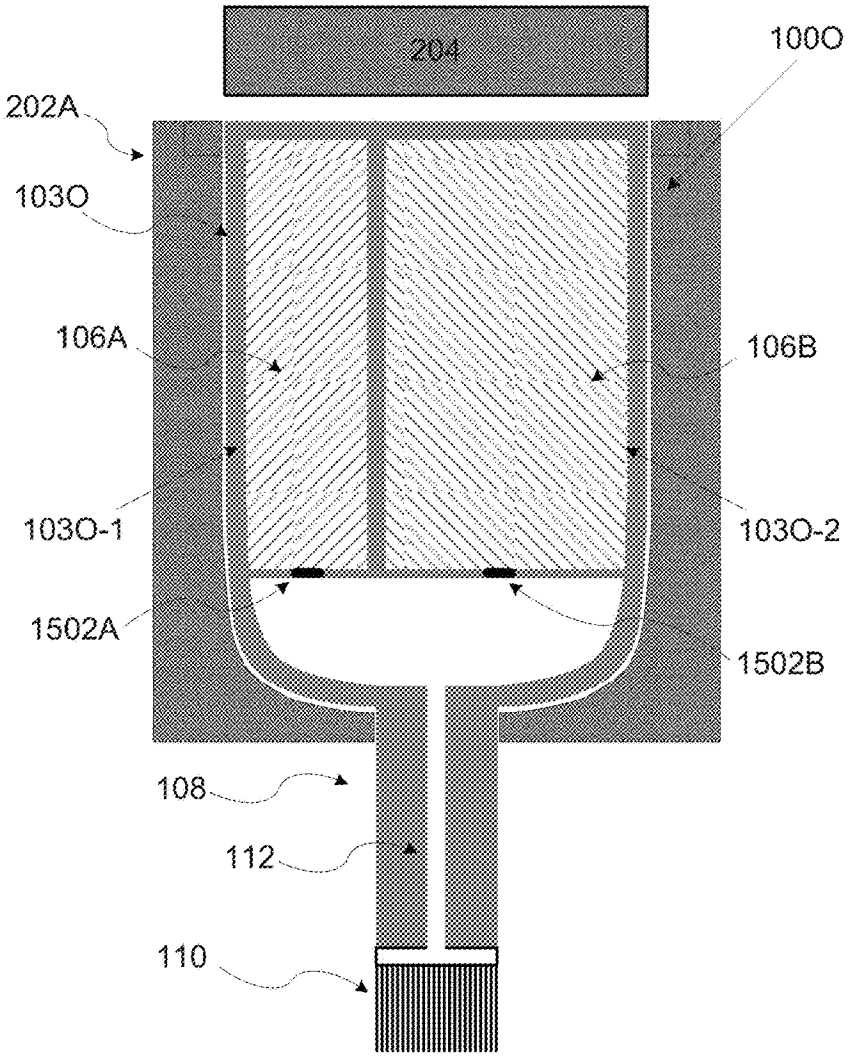

Reference is now made to FIG. 15A and FIG. 15B, which are longitudinal cross section views of an exemplary sixteenth embodiment of a nail polish fluid storage and dispensing capsule inserted in an exemplary dispensing compartment, according to an exemplary embodiment of the present invention. An exemplary embodiment 100O of the nail polish fluid storage and dispensing capsule 100, for example, the capsule 100O includes a body portion 103O such as the body portion 103 and a discharge nozzle such as the discharge nozzle 108. The body portion 103O may be divided to one or more sealed chambers, for example, 103O-1 and 103O-2 which are separated from each other by a separation wall. Each of the chambers 103O-1 and 103O-2 may contain a different type of nail polish fluid such as the nail polish fluid 106 For example, the chamber 103O-1 may contain a nail polish fluid 106A and the chamber 103O-2 may contain a nail polish fluid 106B. Each of the chambers 103O-1 and 103O-2 may include one or more openings 1502 such as the opening 214, for example, the chamber 103O-1 may include an opening 1502A and the chamber 103O-2 may an opening 1502B. Optionally, a single opening 1502 may be utilized to serve both the chamber 103O-1 and the chamber 103O-2, for example, a single opening 1502 located at one or more tangent points between the chamber 103O-1 and the chamber 103O-2, e.g. beneath the separation wall.

As shown in FIG. 15A, the capsule 100O may be inserted into a capsule compartment such as the capsule compartment 202. The sealed openings 1502A and 1502B form a barrier to contain the nail polish fluid 106 inside the respective chambers 103O-1 and 103O-2.

As shown in FIG. 15B, a pressure applying element such as the pressure applying element 204 applies pressure to one or more faces of the body portion 103O, for example, a top face. As the pressure applying element 204 moves down, the high elasticity faces of the body portion 103O may fold thus deforming the body portion 103O and reducing the volume of the reservoir defined by the body portion 103O. The reduced volume may build an internal pressure in the reservoir which may fracture the openings 1502A and 1502B which may automatically open, i.e. automatically transition from the first state to the second state thus releasing the nail polish fluids 106A and 106B contained in the chambers 103O-1 and 103O-2 respectively into the bottom portion of the body portion 103O. The two types of the nail polish fluids, 106A and 106B may mix together forming a mixed nail polish fluid 106C. The internal pressure may further force the mixed nail polish fluid 106C to flow through the conveying tunnel(s) 112 to the nail polish applying element 110.

Optionally, the opening(s) 1502A and/or 1502B are sealing surfaces that are fractured by an external puncturing element such as the external puncturing element 502 to release the nail polish fluids 106A and/or 106B from the chambers 103O-1 and/or 103O-2 respectively into the body portion 103O. As the pressure applying element 204 further deforms the body portion 103O, the increased internal pressure in the reservoir defined by the body portion 103O may force the mixed nail polish fluid 106C to flow through the conveying tunnel 112 to the nail polish applying element 110.

Figure 16B:
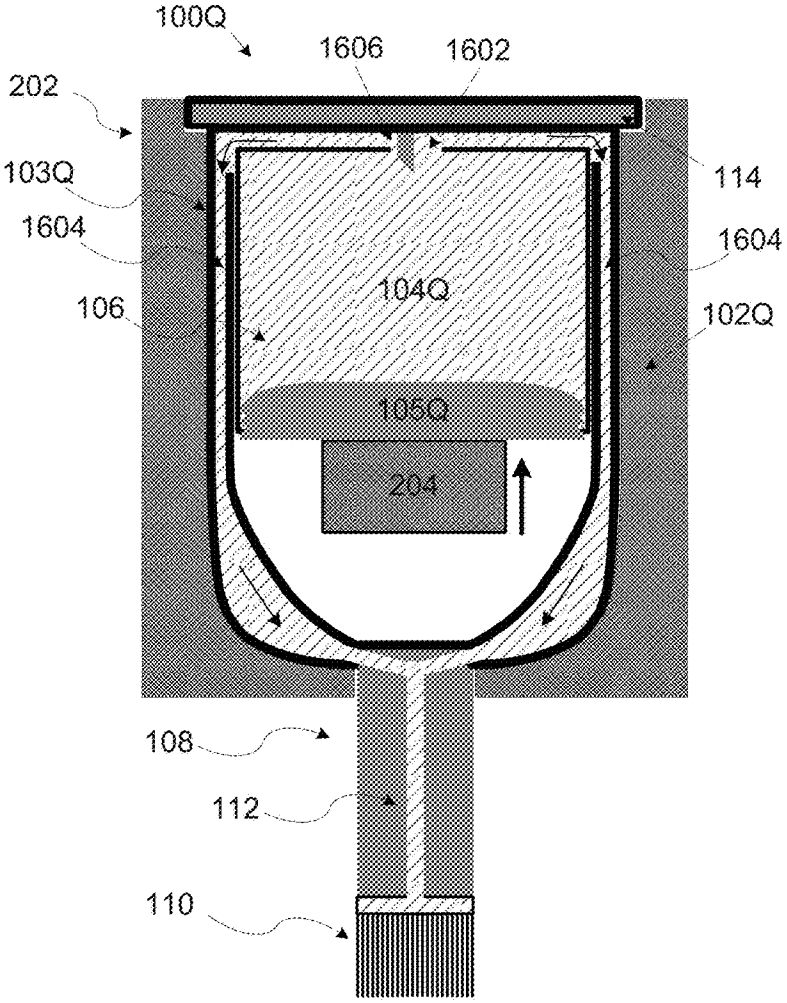
FIG. 16A and FIG. 16B are longitudinal cross section views of exemplary seventeenth and eighteenth embodiments of a nail polish fluid storage and dispensing capsule inserted in an exemplary dispensing compartment, according to an exemplary embodiment of the present invention.
Figure 16A:
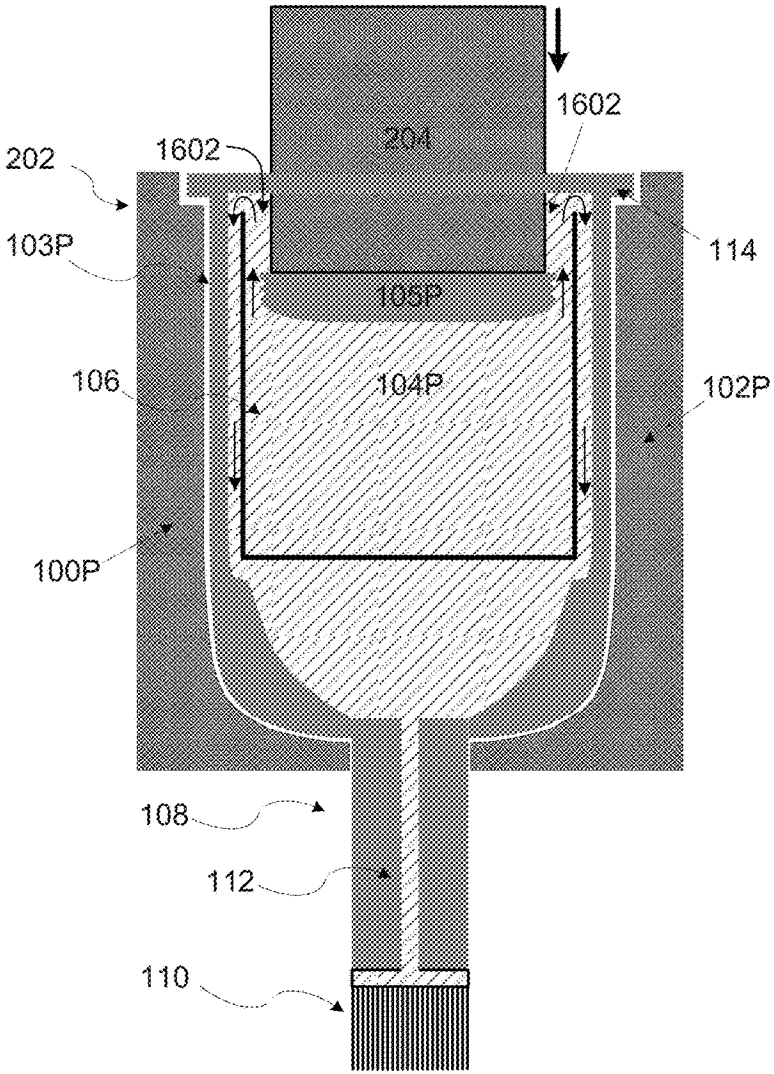

Reference is now made to FIG. 16A, and FIG. 16B, which are longitudinal cross section views of exemplary seventeenth and eighteenth embodiments of a nail polish fluid storage and dispensing capsule inserted in an exemplary dispensing compartment, according to an exemplary embodiment of the present invention.

FIG. 16A present an exemplary embodiment 100P of the nail polish fluid storage and dispensing capsule 100 comprising a container housing 102P such as the container housing 102 and a container 104P such as the container 104 sealed with a sliding gasket 105P such as the sliding gasket 105. The container housing 102P comprises a body portion 103P such as the body portion 103 and a discharge nozzle such as the discharge nozzle 108 which includes one or more conveying tunnels such as the conveying tunnel(s) 112 and an integrated nail polish applying element such as the nail polish applying element 110. The container 104P defines a reservoir adapted to contain nail polish fluid such as the nail polish fluid 106. The body portion 103P may also include a flange-like rim such as the flange-like rim 114 adapted for a capsule compartment such as the capsule compartment 202. The container 104P may include one or more opening 1602 such as the opening 214 which may be located at an upper face of the container 104P and/or at an upper end of one or more lateral faces of the container 104P. The body portion 103P may include an opening at a top face of the body portion 103P to allow a pressure applying element such as the pressure applying element 204 to apply pressure to a top side of the sliding gasket 105P. The opening in the top face of the body portion 103P may be adapted with one or more sealing elements around a perimeter of the opening to seal the body portion 103P while the pressure applying element 204 is moving inside the body portion 103P.

The capsule 100P may be inserted into a capsule compartment such as the capsule compartment 202. The pressure applying element 204 may press down the sliding gasket 105P which slides down towards the bottom face of the container 104P. The body portion 103P may include one or more stoppage elements such as the stoppage element 212 to secure the container 104P in place while the pressure applying element 204 presses against the sliding gasket 105P. As result of the sliding gasket 105P moving toward the bottom side of the body portion 103P, a volume of the reservoir defined by the container 104P is reduced thus building the internal pressure in the reservoir. The internal pressure may fracture the container 104P as the opening(s) 1602 may automatically open, i.e. automatically transition from the first state to the second state thus releasing the nail polish fluid 106 contained in the container 104P into the body portion 103P. The internal pressure may further force the released nail polish fluid 106 to flow between the circumferential walls of the container 104P and the circumferential walls of the body portion 103P and through the conveying tunnel(s) 112 to the nail polish applying element 110.

FIG. 16B present an exemplary embodiment 100Q of the nail polish fluid storage and dispensing capsule 100 comprising a container housing 102Q such as the container housing 102 and a container 104Q such as the container 104. The container housing 102Q comprises a body portion 103Q such as the body portion 103 and a discharge nozzle such as the discharge nozzle 108 which includes one or more conveying tunnels such as the conveying tunnel(s) 112 and an integrated nail polish applying element such as the nail polish applying element 110. The container 104Q defines a reservoir adapted to contain nail polish fluid such as the nail polish fluid 106. The container 104Q is adapted to have an opening in a bottom face of the container 104Q and a sliding gasket 105Q such as the sliding gasket 105 sealing the opening in the bottom face. The container 104Q may further include one or more opening 1602 such as the opening 214 which may be located at an upper face of the container 104Q. The body portion 103Q may include one or more conveying tunnels 1604 to convey the nail polish fluid 106 released from the container 104Q to the conveying tunnel 112. The body portion 103Q may also include a flange-like rim such as the flange-like rim 114 adapted for a capsule compartment such as the capsule compartment 202.

The capsule 100Q may be inserted into the capsule compartment 202 which is adapted to have a pressure applying element such as the pressure applying element 204 pushing the sliding gasket 105Q towards the top face of the container 104Q. The body portion 103Q may include one or more stoppage elements such as the stoppage element 212 to secure the container 104Q in place while the pressure applying element 204 presses against the sliding gasket 105Q. As result of the sliding gasket 105Q moving toward the top side of the body portion 103Q, a volume of the reservoir defined by the container 104Q is reduced thus building the internal pressure in the reservoir. The internal pressure may fracture the container 104Q as the opening(s) 1602 may automatically open, i.e. automatically transition from the first state to the second state thus releasing the nail polish fluid 106 contained in the container 104Q into the body portion 103Q. The internal pressure may further force the released nail polish fluid 106 to flow through the conveying tunnel(s) 1604 and through the conveying tunnel(s) 112 to the nail polish applying element 110.

Optionally, the body portion 103Q includes one or more internal puncturing elements 1606 such as the internal puncturing element 304 that may be located at the internal side of the top face of the body portion 103Q. When the container 104Q is pushed upwards towards the top face of the body portion 103Q, the internal puncturing element(s) 1606 may fracture the container 104Q thus releasing the nail polish fluid 106 contained in the container 104Q into the body portion 103Q.

Figure 17B:
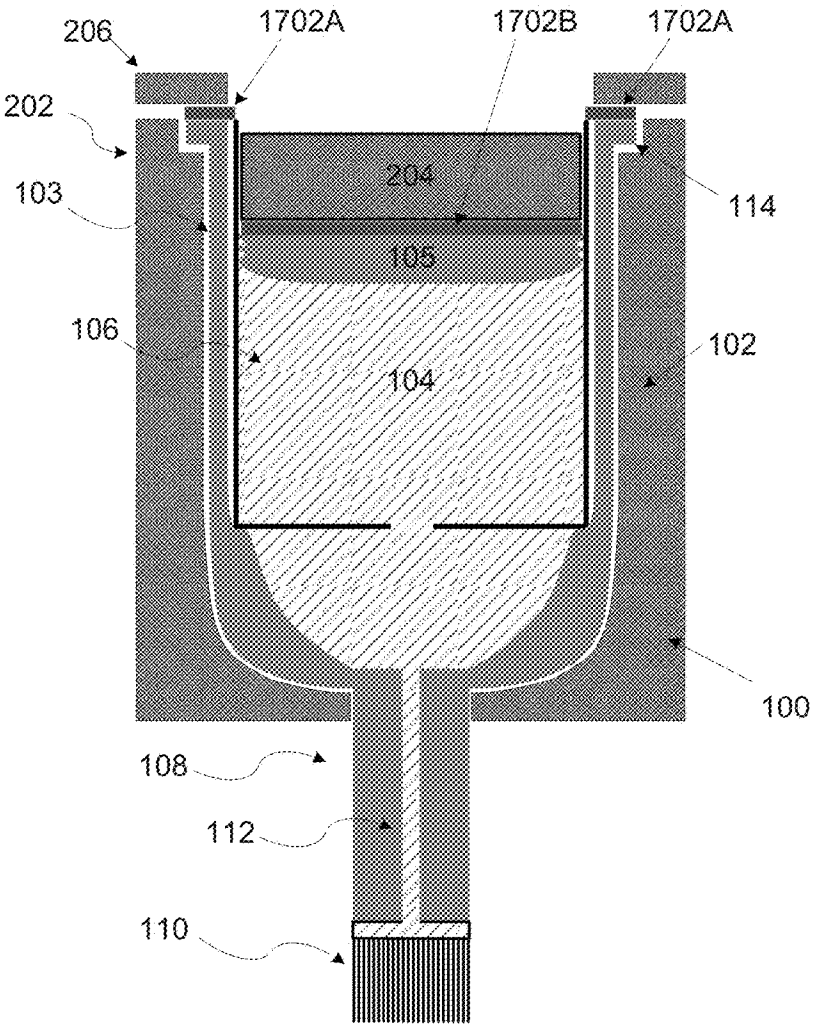
FIG. 17A and FIG. 17B are longitudinal cross section views of an exemplary nail polish fluid storage and dispensing capsule with a top seal, according to an exemplary embodiment of the present invention.
Figure 17A:
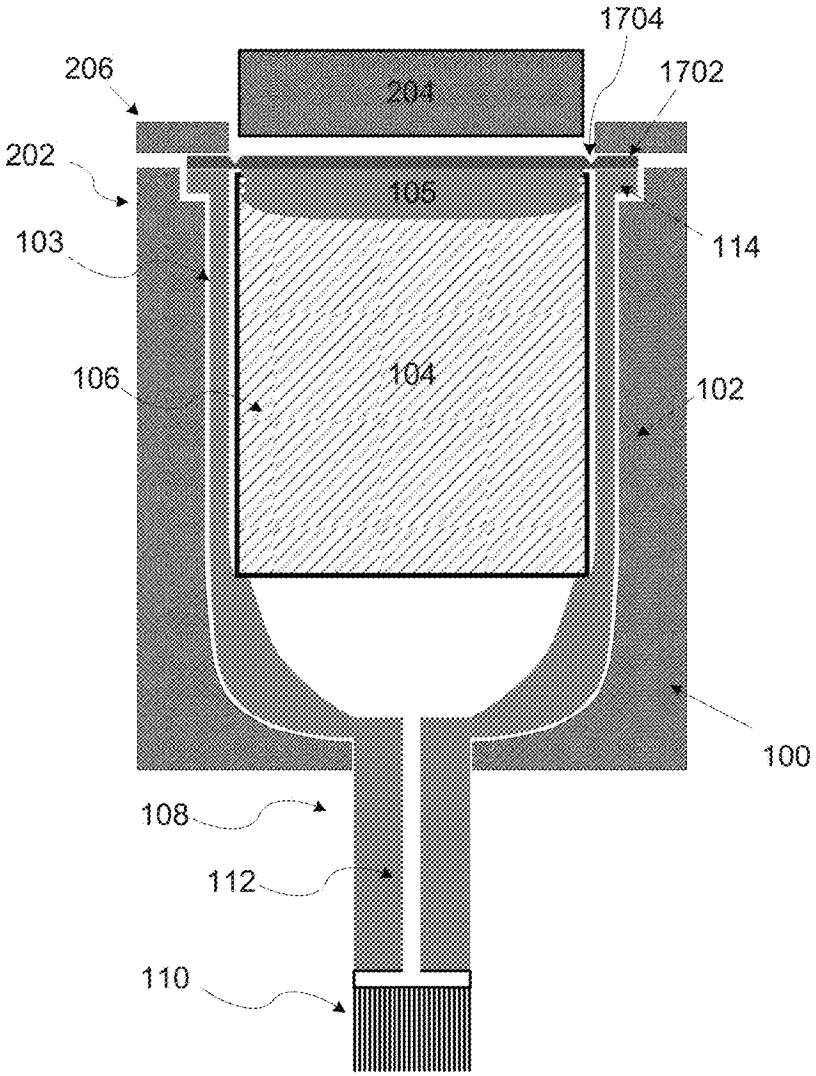

Reference is now made to FIG. 17A and FIG. 17B, which are longitudinal cross section views of an exemplary nail polish fluid storage and dispensing capsule with a top seal, according to an exemplary embodiment of the present invention. An exemplary nail polish fluid storage and dispensing capsule such as the capsule 100 includes a body portion such as the body portion 103 and a discharge nozzle such as the discharge nozzle 108 which includes one or more conveying tunnels such as the conveying tunnel(s) 112 and an integrated nail polish applying element such as the nail polish applying element 110. The capsule 100 may further be constructed of a container housing such as the container housing 102 and a container such as the container 104.

The capsule 100 may include a top seal 1702 that may seal the body portion 103 to prevent air contacting the air as well as preventing evaporation of one or more components of nail polish fluid such as the nail polish fluid 106. The top seal 1702 may be produced from one or more materials, for example, a polymer, a metal foil (e.g. and aluminum foil and/or the like), a ceramic material and/or the like. Optionally, the material(s) used to produce the top seal 1702 is characterized by a low permeability coefficient to prevent one or more components of the nail polish fluid, for example, solvents from diffusing through the top seal 1702 and evaporate over time.

The top seal 1702 may be adapted with one or more braking joints 1304, in particular a braking joint disposed around a perimeter of the body portion 103, for example, over a flange-like rim such as the flange-like rim 114.

As shown in FIG. 17A, the capsule 100E may be inserted into the capsule compartment 202. The capsule compartment 202 may include a locking mechanism such as the locking mechanism 206 to lock the capsule 100 using the flange-like rim 114. In particular, the locking mechanism 206 may press the edges (perimeter) of the top seal 1702.

As shown in FIG. 17B, a pressure applying element such as the pressure applying element 204 presses down the sliding gasket 105 which slides down towards the bottom side of the body portion 103. As result of the sliding gasket 105 moving toward the bottom side of the body portion 103, the top seal 1702 may be broken, torn, reaped and/or fractured. In particular, the top seal 1702 may break at the braking joint(s) 1304. A perimeter part 1702A of the top seal 1702 may be left at the top of the body portion 103, in particular the perimeter part 1702A may be caught between the flange-like rim 114 and the locking mechanism 206 while a central part 1702B of the top seal 1702 which is torn from the perimeter part 1702A may be caught between the pressure applying element 204 and the sliding gasket 105.

Optionally, the top seal 1702 is removed manually by the user. In some embodiments, the top seal 1702 is removed automatically by a nail polish applying apparatus prior to applying the pressure applying element 204.

Figure 18:
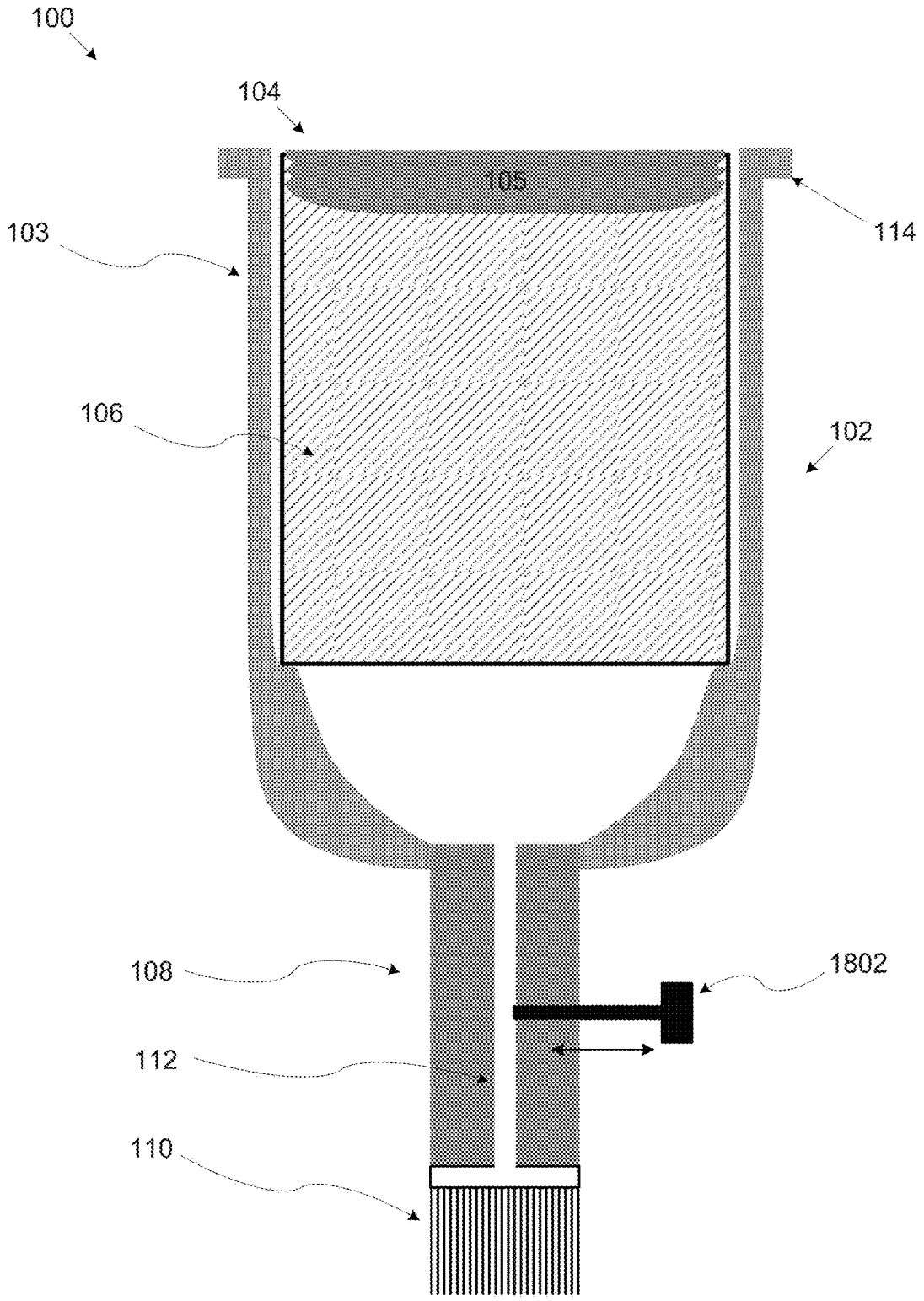
FIG. 18 is a longitudinal cross section view of an exemplary nail polish fluid storage and dispensing capsule with an adjustable shutter, according to an exemplary embodiment of the present invention.

Reference is now made to FIG. 18, which is a longitudinal cross section view of an exemplary nail polish fluid storage and dispensing capsule with an adjustable shutter, according to an exemplary embodiment of the present invention. An exemplary nail polish fluid storage and dispensing capsule such as the capsule 100 includes a body portion such as the body portion 103 and a discharge nozzle such as the discharge nozzle 108 which includes one or more conveying tunnels such as the conveying tunnel(s) 112 and an integrated nail polish applying element such as the nail polish applying element 110. The capsule 100 may further be constructed of a container housing 102 and a container 104.

The capsule 100 may include a dynamically adjustable shutter 1802 installed on the discharge nozzle 108. The shutter 1802 may be used to control a flow rate of nail polish fluid such as the nail polish fluid 106 through the conveying tunnel 112 to the nail polish applying element 110. The shutter 1802 may include a blocking element, for example, a screw, a mechanical valve, an electromagnetic valve, a press lever and/or the like that may be set to two or more operational states. In a first state, the shutter 1802 may block the flow of the nail polish fluid 106 through the conveying tunnel(s) 112. In one or more other states, the shutter 1802 is adjusted to allow at least partial flow of the nail polish fluid 106 through the conveying tunnel(s) 112.

The shutter 1802, in particular when utilized as the screw, the press lever and/or the like may be operated by a user of the nail polish application apparatus. Additionally and/or alternatively, the shutter 1802, in particular when utilized as the mechanical valve, the electromagnetic valve and/or the like may be controlled by the nail polish application apparatus. For example, the nail polish application apparatus may apply a magnetic field through the electromagnetic valve to transition between the operational states with respect to the magnitude of the magnetic field. In another example, the shutter 1802, in particular the pressing lever, may be adapted to mechanical couple (contact) a shutter control element of the nail polish application apparatus when the capsule 100 is placed in a capsule compartment such as, for example, the capsule compartment 202. The nail polish application apparatus may shift, move and/or maneuver the shutter control element to open and/or close the press lever.

Optionally, the shutter 1802 is part of the dispensing apparatus rather than the capsule 100D. For example, the shutter 1802 may be utilized by a peristaltic pump such as the peristaltic pump 1104 which may be adjusted to control the flow of the nail polish fluid 106 through the conveying tunnel(s) 112. Naturally, in such embodiments, the capsule 100 may be constructed with a discharge nozzle such as the discharge nozzle 108J of the capsule 100J.

Reference is now made to FIG. 19A, FIG. 19B, FIG. 19C, FIG. 19D, FIG. 19E, FIG. 19F, FIG. 19G, FIG. 19H, FIG. 19I, FIG. 19J, FIG. 19K and FIG. 19L, which are longitudinal cross section view of exemplary nail polish applying elements of a nail polish fluid storage and dispensing capsule, according to an exemplary embodiment of the present invention. FIG. 19A through 19J present a plurality of exemplary nail polish applying elements such as the nail polish applying element 110 integrated in a discharge nozzle such as the discharge nozzle 108 of a nail polish storage and dispensing capsule such as the capsule 100. A proximal end of the nail polish applying element 110 connects to a conveying tunnel such as the conveying tunnel 112 of the discharge nozzle 108.

Figure 19C:
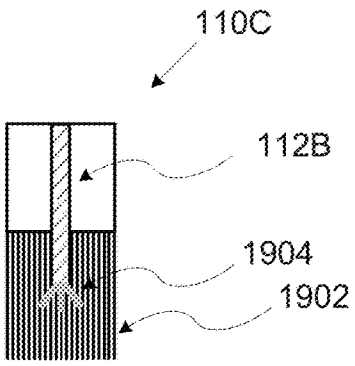
FIG. 19A, FIG. 19B, FIG. 19C, FIG. 19D, FIG. 19E, FIG. 19F, FIG. 19G, FIG. 19H, FIG. 19I, FIG. 19J, FIG. 19K and FIG. 19L are longitudinal cross section view of exemplary nail polish applying elements of a nail polish fluid storage and dispensing capsule, according to an exemplary embodiment of the present invention.
Figure 19B:
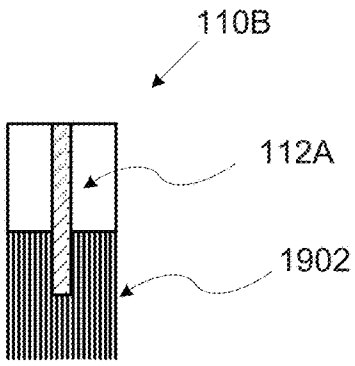
Figure 19A:
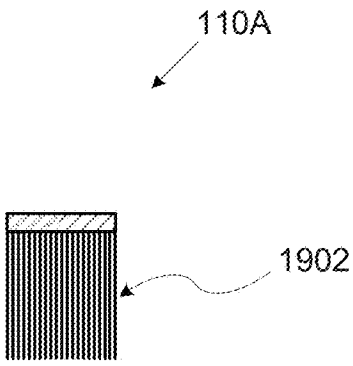

As shown in FIG. 19A, an embodiment 110A of the exemplary nail polish applying element 110 comprises a plurality of hair strands 1902. Nail polish fluid such as the nail polish fluid 106 coming out of the conveying tunnel 112 may flow over the plurality of hair strands 1902 for application on a nail surface as the hair strands 1902 move along the nail surface. The hair strands 1902 may include, for example, synthetic hair strands, organic hair strands (e.g. human, animals, etc.) and/or a combination thereof.

As shown in FIG. 19B, an embodiment 110B of the exemplary nail polish applying element 110 includes a plurality of hair strands 704 where a conveying tunnel 112A such as the conveying tunnel 112 extends into the plurality of hair strands 1902 to convey the nail polish fluid 106 in a uniform manner over the plurality of hair strands 1902.

As shown in FIG. 19C, an embodiment 110C of the exemplary nail polish applying element 110 includes a plurality of hair strands 1902. A conveying tunnel 112B such as the conveying tunnel 112 which extends into the plurality of hair strands 1902 includes one or more spraying outlets 1904 to improve uniformity of dispensing the nail polish fluid 106 over the plurality of hair strands 1902. The spraying outlets 1904 may be utilized as, for example, holes in the distal end of the conveying tunnel 112B located within the plurality of hair strands 704. The spraying outlets 1904 may be further utilized as, for example, elastic tubes extending into the plurality of hair strands 1902.

Figure 19F:
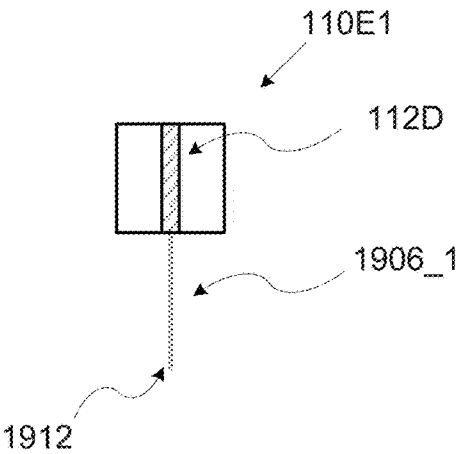
Figure 19E:
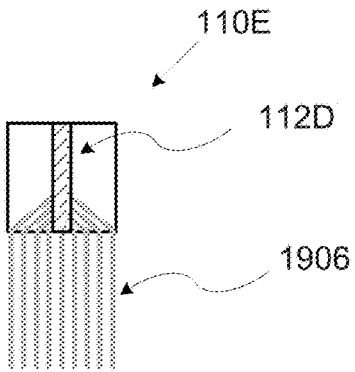
Figure 19D:
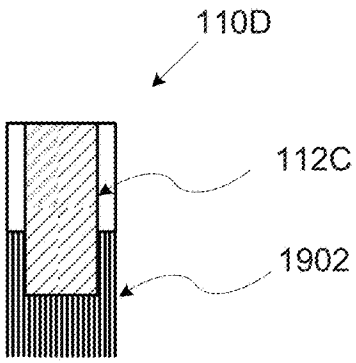

As shown in FIG. 19D, an embodiment 110D of the exemplary nail polish applying element 110 includes a plurality of hair strands 704. At least a distal opening of a conveying tunnel 112C such as the conveying tunnel 112 which extends into the plurality of hair strands 1902 is constructed as an elongated opening to convey the nail polish fluid 106 in a uniform manner over the plurality of hair strands 1902. Optionally, the conveying tunnel 112C is constructed as a strip (a slot) having an elongated profile which extends into the plurality of hair strands 1902.

As shown in FIG. 19E, an embodiment 110E of the exemplary nail polish applying element 110 includes one or more elastic tubes 1906 having an internal dispensing tunnel. The elastic tube(s) 1906 connect to a conveying tunnel 112D such as the conveying tunnel 112 to receive the nail polish fluid 106 and dispense it over the nail surface. The elastic tube(s) 1906 may be flexible to adapt to the nail surface as the elastic tube(s) 1906 move along the nail surface.

For example, as shown in FIG. 19F, an embodiment 110E1 may include a single elastic tube 1906_1 constructed as an at least partially flexible syringe needle having a hollow internal tunnel (void) for conveying the nail polish fluid 106 from the conveying tunnel(s) 112 to a nail polish applying tip 1912 of the needle 1906_1. The capsule 100 may be moved by the automated nail polish application apparatus and positioned such that the nail polish applying tip 1912 may touch the nail surface for applying the nail polish fluid 106 to the nail surface. A diameter of the internal tunnel of the needle 1906_1 may be adapted according to one or more nail polish application parameters, for example, an external diameter of the needle 1906_1, a viscosity of the nail polish fluid, a linear velocity in which the nail polish application apparatus moves the capsule 100 and/or the like.

For example, the diameter of the internal tunnel of the needle 1906_1 may be in a range of 0.1 mm to 3 mm.

Since the needle 1906_1 is flexible, the capsule 100 may be further maneuvered to position the flexible needle 1906_1 with respect to the nail surface such that the nail polish applying tip 1912 may be slightly pressed against the nail surface. Therefore, when moving the capsule for applying the nail polish fluid 106 to the nail surface, the nail polish applying tip 1912 may accurately follow and/or adjust to the shape, outline, curvatures and/or the like of the nail surface area to which the nail polish fluid 106 is currently applied. This may significantly improve the results of the nail polish application since the accurate adjustment of the nail polish applying tip 1912 to each point of the nail surface may significantly improve a distribution of the nail polish fluid 106 to the designated nail surface area. This dynamic adjustment may also significantly improve uniform leveling of the nail polish fluid 106 over the entire nail surface since the application may be done at substantially similar conditions for each point on the nail surface.

Figure 19I:
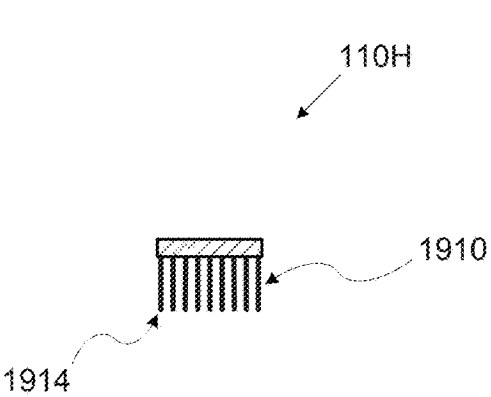
Figure 19H:
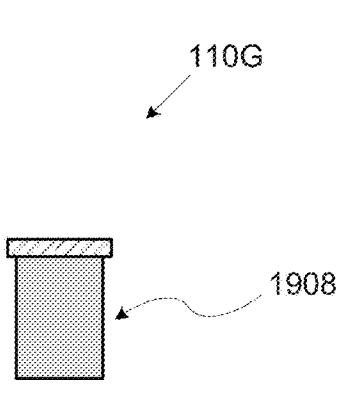
Figure 19G:
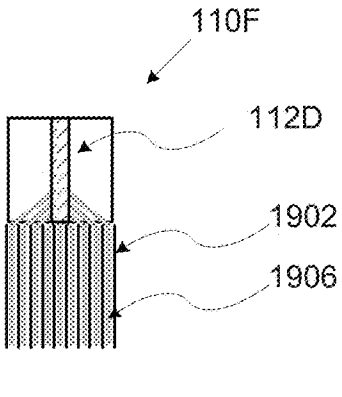

As shown in FIG. 19G, an embodiment 110F of the exemplary nail polish applying element 110 includes a combination of one or more elastic tubes 1906 and a plurality of hair strands 1902.

As shown in FIG. 19H, an embodiment 110G of the exemplary nail polish applying element 110 is constructed as an elastic wiper 1908. The nail polish fluid 106 coming from the conveying tunnel(s) 112 may flow over the wiper 1908 for application on the nail surface as the wiper 1908 moves along the nail surface. Optionally, the wiper 1908 includes one or more internal dispensing tunnel through which the nail polish fluid 106 coming from the conveying tunnel(s) 112 may flow.

As shown in FIG. 19I, an embodiment 110H of the exemplary nail polish applying element 110 is constructed with one or more solid pipes 1910. The pipes 1910 may include internal dispensing tunnel(s) that connects to the conveying tunnel(s) 112 to receive the nail polish fluid 106 and dispense it over the nail surface as the pipe(s) 1910 move along the nail surface.

Figure 19L:
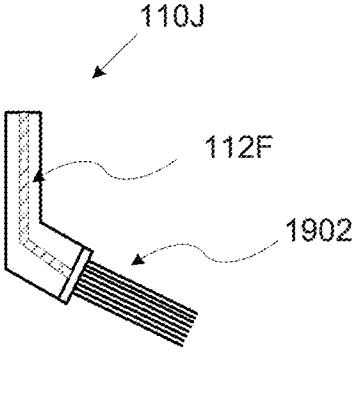
Figure 19K:
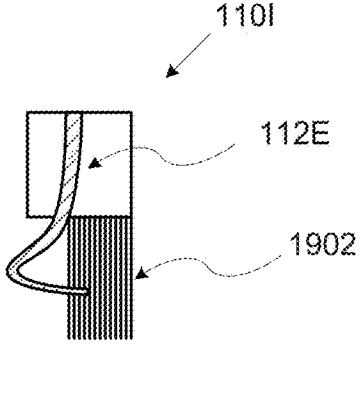
Figure 19J:
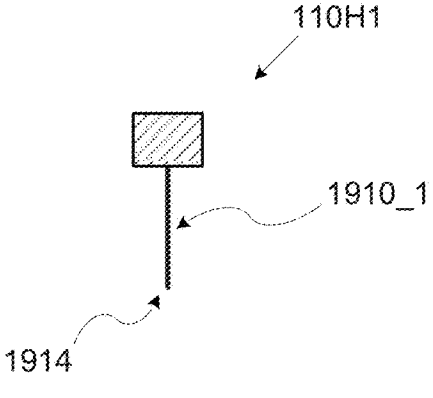

For example, as shown in FIG. 19J, an embodiment 110H1 may include a single solid pipe 1910_1 constructed as a syringe needle having a hollow internal tunnel (void) for conveying the nail polish fluid 106 from the conveying tunnel(s) 112 to a nail polish applying tip 1914 of the needle 1910_1. The capsule 100 may be moved by the automated nail polish application apparatus and positioned such that the nail polish applying tip 1914 may touch the nail surface and/or hover above the nail surface for applying the nail polish fluid 106 to the nail surface. A diameter of the internal tunnel of the needle 1910_1 may be adapted according to one or more nail polish application parameters, for example, an external diameter of the needle 1910_1, the viscosity of the nail polish fluid, a gap between the nail polish applying tip 1914 and the nail surface, the linear velocity in which the nail polish application apparatus moves the capsule 100 and/or the like. For example, the diameter of the internal tunnel of the needle 1910_1 may be in a range of 0.1 mm to 3 mm.

Positioning of the nail polish applying tip 1914 with respect to the nail surface may have major impact on the quality of the nail polish application since the positioning may affect, for example, accuracy of applying the nail polish fluid 106 to the desired nail surface area, accuracy of the painted area/line, distribution of the nail polish fluid 106 over the painted nail surface area and/or the like. To achieve best application of the nail polish fluid to the nail surface, the nail polish applying tip 1914 may be positioned at a certain height (gap) above the nail surface for example, in a range of 0 mm to 2.5 mm with an optimal gap in the range of 0 mm to 0.7 mm. However, the accuracy of the gap between the nail polish applying tip 1914 and the nail surface may depend on the diameter of the internal tunnel of the needle. The accuracy for maintaining the gap between the nail polish applying tip 1914 and the nail surface may be less significant for a small diameter of the internal tunnel and vice versa, the accuracy of the gap must be significantly high for larger diameters of the internal tunnel.

As shown in FIG. 19K, an embodiment 110I of the exemplary nail polish applying element 110 includes a plurality of hair strands 1902. A conveying tunnel 112E such as the conveying tunnel(s) 112 extends into the plurality of hair strands 1902 from an angled direction to dispense the nail polish fluid 106 over the plurality of hair strands 1902 at a location closer to the application location of the nail polish fluid 106 over the nail surface.

Typically the nail polish applying element 110 may be fixated (mechanically coupled) to the discharge nozzle 108 in a vertical position, i.e. in line with the vertical axis of the discharge nozzle 108. However, in some embodiments of the present invention the brush assembly 108 may be mechanically coupled to the discharge nozzle 108 in a vertical position with respect to the vertical axis of the discharge nozzle 108. The tilted position of the nail polish applying element 110 may be useful for applying the nail polish fluid 106 on a side and/or curved surface of the nail.

As shown in FIG. 19L, an embodiment 110J of the exemplary nail polish applying element 110 includes a plurality of hair strands 1902. The brush head 110J is fixated in a tilted position with respect to a vertical axis of the discharge nozzle 108, in particular, with respect to a proximal end of a conveying tunnel(s) 112F such as the conveying tunnel 112. The conveying tunnel 112F may be adapted to bend at its distal end towards the plurality of hair strands 1902.

It should be noted that any two or more embodiments of the nail polish applying element 110 presented herein above may be combined together. Moreover, any of the exemplary nail polish applying element 110 and/or a combination thereof may be combined with the various embodiments of the capsules 100 described in the present invention.

Figure 20:
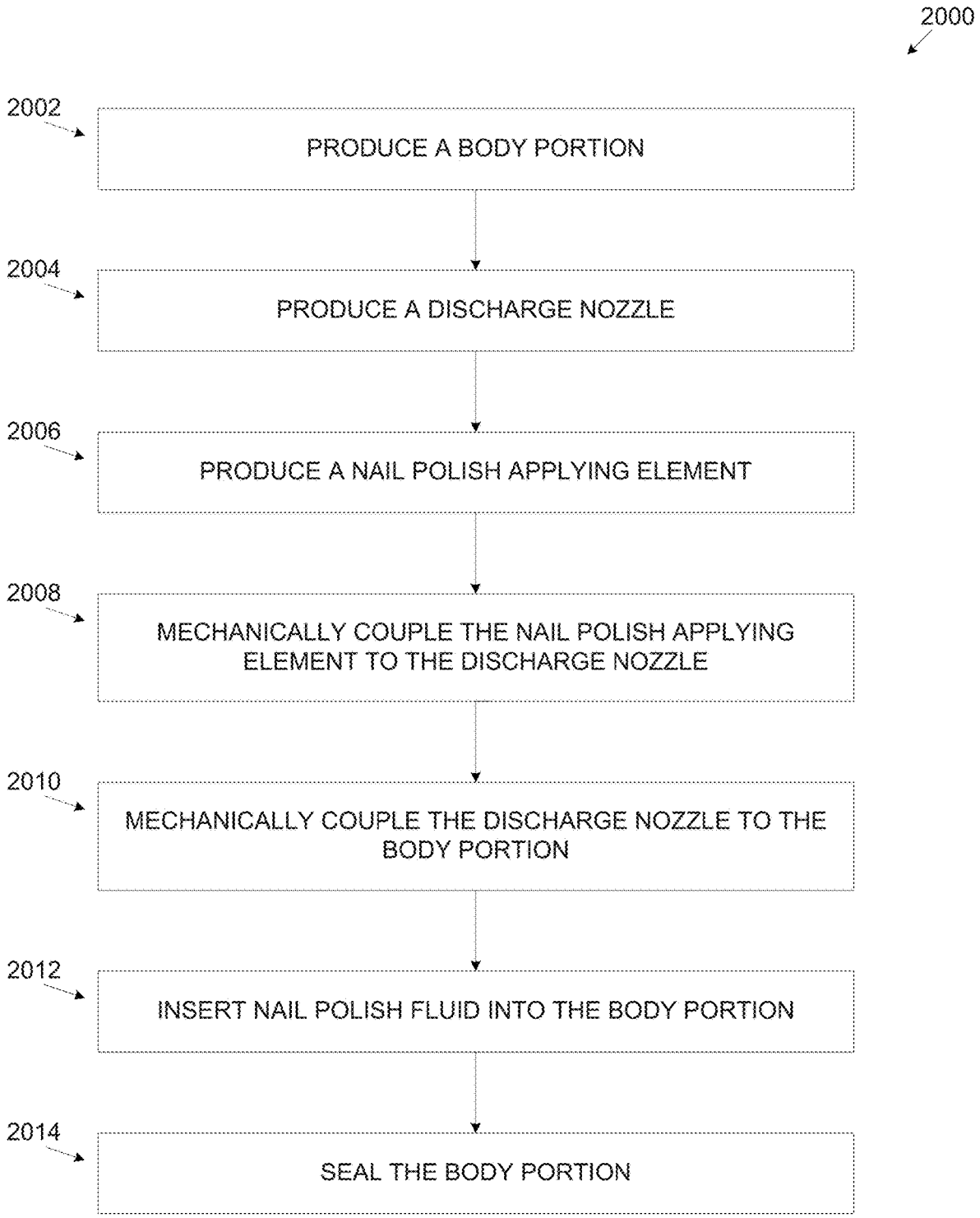
FIG. 20 is a flowchart of an exemplary process for producing an exemplary nail polish fluid storage and dispensing capsule, according to an exemplary embodiment of the present invention.

Reference is now made to FIG. 20, which is a flowchart of an exemplary process for producing an exemplary nail polish fluid storage and dispensing capsule, according to an exemplary embodiment of the present invention. An exemplary process 2000 may be applied to produce an exemplary nail polish fluid storage and dispensing capsule such as the capsule 100, for example, the capsules 100A through 100R.

As shown at 2002, the process 2000 starts with producing a body portion such as the body portion 103. The body portion 103 may be produced from one or more materials, for example, a polymer, glass, metal, a ceramic material and/or the like through one or more production methods, for example, molding, 3D printing, CNC machining and/or the like. Optionally, one or more of the material(s) used to produce the body portion 103 is characterized by a low permeability coefficient to prevent one or more components of the nail polish fluid, for example, solvents from diffusing through the body portion 103 and evaporating over time.

As shown at 2004, the process 2000 continues with producing a discharge nozzle such as the discharge nozzle 108. The discharge nozzle 108 may be produced from one or more materials, for example, a polymer, glass, metal, a ceramic material and/or the like through one or more production methods, for example, molding, 3D printing, CNC machining and/or the like.

As shown at 2006, the process 2000 continues with producing nail polish applying element such as the nail polish applying element 110. The nail polish applying element 110 may be produced in one or more configurations as described herein above using one or more materials, for example, a polymer, metal, hair strands and/or the like through one or more production methods, for example, molding, 3D printing, CNC machining and/or the like.

As shown at 2008, the nail polish applying element 110 is mechanically coupled to the discharge nozzle 108. In case the nail polish applying element 110 comprises a plurality of hair strands such as the hair strands 1902, for example, the nail polish applying elements 110A, 100B, 110C, 110D, 100F, 110H and/or 100I, the hair strands 1902 may fixated to the discharge nozzle 108 through one or more methods, for example, pinching, press fit, stapling, welding, soldering, gluing and/or the like. In case the nail polish applying element 110 comprises elastic tubes such as the elastic tube 1906, for example, the nail polish applying elements 110E and/or 100F, the elastic tube(s) 1906 may fixated to the discharge nozzle 108 through one or more methods, for example, pinching, press fit, welding, soldering, gluing and/or the like. Typically, the elastic tube(s) 1906 may be part of the discharge nozzle 108 forming a single piece produced using one or more production methods, for example, molding, 3D printing, CNC machining and/or the like. As shown at 2010, the discharge nozzle is mechanically coupled to the body portion 103, in particular attaching a proximal end (typically a top end) of the discharge nozzle 108 to a bottom face of the body portion 103. The coupling may be done through one or more methods, for example, pinching, press fit, welding, soldering, gluing and/or the like. Typically, the body portion 103 and the discharge nozzle 108 are produced as single piece using one or more production methods, for example, molding, 3D printing, CNC machining and/or the like.

As shown at 2012, nail polish fluid such as the nail polish fluid 106 is inserted into the body portion 103.

As shown at 2014, the body portion 103 filled with the nail polish fluid 106 is sealed.

Optionally, in case the capsule 100 is constructed of a container housing such as the container housing 102 and a container such as the container 104, the two parts are produced. The container housing 102 comprising the body portion 103 and the discharge nozzle 108 may be produced as described in steps 2002 through 2010. The container 104 may be produced from one or more materials, for example, a polymer, glass, metal, a ceramic material and/or the like through one or more production methods, for example, molding, 3D printing, CNC machining and/or the like. Optionally, one or more of the material(s) used to produce the container 104 is characterized by a low permeability coefficient to prevent one or more components of the nail polish fluid, for example, solvents from diffusing through the inner container 1302 and evaporating over time. The container 104 may be filled with the nail polish fluid 106 and sealed with a gasket such as the sliding gasket 105. The sliding gasket 105 may be produced from one or more materials, for example, rubber, slicing and/or the like using one or more production methods, for example, molding, 3D printing, CNC machining and/or the like.

Optionally, an inner container such as the inner container 1302 is produced from one or more materials, for example, a polymer, glass, a metal foil, a ceramic material and/or the like through one or more production methods, for example, molding, 3D printing, gluing, CNC machining and/or the like. Optionally, one or more of the material(s) used to produce the inner container 1302 is characterized by a low permeability coefficient to prevent one or more components of the nail polish fluid, for example, solvents from diffusing through the inner container 1302 and evaporating over time. The inner container 1302 may be disposed in the body portion 103 and filled with the nail polish fluid 106. The inner container 1302 as well as the body portion 103 may then be sealed.

Optionally, a top seal such as the top seal 1702 is produced from one or more materials, for example, a metal foil, a cartoon, a polymer and/or the like. The top seal 1702 may be attached to the top circumferential edge of the body portion 103 using one or more methods, for example, pinching, press fit, welding, soldering, gluing and/or the like.

Optionally, a removable cover such as the cover 116 is produced from one or more materials, for example, a metal, a polymer and/or the like. The cover 116 may employ one or more attachment techniques to the body portion 103 and/or the discharge nozzle 108, for example, placed, screwed, glued, pushed and/or the like.

Figure 21A:
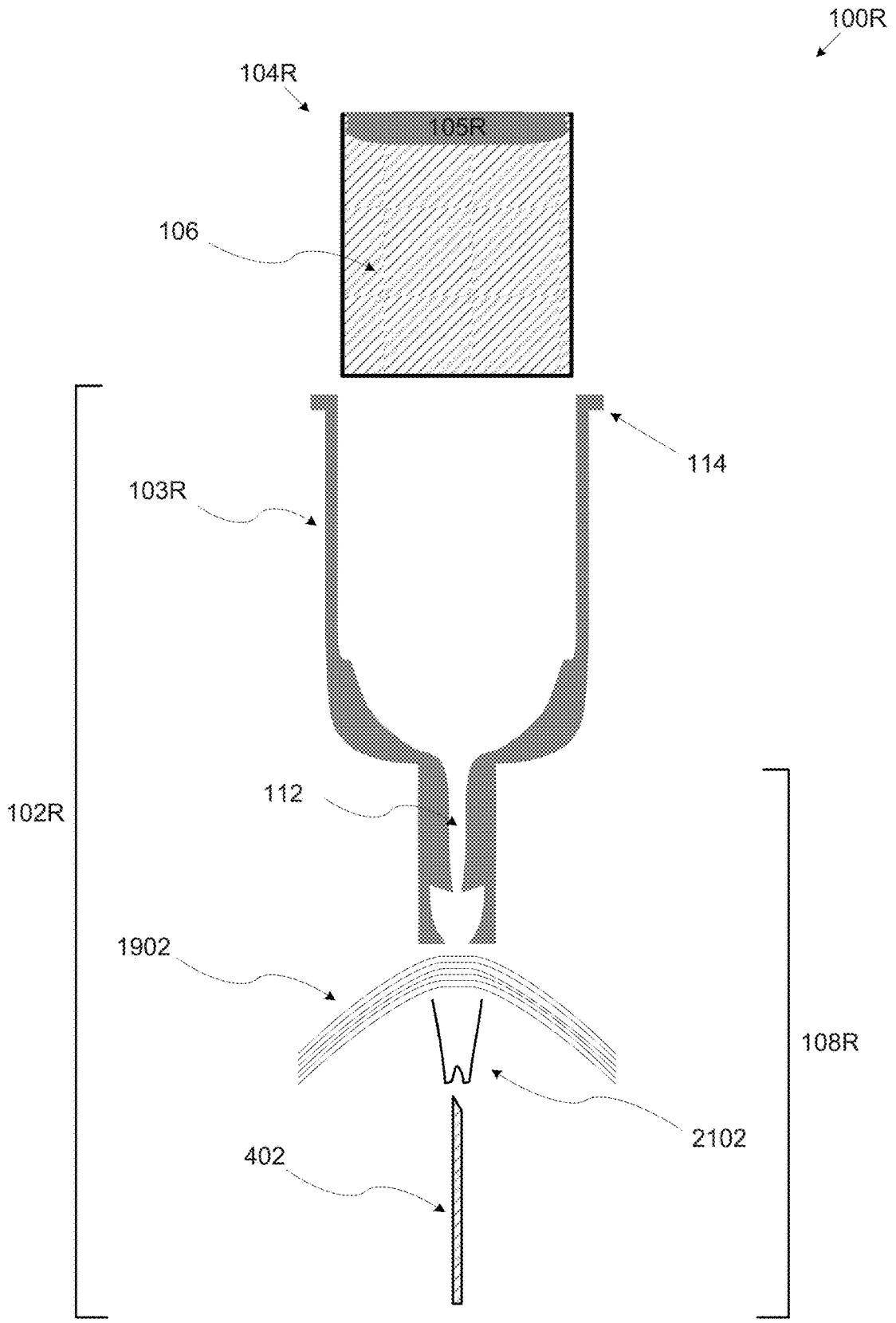
FIG. 21A and FIG. 21B are schematic illustrations of an exemplary process for assembling an exemplary nail polish fluid storage and dispensing capsule, according to an exemplary embodiment of the present invention.
Figure 21B:
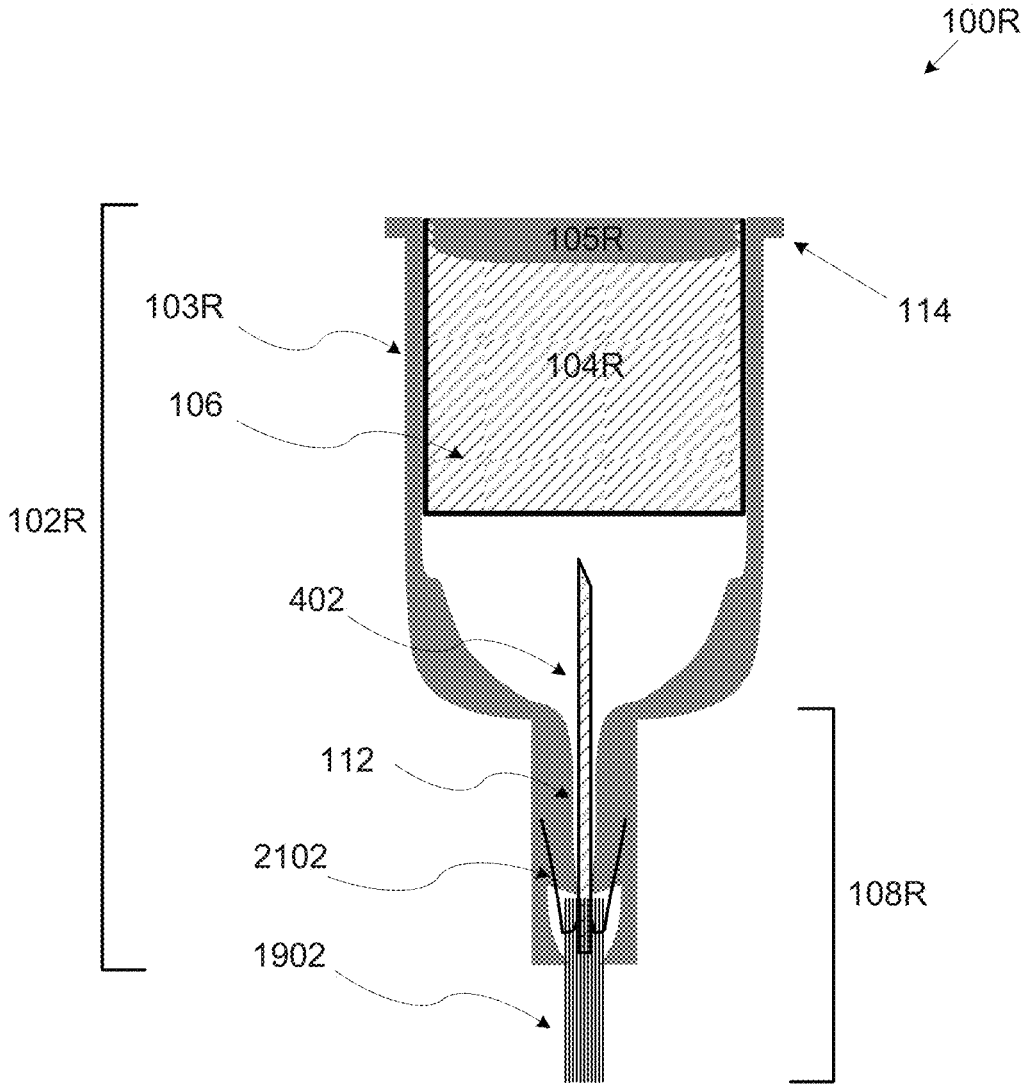

Reference is now made to FIG. 21A and FIG. 21B, which are schematic illustrations of an exemplary process for assembling an exemplary nail polish fluid storage and dispensing capsule, according to an exemplary embodiment of the present invention. FIG. 21A presents the parts of a disassembled exemplary nail polish fluid storage and dispensing capsule 100R such as the capsule 100 which may be produced using a production process such as the process 2000. The capsule 100R includes a container housing 102R such as the container housing 102 and a container 104R such as the container 104. The container housing 102R comprises a body portion 103R such as the body portion 103 and a discharge nozzle 108R such as the discharge nozzle 108, in particular, the discharge nozzle 108C. The discharge nozzle 108R and the body portion 103R form a single piece and may be produced as a single piece. A conveying tunnel such as the conveying tunnel 112 is formed as an inherent tunnel in the discharge nozzle 108R. A plurality of hair strands such as the hair strands 1902 forming a nail polish applying element such as the nail polish applying element 110 may be stapled into the discharge nozzle 108R using a bonding element 2102, for example, a metal pin, a metal wire and/or the like. A piercing conveying tunnel such as the piercing conveying tunnel 402, for example, a sharpened hollow wedge, a hollow needle and/or the like may be inserted through the conveying tunnel 112 to convey the nail polish fluid 106 to the nail polish applying element 110. The container 104R may be produced as described in the process 1800. FIG. 21B presents the assembled capsule 100R in which the parts are assembled using a process such as the process 2000.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the Applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A capsule integrated with a nail polish applying element for usage by a nail polish application apparatus, the capsule comprising:

a body portion defining a reservoir containing nail polish fluid; and the nail polish applying element fixated to a bottom face of the body portion, the nail polish applying element includes at least one solid pipe having an internal dispensing tunnel adapted to convey the nail polish fluid from the body portion and dispense the nail polish fluid on a nail surface;

wherein the capsule is adapted for releasing the nail polish fluid from the body portion through the internal dispensing tunnel for application on the nail surface by the at least one solid pipe as result of an increased internal pressure built in the reservoir when pressure is applied on the body portion by a pressure applying element of the nail polish application apparatus.

2. The capsule of claim 1, wherein the body portion comprises:

an upper face with an opening sealed with a sliding gasket, and the bottom face;

wherein the increased internal pressure is built in the reservoir as result of volume reduction of the reservoir induced by the sliding gasket adapted to press down when the pressure applying element slides towards the bottom face.

3. The capsule of claim 1, wherein the body portion comprises at least one high elasticity face having an elasticity coefficient that is higher than an elasticity coefficient of at least one other face of the body portion, wherein the nail polish fluid is released from the at least one solid pipe as result of an increased internal pressure built in the reservoir when the at least one high elasticity is deformed under pressure induced by the pressure applying element thus reducing a volume of the reservoir.

4. The capsule of claim 3, wherein the body portion is configured to release the nail polish fluid when pressure is applied by the pressure applying element on at least one lateral face of the body portion.

5. The capsule of claim 3, wherein the pressure applied by the pressure applying element is applied on a top face of the body portion.

6. The capsule of claim 1, wherein the capsule is mechanically shaped for accommodation by a capsule compartment of the nail polish application apparatus.

7. The capsule of claim 1, wherein the nail polish fluid is a member selected from a group consisting of: a nail polish fluid, a base coating fluid, a top coating fluid, a drying material, a nail art polish fluid and a medical nail treatment fluid.

8. The capsule of claim 1, wherein the nail polish fluid dispensed from the internal dispensing tunnel is applied by the at least one solid pipe on a nail surface of a human hand finger and/or a nail surface of a human foot toe.

9. The capsule of claim 1, wherein the body portion is air sealed.

10. The capsule of claim 1, wherein the capsule is configured such that the nail polish fluid is released from the body portion to the at least one solid pipe after the bottom face of the body portion is fractured at a weakened surface formed in the bottom face which is automatically fractured as result of the increased internal pressure.

11. The capsule of claim 1, wherein the capsule is configured such that the nail polish fluid is released from the container to the at least one solid pipe after the bottom face of the body portion is fractured by opening a valve located in the bottom face, the valve having a first state in which the valve is closed and a second state in which the valve is open, the valve automatically transitions from the first state to the second state as result of the increased internal pressure.

12. The capsule of claim 1, wherein the body portion is fractured by at least one external element separated from the capsule.

13. The capsule of claim 1, wherein a diameter of the dispensing tunnel is in a range of 0.1 mm to 3 mm.

14. The capsule of claim 1, wherein a diameter of the dispensing tunnel is adapted to a viscosity of the nail polish fluid.

15. The capsule of claim 1, further comprising at least one stirring object is disposed inside the reservoir defined by the capsule for stirring the nail polish fluid when the body portion is shaken.

16. The capsule of claim 1, wherein the body portion comprises at least one opening in a top face of the body portion adapted for injecting a compression material at high pressure into the body portion by the pressure applying element to build the increased internal pressure in the reservoir.

17. The capsule of claim 1, wherein the body portion has a circumferential lateral wall constructed with at least one annular corrugation disposed about a center axis of the body portion, wherein the at least one corrugation is adapted to fold under pressure induced by the pressure applying element thus reducing a volume of the reservoir and increasing the internal pressure in the reservoir.

* * * * *